US007115357B2

(12) United States Patent
Haraguchi et al.

(10) Patent No.: US 7,115,357 B2
(45) Date of Patent: Oct. 3, 2006

(54) SILVER HALIDE COLOR REVERSAL PHOTOSENSITIVE MATERIAL

(75) Inventors: Nobuyuki Haraguchi, Minami-Ashigara (JP); Masayuki Kuramitsu, Minami-Ashigara (JP); Naoto Matsuda, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/827,627

(22) Filed: Apr. 20, 2004

(65) Prior Publication Data

US 2004/0229174 A1 Nov. 18, 2004

(30) Foreign Application Priority Data

Apr. 21, 2003 (JP) ..... 2003-115831

(51) Int. Cl.

| | |
|---|---|
| ***G03C 1/46*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/505; 430/502; 430/503; 430/504; 430/506; 430/557; 430/558

(58) Field of Classification Search ..... 430/502, 430/503, 504, 505, 506, 558, 557
See application file for complete search history.

(56) References Cited

U.S. PATENT DOCUMENTS 6,656,670 B1 12/2003 Sato et al.
6,746,834 B1 * 6/2004 Kuramitsu et al. ..... 430/504

* cited by examiner

*Primary Examiner*—Geraldine Letscher
(74) *Attorney, Agent, or Firm*—Sughrue Mion, PLLC

(57) ABSTRACT

A silver halide color reversal photosensitive material comprising a blue-sensitive emulsion layer unit containing a yellow color-forming coupler, a green-sensitive emulsion layer unit containing a magenta color-forming coupler and a red-sensitive emulsion layer unit containing a cyan color-forming coupler, on a transparent support, wherein the material includes at least one interimage effect-donating layer substantially forms no image; the wavelength, λrmax, at which the maximum sensitivity of the spectral sensitivity distribution of the red-sensitive layer unit is given, satisfies the relation: 620 nm≦λrmax≦680 nm; and the sensitivities of the red-sensitive layer unit satisfy the following relationships: Sr(610) is ⅕ of Sr(λrmax) or more; Sr(680) is 1/10 of Sr(λrmax) or more; and/or Sr(690) is 1/50 of Sr(λrmax) or more wherein Sr(610), Sr(680) and Sr(690) are the sensitivities of the red-sensitive unit at 610 nm, 680 nm and 690 nm, respectively, and Sr(λrmax) is the maximum sensitivity at λrmax.

15 Claims, 1 Drawing Sheet

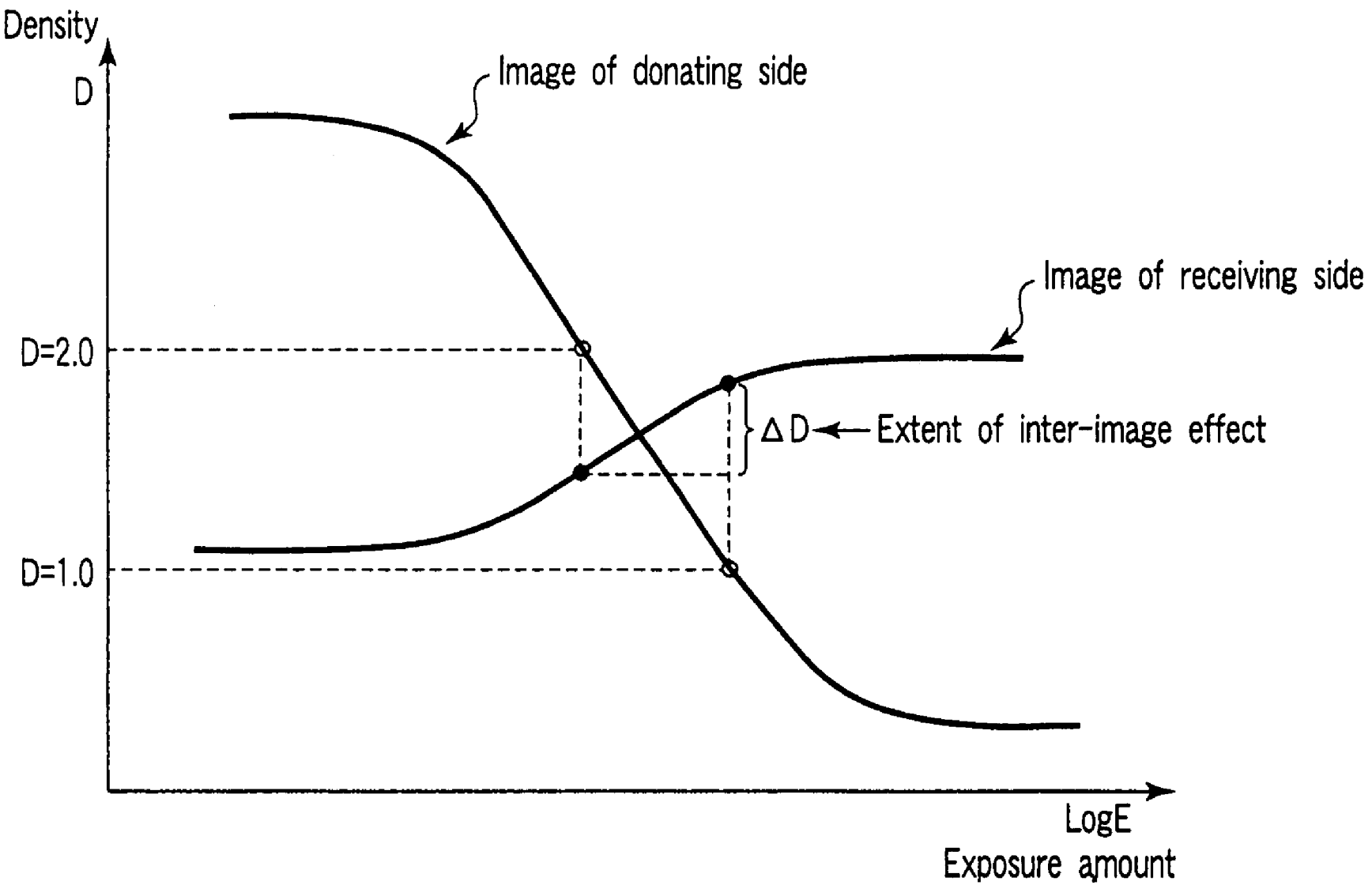
Image of receiving side
Extent of inter-image effect
ΔD
Image of donating side
Density
D
D=2.0
D=1.0
LogE
Exposure amount

SILVER HALIDE COLOR REVERSAL PHOTOSENSITIVE MATERIAL

CROSS-REFERENCE TO RELATED APPLICATIONS

This application is based upon and claims the benefit of priority from prior Japanese Patent Application No. 2003-115831, filed Apr. 21, 2003, the entire contents of which are incorporated herein by reference.

BACKGROUND OF THE INVENTION

1. Field of the Invention

The invention relates to a silver halide color reversal photosensitive material, particularly to a color reversal photosensitive material improved in color reproduction. More specifically, the invention relates to a color reversal photosensitive material suitable for landscape photography such as a sunset because of its high color saturation, and exhibits reduced fog in the case of photography under a fluorescent light.

2. Description of the Related Arts

Silver halide color reversal photosensitive materials are often used by professional photographers for originals of printing because they can directly appreciate the films after development. That is, it also plays a role of color sample for printing. Accordingly, the requirements for color reproduction are very severe. However, it is difficult to say that conventional commercial products have sufficiently answered the requirements.

One example is fog due to a fluorescent lamp. Conventional silver halide color reversal photosensitive materials have a weakness in that it gets wholly fogged on the cyan side in photography under a fluorescent lamp. The reason is that the red-sensitive layer has spectral sensitivity of longer waves and does not have sensitivity for bright lines of a fluorescent lamp. However, attempts only to prepare a red-sensitive layer with the spectral sensitivity of a shorter wave to counter the weakness results in problems of color reproduction such as decrease of color saturation or slippage of hue. Further, it is not preferable because characteristic that color reproduction of evening glow and the like becomes more reddish than actual color, which is consciously used by nature photographers as one of representations although a shortcoming from the view point of faithful color reproduction, is lost. Various attempts have always been carried out to improve color reproduction of color reversal photosensitive material.

In the case of color negative film, correction of auxiliary absorption of coloring material is generally carried out by masking using so-called colored coupler in order to obtain color reproduction with a higher color saturation and more faithfulness. In the case of color reversal photosensitive material, the correction of auxiliary absorption of coloring material by masking using the colored coupler is impossible. Therefore, an attempt to improve color reproduction by utilizing mainly an interimage effect has been carried out along with improvement in spectral sensitivity and spectral absorption property of coloring material.

For example, one of the conventional techniques includes a method for improving faithfulness in hue by using an interimage effect-donating layer containing an emulsion of silver iodide by high content (refer to pages 2 and 3 of Jpn. Pat. Appln. KOKAI Publication No. (hereinafter referred to as JP-A-) 2002-351029.

BRIEF SUMMARY OF THE INVENTION

The use of the above described method allows faithfulness in hue and color saturation to be consistent to some degree. However, studies of construction were insufficient, for example, from the viewpoint of consistency of faithfulness of color reproduction in the case of photography under a fluorescent lamp with color reproduction preferred by nature photographers.

The object of the present invention is to realize color reversal photosensitive material having excellent color reproduction preferred for sunset color with high color saturation, in addition to faithful color reproduction of hue in the case of photography under a fluorescent lamp and the like.

The object of the invention has been achieved by the following means.

(1) A silver halide color reversal photosensitive material comprising at least one blue-sensitive emulsion layer unit containing a yellow color-forming color coupler, at least one green-sensitive emulsion layer unit containing a magenta color-forming color coupler and at least one red-sensitive emulsion layer unit containing a cyan color-forming color coupler, on a transparent support, wherein the silver halide color reversal photosensitive material includes at least one interimage effect-donating layer that substantially forms no image;

the wavelength, λrmax, at which the maximum sensitivity of the spectral sensitivity distribution of the red-sensitive emulsion layer unit is given, satisfies the relation: 620 nm≦λrmax≦680 nm; and the sensitivities of the red-sensitive emulsion layer unit satisfy the following relationships:

Sr(610) is ⅕ of Sr(λrmax) or more,

Sr(680) is 1/10 of Sr(λrmax) or more, and/or

Sr(690) is 1/50 of Sr(λrmax) or more wherein Sr(610), Sr(680) and Sr(690) are the sensitivities of the red-sensitive emulsion layer unit at 610 nm, 680 nm and 690 nm, respectively, and Sr(λrmax) is the maximum sensitivity at λrmax.

(2) The silver halide color reversal photosensitive material described in (1) wherein the silver halide color reversal photosensitive material comprising at least one coupler selected from the group consisting of magenta couplers represented by the following general formula (MC-I), cyan couplers represented by the general formula (CC-I) and yellow couplers represented by the general formula (YC-I); and the at least one coupler occupies from 30 mol % to 100 mol % of image-forming couplers contained in the blue-sensitive emulsion layer unit, the green-sensitive emulsion layer unit and the red-sensitive emulsion layer unit.

(MC-I)

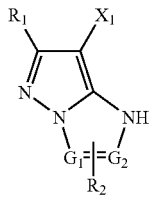

In the general formula (MC-I), $R_1$ represents a hydrogen atom or substituent; one of $G_1$ and $G_2$ represents a carbon atom, and the other represents a nitrogen atom; and $R_2$ represents a substituent that substitutes one of $G_1$ and $G_2$ which is a carbon atom. $R_1$ and $R_2$ may further have a substituent. A polymer of the general formula (MC-I) may be formed via $R_1$ or $R_2$. A polymer chain may be bonded via $R_1$ or $R_2$. $X_1$ represents a hydrogen atom or a group capable of splitting off by a coupling reaction with an oxidized aromatic primary amine color developing agent.

(CC-I)

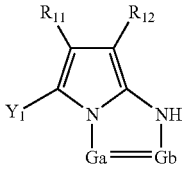

In the general formula (CC-I), Ga represents —C($R_{13}$)═ or —N═; Gb represents —C($R_{13}$)═ when Ga represents —N═, or Gb represents —N═ when Ga represents —C($R_{13}$)═. Each of $R_{11}$ and $R_{12}$ is an electron-withdrawing group with a Hammett substituent constant up value of 0.20 to 1.0. $R_{13}$ represents a substituent. $Y_1$ represents a hydrogen atom or a group capable of splitting off by a coupling reaction with an oxidized aromatic primary amine color developing agent.

(YC-I)

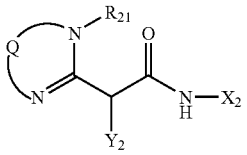

In the general formula (YC-I), Q represents a residue forming a nitrogen-containing 6-membered ring with —N—C═N— moiety. $R_{21}$ represents an alkyl group having 7 carbon atoms or more. It may be substituted by another substituent. $X_2$ represents an aryl group. $Y_2$ represents a hydrogen atom or a group capable of splitting off by a coupling reaction with an oxidized aromatic primary amine color developing agent.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

Single FIGURE is a graph for illustrating a method of evaluating extent of the interimage effect.

DETAILED DESCRIPTION OF THE INVENTION

In order to make faithfulness in hue taking account of the photography under a fluorescent lamp and the like be consistent with high color saturation, it is necessary to fulfill both ranges of the spectral sensitivity distribution and extent of the interimage effect according to the invention. Hereinafter, preferable ranges of them will be described.

In the invention, the wavelength, λrmax, which gives the maximum sensitivity in the spectral sensitivity distribution of the red-sensitive emulsion layer unit containing a cyan color-forming coupler, is 620 nm≦λrmax≦680 nm. However, determining the λrmax to be 630 nm≦λrmax≦650 nm can place the faithfulness in hue in more preferable range.

In the invention, the relation between sensitivity at 610 nm, i.e., Sr(610), sensitivity at 680 nm, i.e., Sr(680) and sensitivity at 690 nm, i.e., Sr(690); and the maximum sensitivity, i.e., Sr(λrmax), of the red-sensitive emulsion layer unit preferably satisfies the relation Sr(610)/Sr(λrmax)≧⅕ and, at the same time, at least one of the relations Sr(680)/Sr(λrmax)≧1/10 and Sr(690)/Sr(λrmax)≧1/50. Further, satisfying the relation Sr(610)/Sr(λrmax)≧⅓ and at least one of relations Sr(680)/Sr(λrmax)≧⅕ and Sr(690)/Sr(λrmax)≧1/40 is more preferable. In the invention, sensitivity representing spectral sensitivity distribution is shown by the logarithmic value of inverse number of an exposure amount necessary for making the density of each of color sensitive layer units be 1.0.

In the invention, the relation between the extent of the interimage effect IIErg from the red-sensitive emulsion layer unit to the green-sensitive emulsion layer unit and the extent of the interimage effect IIEgr from the green-sensitive emulsion layer unit to the red-sensitive emulsion layer unit is preferably IIEgr≧0.15 and IIErg≧0.0. The relation IIEgr≧0.20 enables more preferable color saturation to achieve. However, since too large IIEgr damages faithfulness in hue, the relation 2.0≧IIEgr≧0.20 is more preferable. In addition, the relation IIErg≧0.05 makes it possible to achieve more preferable color saturation. However, since too large IIErg damages faithfulness in hue, the relation 1.5≧IIErg≧0.05 is more preferable. Further, in order to intend to improve color saturation while maintaining preferable faithfulness in hue, the relation IIEgr>IIErg is preferable.

Establishing the spectral sensitivity distribution of the red-sensitive emulsion layer unit and/or the green-sensitive emulsion layer unit within a preferable range improves faithfulness in hue. However, at the same time, it is accompanied with decrease in color saturation. Therefore, when establishing the spectral sensitivity distribution within a preferable range, it is more preferable to establish the extent of IIErg and IIEgr within a preferable range at the same time.

In the invention, the wavelength λgmax giving the maximum sensitivity of spectral sensitivity distribution of the green-sensitive emulsion layer unit preferably satisfies the relation 520 nm≦λgmax≦570 nm, and more preferably 530 nm≦λgmax≦560 nm, to achieve faithfulness in hue.

Further, in the invention, it is preferable that extent of interimage effect IIEgb from the green-sensitive emulsion layer unit (GL) to the blue-sensitive emulsion layer unit (BL) and extent of inter-image from IIEbg from BL to GL satisfy the relation IIEbg≧0.15 and IIEgb≧0.0, and the relation IIEbg≧0.2 makes it possible to realize more preferable color saturation, and it is further preferable to satisfy the relation 2.0≧IIEbg≧0.2 in order not to damage largely faithfulness in hue. In addition, it is possible to achieve more preferable color saturation by establishing the relation IIEgb≧0.05, and the relation 1.5≧IIEgb≧0.05 is more preferable in order not to damage largely faithfulness in hue. Furthermore, in order to intend improve color saturation while maintaining preferable faithfulness in hue, it is more preferable to establish the relation IIEbg>IIEgb.

Establishing the spectral sensitivity distribution of the green-sensitive emulsion layer unit within a preferable range improves faithfulness in hue. However, at the same time, it is accompanied with decrease in color saturation. Therefore, when establishing the spectral sensitivity distribution within a preferable range, it is more preferable to establish the extent of IIEbg and IIEgb within a preferable range at the same time.

In the invention, there is no particular restriction on density dependency of spectral sensitivity distribution. However, it is preferable that Srmax1.0, the maximum wavelength of the spectral sensitivity distribution of the red-sensitive layer at D=1.0 and Srmax2.0, the maximum wavelength of the spectral sensitivity distribution of the red-sensitive layer at D=2.0 satisfy the relation 0 nm≦Srmax2.0-Srmax1.0≦60 nm, and satisfying the relation 10 nm≦Srmax2.0-Srmax1.0≦40 nm is more preferable.

The method for evaluating interimage effect in the invention conforms to W. T. Hanson Jr. et al., "Journal of the Optical Society of America" Vol. 42, pp 663–669. Specifically, the layer donating the interimage effect is exposed continuously and the layer receiving the interimage effect is exposed stepwise. After that, treatments shown below is conducted followed by measurement after the above descried document to define density change of the interimage effect receiving side at the integral density of 1.5 when the integral density of the interimage effect donating side decreases from 2.0 to 1.0, as shown in FIGURE, as measure of extent of the interimage effect. (Processing for evaluation of interimage effect)

| Step | Time (min) | Temp. | Tank vol. (L) | Replenishment rate |
|---|---|---|---|---|
| 1st Development | 6 | 38° C. | 37 | 2200 mL/m$^2$ |
| 1st Aater washing | 2 | 38° C. | 16 | 4000 mL/m$^2$ |
| Reversal | 2 | 38° C. | 17 | 1100 mL/m$^2$ |
| Color development | 6 | 38° C. | 30 | 2200 mL/m$^2$ |
| Prebleaching | 2 | 38° C. | 19 | 1100 mL/m$^2$ |
| Bleaching | 6 | 38° C. | 30 | 220 mL/m$^2$ |
| Fixing | 4 | 38° C. | 29 | 1100 mL/m$^2$ |
| 2nd Water washing | 4 | 38° C. | 35 | 4000 mL/m$^2$ |
| Final rinse | 1 | 25° C. | 19 | 1100 mL/m$^2$ |

(L = liter;
mL = milliliter)

The composition of each processing solution was as follows.

| (1st development solution) | Tank solution | Replenisher |
|---|---|---|
| Pentasodium nitrilo-N,N,N-trimethylenephosphonate | 1.5 g | 1.5 g |
| Pentasodium diethylenetriaminepentacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolidone | 2.5 g | 3.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1000 mL | 1000 mL |
| pH | 9.60 | 9.60 |

This pH was adjusted by the use of sulfuric acid or potassium hydroxide.

| (reversal solution) | Tank solution | Replenisher |
|---|---|---|
| Pentasodium nitrilo-N,N,N-trimethylenephosphonate | 3.0 g | same as the tank solution |
| Stannous chloride dihydrate | 1.0 g | |
| p-Aminophenol | 0.1 g | |
| Sodium hydroxide | 8 g | |
| Glacial acetic acid | 15 mL | |
| Water to make | 1000 mL | |
| pH | 6.00 | |

This pH was adjusted by the use of acetic acid or sodium hydroxide.

| (Color developer) | Tank solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 12.0 g | 12.0 g |
| Citrazinic acid | 0.5 g | 0.5 g |
| N-Ethyl-N-(β-methanesulfonamidoethyl)-3-methyl-4-aminoaniline 3/2 sulfate monohydrate | 10 g | 10 g |
| 3,6-Dithiaoctane-1,8-diol | 1.0 g | 1.0 g |
| Water to make | 1000 mL | 1000 mL |
| pH | 11.80 | 12.00 |

This pH was adjusted by the use of sulfuric acid or potassium hydroxide.

| (Prebleaching) | Tank solution | Replenisher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde/sodium bisulfite adduct | 30 g | 35 g |
| Water to make | 1000 mL | 1000 mL |
| pH | 6.30 | 6.10 |

This pH was adjusted by the use of acetic acid or sodium hydroxide.

| (Bleaching solution) | Tank solution | Replenisher |
|---|---|---|
| Disodium ethylenediaminetetraacetate dihydrate | 2.0 g | 4.0 g |

-continued

| (Bleaching solution) | Tank solution | Replenisher |
|---|---|---|
| Fe(III) ammonium ethylenediaminetetraacetate dihydrate | 120 g | 240 g |
| Potassium bromide | 100 g | 200 g |
| Ammonium nitrate | 10 g | 20 g |
| Water to make | 1000 mL | 1000 mL |
| pH | 5.70 | 5.50 |

This pH was adjusted by the use of nitric acid or sodium hydroxide.

| (Fixing solution) | Tank solution | Replenisher |
|---|---|---|
| Ammonium thiosulfate | 80 g | same as the tank solution |
| Sodium sulfite | 5.0 g | |
| Sodium bisulfite | 5.0 g | |
| Water to make | 1000 mL | |
| pH | 6.60 | |

This pH was adjusted by the use of acetic acid or aqueous ammonia.

| (Stabilizer) | Tank solution | Replenisher |
|---|---|---|
| 1,2-Benzoisothiazolin-3-one | 0.02 g | 0.03 g |
| Polyoxyethylene p-monononylphenyl ether (av. deg. of polymn. 10) | 0.3 g | 0.3 g |
| Polymaleic acid (av. mol. wt. 2,000) | 0.1 g | 0.15 g |
| Water to make | 1000 mL | 1000 mL |
| pH | 7.0 | 7.0 |

As for the light-sensitive emulsion used for the interimage effect-donating layer of the invention, any one may be utilized. But those with silver iodide content of 6% by mole or more is preferable, and those with 9 mol % or more is further preferable. Combination of a light-sensitive emulsion and a non-light-sensitive fine particle emulsion is also used preferably in an interimage effect-donating layer. Non-light-sensitive fine particles may be used in the layer containing light-sensitive emulsion, or added to a layer adjacent to the layer. There is no restriction on disposing position of the interimage effect-donating layer, but it is preferable to dispose the donor layer adjacent to or neighboring to the principal photosensitive layer. In this case, there is no restriction on content of silver iodide in the non-light-sensitive fine particle emulsion, but 3 mol % or more is preferable, and silver iodide fine particles can be preferably used. Size of the non-light-sensitive fine particle emulsion here means 0.15 μm or less, and non-light-sensitivity means that sensitivity of non-light-sensitive emulsion is apart from that of light-sensitive emulsion used in combination with the non-light-sensitive emulsion by substantially 1.5 Log E or more.

There is no restriction on spectral sensitivity characteristics of the interimage effect-donating layer, but it is preferable to dispose a light-sensitive emulsion layer being spectrally sensitized in a cyan light region and give the interimage effect to the red-sensitive layer in view of color reproduction. The layer to which such interimage effect is given may be blue-sensitive, green-sensitive or red-sensitive. In the invention, the phrase that the interimage effect-donating layer "substantially does not form image" means that it substantially does not contribute to image formation. Specifically, it means that contribution of the donor layer for coloring is 10% or less in relation to the total coloring density. Configuration, in which a donor layer of interimage effect having different spectral sensitivity distribution different from that of principal photosensitive layers such as BL, GL, RL, is disposed adjacent to or neighboring to the principal photosensitive layer, as disclosed in U.S. Pat. No. 4,663,271, (hereinafter referred to as U.S.P.) U.S. Pat. Nos. 4,705,744 and 4,707,436, JP-A's-62-160448 and 63-89850, the contents of all of which are incorporated herein by reference, is also preferably utilized.

In the interimage effect-donating layer of the invention, it is preferable to use light-sensitive emulsions having different sensitivities from each other in combination. There is no restriction on the sensitivity difference of light-sensitive emulsions, but a difference of 0.1 Log E or more but 1.0 Log E or less is preferable. There is no restriction on number of kinds of light-sensitive emulsions, but two or more but four or less is preferable.

The interimage effect-donating layer according to the invention may be a interimage effect donor unit consisting of two layers or more. In this case, light-sensitive emulsions contained in respective layers have preferably sensitivities different from each other. Preferably the difference is 0.1 Log E or more but 1.0 Log E or less. There is no restriction on number of layers, but two to four layers are preferable.

Here, evaluation of sensitivity difference in the invention is conducted, for example, according to a method described below. An emulsion coating liquid is prepared by adding each of dodecylbenzenesulfonate as a coating aid, polyvinylbenzensulfonate as a viscosity-enhancing agent, a vinylsulfon-series compound as a hardening agent and a polyethyleneoxide-series compound as a photographic characteristics improving agent to respective emulsions. Subsequently, each of these coating liquid is coated uniformly on a polyester support having been subjected to under layer processing followed by coating a surface protective layer consisting mainly of gelatin aqueous solution on it to prepare a sample. After carrying out wedge exposure, these samples are subjected to development processing using a processing solution of following composition at 20° C. for 4 minutes. followed by fixing, washing and drying. Then sensitometry is conducted to obtain each sensitivity from inverse number of exposure amount giving the density of the minimum density+0.1. Sensitivity difference is evaluated on the basis of logarithm of respective relative values.

<Processing Solution>

| | |
|---|---|
| 1-Phenyl-3-pyrazolidon | 0.5 g |
| Hydroquinone | 10 g |
| Ethylenediaminetetraacetic acid · disodium salt | 2 g |
| Potassium sulfite | 60 g |
| Boric acid | 4 g |
| Potassium carbonate | 20 g |
| Sodium bromide | 5 g |
| Diethylene glycol | 20 g |
| Sodium hydroxide to adjust pH at 10.0 | |
| Water to make 1 L | |

The photosensitive material according to the invention contains an image-forming coupler. The image-forming coupler means a coupler coupling with an oxidized color developing agent of aromatic primary amine to form an image-forming dye. Generally, a yellow coupler, magenta coupler and cyan coupler are used in combination to obtain a color image.

It is preferable to use the image-forming coupler of the invention in a light-sensitive emulsion layer that is sensitive to light with complementary color in relation to the coloring hue of the coupler. That is, a yellow coupler, a magenta coupler and a cyan coupler are added in a blue-sensitive emulsion layer, in a green-sensitive emulsion layer and in a red-sensitive emulsion layer, respectively. Further, for the purpose of improving shade depiction properties and the like, a coupler not in such complementary color relation may be used in mixture (for example, use of a cyan coupler in combination in the green-sensitive emulsion layer, and so on). The contents of all the patent specifications and publications describing the couplers shown below are incorporated herein by reference.

Yellow Couplers:

couplers represented by formulas (I) and (II) in EP502,424A;

couplers (particularly Y-28 on page 18) represented by formulas (1) and (2) in European Patent (hereinafter referred to as "EP") 513,496A;

couplers represented by formula (I) in claim 1 of EP568,037A;

couplers represented by formula (I) in column 1, lines 45 to 55 of U.S. Pat. No. 5,066,576;

couplers represented by formula (I) in paragraph 0008 of JP-A-4-274425;

couplers (particularly D-35) described in claim 1 on page 40 of EP498,381A1;

couplers (particularly Y-1 and Y-54) represented by formula (Y) on page 4 of EP447,969A1;

couplers represented by formulas (II) to (IV) in column 7, lines 36 to 58 of U.S. Pat. No. 4,476,219; and so on Magenta Couplers:

couplers described in JP-A-3-39737 (e.g., L-57, L-68, and L-77);

couplers described in EP456,257 (e.g., A-4-63, and A-4-73 and A-4-75;

couplers described in EP486,965 (e.g., M-4, M-6, and M-7;

couplers described in EP571,959A (e.g., M-45);

couplers described in JP-A-5-204106 (e.g., M-1);

couplers described in JP-A-4-362631 (e.g., M-22);

couplers represented by general formula (MC-I) described in JP-A-11-119393 (e.g., CA-4, CA-7, CA-12, CA-15, CA-16, and CA-18); and so on Cyan Couplers:

couplers described in JP-A-4-204843 (e.g., CX-1, -3, -4, -5, -11, -12, -14, and -15);

couplers described in JP-A-4-43345 (e.g., C-7, -10, -34 and, -35, and (I-1) and (I-17);

couplers represented by formulas (Ia) or (Ib) in claim 1 of JP-A-6-67385;

couplers represented by general formula (PC-1) described in JP-A-11-119393 (e.g., CB-1, CB-4, CB-5, CB-9, CB-34, CB-44, CB-49 and CB-51);

couplers represented by general formula (NC-1) described in JP-A-11-119393 (e.g., CC-1 and CC-17); and so on.

Next, the magenta coupler represented by the general formula (MC-I) will be described.

In the formula, $R_1$ represents a hydrogen atom or a substituent which may be further substituted. The substituent represented by $R_1$, for example, is preferably selected from an alkyl group (including cycloalkyl and bicycloalkyl (the same can be applied to other groups including an alkyl moiety, such as alkoxy and alkylthio)), aralkyl group, aryl group, alkoxy group, aryloxy group, amino group, acylamino group, arylthio group, alkylthio group, aminocarbonylamino group, alkoxycarbonylamino group, carbamoyloxy group, and heterocyclic thio group (to which an unsaturated ring such as a benzene ring may be condensed (the same can be applied to the heterocyclic ring to be described below)).

Examples of the substituent represented by $R_1$ can be an alkyl group (e.g., isopropyl, t-butyl, t-amyl, adamantly, 1-methylcyclopropyl, n-octyl, cyclohexyl, 2-methanesulfonylethyl, 3-(3-pentadecylphenoxy)propyl, 3-{4-{2-[4-(4-hydroxyphenylsulfonyl)phenoxy] dodecanamide}phenyl}propyl, 2-ethoxytridecyl, trifluoromethyl, cyclopentyl, and 3-(2,4-di-t-amylphenoxy) propyl); aralkyl group (e.g., benzyl, 4-methoxybenzyl, and 2-methoxybenzyl); aryl group (e.g., phenyl, 4-t-butylphenyl, 2,4-di-t-amylphenyl, and 4-tetradecanamidophenyl); alkoxy group (e.g., methoxy, ethoxy, 2-methoxyethoxy, 2-dodecylethoxy, 2-methanesulfonylethoxy, and 2-phenoxyethoxy); aryloxy group (e.g., phenoxy, 2-methylphenoxy, 4-t-butylphenoxy, 3-nitrophenoxy, 3-t-butyloxycarbamoylphenoxy, and 3-methoxycarbamoylphenoxy); amino group (including an anilino group, e.g., methylamino, ethylamino, anilino, dimethylamino, diethylamino, t-butylamino, 2-methoxyanilino, 3-acetylaminoanilino, and cyclohexylamino); acylamino group (e.g., acetamido, benzamido, tetradecanamido, 2-(2,4-di-t-amylphenoxy)butanamido, 4-(3-t-butyl-4-hydroxyphenoxy)butanamido, and 2-{4-(4-hydroxyphenylsulfonyl)phenoxy}decanamido); aminocarbonylamino group (e.g., carbamoylamino, N,N-dimethylaminocarbonylamino, morphorylcarbonylamino, phenylaminocarbonylamino, methylaminocarbonylamino, and N,N-dibutylaminocarbonylamino); alkylthio group (e.g., methylthio, octylthio, tetradecylthio, 2-phenoxyethylthio, 3-phenoxypropylthio, and 3-(4-t-butylphenoxy)propylthio); arylthio group (e.g., phenylthio, 2-butoxy-5-t-octylphenylthio, 3-pentadecylphenylthio, 2-carboxyphenylthio and 4-tetradecanamidephenylthio); alkoxycarbonyamino group (e.g., methoxycarbonylamino, and tetradecyloxycarbonyamino); carbamoyloxy group (e.g., N-methylcarbamoyloxy, and N-phenylcarbamoyloxy); heterocyclic thio group (e.g., 2-benzothiazolyl thio, 2,4-diphenoxy-1,3,5-triazole-6-thio, and 2-pyridylthio).

Among the above-mentioned groups, an alkyl group, aryl group, alkoxy group, aryloxy group, and amino group are preferable. More preferably, secondary alkyl and tertiary alkyl groups having a total of 3- to 15-carbon, and most preferably a tertiary alkyl group having a total of 4- to 10-carbon.

$X_1$ represents a hydrogen atom or a split-off group capable of splitting off by a coupling reaction with an oxidized aromatic primary amine color developing agent. Specifically, the split-off group includes a halogen atom, alkoxy group, aryloxy group, acyloxy group, alky- or aryl-sulfonyloxy group, acylamino group, alkyl- or aryl-sulfonylamido group, alkoxycarbonyloxy group, aryloxycarbonyloxy group, alkyl-, aryl-, or heterocyclic-thio group, carbamoylamino group, carbamoyloxy group, 5- or 6-memebered nitrogen-containing heterocyclic group, imido group, and arylazo group. These groups may be further substituted with the substituents represented by $R_2$.

More specifically, examples of $X_1$ are a halogen atom (e.g., a fluorine atom, chlorine atom, and bromine atom); alkoxy group (e.g., ethoxy, dodecyloxy, methoxyethylcarbamoylmethoxy, carboxypropyloxy, methylsulfonylethoxy, and ethoxycarbonylmethoxy); aryloxy group (e.g., 4-methylphenoxy, 4-chlorophenoxy, 4-methoxyphenoxy, 4-carboxyphenoxy, 4-methoxycarboxyphenoxy, 4-carbamoylphenoxy, 3-ethoxycarboxyphenoxy, 3-acetylaminophenoxy, and 2-carboxyphenoxy); acyloxy group (e.g., acetoxy, tetradecanoyloxy, and benzoyloxy); alkyl- or aryl-sulfonyloxy group (e.g., methanesulfonyloxy and toluenesulfonyloxy); acylamino group (e.g., dichloroacetylamino and heptafluorobutylylamino), alkyl- or aryl-sulfonamido group (e.g., methanesulfonamino, trifluoromethanesulfonamino, and p-toluenesulfonylamino); alkoxycarbonyloxy group (e.g., ethoxycarbonyloxy and benzyloxycarbonyloxy); aryloxycarbonyloxy group (e.g., phenoxycarbonyloxy); alkyl-, aryl-, or heterocyclic-thio group (e.g., dodecylthio, 1-carboxydodecylthio, phenylthio, 2-butoxy-5-t-octylphenylthio, and tetrazolylthio); carbamoylamino group (e.g., N-methylcarbamoylamino and N-phenylcarbamoylamino); carbamoyloxy group (e.g., N,N-dimethylcarbamoyloxy, N-phenylcarbamoyloxy, morpholin-4-yl carbonyloxy, and pyrrolidine-1-yl carbonyloxy); 5- or 6-membered nitrogen-containing heterocyclic group (e.g., imidazolyl, pyrazolyl, triazolyl, tetrazolyl, and 1,2-dihydro-2-oxo-1-pyridyl); imido group (e.g., succinimido and hydantoinyl); and arylazo group (e.g., phenylazo and 4-methoxyphenylazo). $X_1$ can also take the form of a bis coupler obtained by condensing a 4-equivalent coupler by aldehydes or ketones, as a split-off group bonded via a carbon atom.

$X_1$ is preferably a hydrogen atom, halogen atom, alkoxy group, aryloxy group, alkyl- or aryl-thio group, or 5- or 6-membered nitrogen-containing heterocyclic group that is bonded to the coupling active position via the nitrogen atom thereof, and particularly preferably, a hydrogen atom, chlorine atom, or phenoxy group that may be substituted.

One of $G_1$ and $G_2$ is a nitrogen atom, and the other is a carbon atom. $R_2$ in the formula (MC-I) is bonded to one of $G_1$ and $G_2$ which is a carbon atom.

$R_2$ represents a substituent. Examples are a halogen atom, alkyl group, aryl group, heterocyclic group, cyano group, hydroxyl group, nitro group, carboxyl group, amino group, alkoxy group, aryloxy group, acylamino group, alkylamino group, anilino group, aminocarbonylamino group, sulfamoylamino group, alkylthio group, arylthio group, alkoxycarbonylamino group, sulfonamido group, carbamoyl group, sulfamoyl group, sulfonyl group, alkoxycarbonyl group, heterocyclic oxy group, azo group, acyloxy group, carbamoyloxy group, silyloxy group, aryloxycarbonylamino group, imido group, heterocyclic thio group, sulfinyl group, phosphonyl group, aryloxycarbonyl group, acyl group, and azolyl group. These substituents may have a substituent.

More specifically, examples of a substituent represented by $R_2$ are a halogen atom (e.g., a chlorine atom and bromine atom); alkyl group (e.g., a 1- to 32-carbon, straight-chain or branched-chain alkyl group, cycloalkyl group; more specifically, methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy] dodecanamido}phenyl}propyl, 2-ethoxytridecyl, trifluoromethyl, cyclopentyl, and 3-(2,4-di-t-amylphenoxy)propyl); aryl group (e.g., phenyl, 4-t-butylphenyl, 2,4-di-t-amylphenyl, and 4-tetradecanamidophenyl); heterocyclic group (e.g., 2-furyl, 2-thienyl, 2-pyrimidinyl, and 2-benzothiazolyl); cyano group; hydroxyl group; nitro group; carboxyl group; amino group; alkoxy group (e.g., methoxy, ethoxy, 2-methoxyethoxy, 2-dodecylethoxy, and 2-methanesulfonylethoxy); aryloxy group (e.g., phenoxy, 2-methylphenoxy, 4-t-butylphenoxy, 3-nitrophenoxy, 3-t-butyloxycarbamoylphenoxy, and 3-methoxycarbamoylphenoxy); acylamino group (e.g., acetamido, benzamido, tetradecanamido, 2-(2,4-di-t-amylphenoxy)butanamido, 4-(3-t-butyl-4-hydroxyphenoxy)butanamido, 2-{4-(4-hydroxyphenylsulfonyl)phenoxy}decanamido); alkylamino group (e.g., methylamino, butylamino, dodecylamino, diethylamino, and methylbutylamino); anilino group (e.g., phenylamino, 2-chloroanilino, 2-chloro-5-tetradecanaminoanilino, 2-chloro-5-dodecyloxycarbonylanilino, N-acetylanilino, and 2-chloro-5-{α-(3-t-butyl-4-hydroxyphenoxy) dodecanamido}anilino); aminocarbonylamino group (e.g., phenylaminocarbonylamino, methylaminocarbonylamino, and N,N-dibutylaminocarbonylamino); sulfamoylamino group (e.g., N,N-dipropylsulfamoylamino and N-methyl-N-decylsulfamoylamino); alkylthio group (e.g., methylthio, octylthio, tetradecylthio, 2-phenoxyethylthio, 3-phenoxypropylthio, and 3-(4-t-butylphenoxy)propylthio); arylthio group (e.g., phenylthio, 2-butoxy-5-t-octylphenylthio, 3-pentadecylphenylthio, 2-carboxyphenylthio, and 4-tetradecanamidophenylthio); alkoxycarbonylamino group (e.g., methoxycarbonylamino and tetradecyloxycarbonylamino); sulfonamido group (e.g., methanesulfonamido, hexadecanesulfonamido, benzenesulfonamido, p-toluenesulfonamido, octadecanesulfonamido, and 2-methyloxy-5-t-butylbenzenesulfonamido); carbamoyl group (e.g., N-ethylcarbamoyl, N,N-dibutylcarbamoyl, N-(2-dodecyloxyethyl) carbamoyl, N-methyl-N-dodecylcarbamoyl, and N-(3-(2,4-di-t-amylphenoxy)propyl)carbamoyl); sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl); sulfonyl group (e.g., methanesulfonyl, octanesulfonyl, benzenesulfonyl, and toluenesulfonyl); alkoxycarbonyl group (e.g., methoxycarbonyl, butyloxycarbonyl, dodecyloxycarbonyl, and octadecyloxycarbonyl); heterocyclic oxy group (e.g., 1-phenyltetrazole-5-oxy and 2-tetrahydropyranyloxy); azo group (e.g., phenylazo, 4-methoxphenylazo, 4-pyvaloylaminophenylazo, and 2-hydroxy-4-propanoylphenylazo); acyloxy group (e.g., acetoxy); carbamoyloxy group (e.g., N-methylcarbamoyloxy and N-phenylcarbamoyloxy); silyloxy group (e.g., trimethylsilyloxy and dibutylmethylsilyloxy); aryloxycarbonylamino group (e.g., phenoxycarbonylamino); imido group (e.g., N-succinimido, N-phthalimido, and 3-octadecenylsuccinimido); heterocyclic thio group (e.g., 2-benzothiazolylthio, 2,4-di-phenoxy-1,3,5-trizole-6-thio, and 2-pyridylthio); sulfinyl group (e.g., dodecanesulfinyl, 3-pentadecylphenylsulfinyl, and 3-phenoxypropylsulfinyl); phosphonyl group (e.g., phenoxyphosphonyl, octyloxyphosphonyl, and phenylphosphonyl); aryloxycarbonyl group (e.g., phenoxycarbonyl); acyl group (e.g., acetyl, 3-phenylpropanoyl, benzoyl, and 4-dodecyloxybenzoyl); and azolyl group (e.g., imidazolyl, pyrazolyl, 3-chloro-pyrazole-1-yl, and triazole).

In a case where a group represented by $R_2$ can further have a substituent, such further substituent may be an organic substituent that is bonded to $R_2$ via a carbon atom, oxygen atom, nitrogen atom, or sulfur atom thereof, or a halogen atom.

Preferable substituents as $R_2$ are an alkyl group, aryl group, alkoxy group, aryloxy group, alkylthio group, aminocarbonylamino group, alkoxycarbonylamino group, and acylamino group. More preferably, $R_2$ is a group having the total carbon atoms of 6 to 70 and having an alkyl group or aryl group having 6 to 70 carbon atoms as a partial structure thereof, thereby providing immobility to the coupler represented by the general formula (MC-I). Herein, "a group having an alkyl group as a partial structure thereof" includes the cases where $R_2$ is a group to which an alkyl group is bonded directly or via a divalent bond, and where $R_2$ itself is an alkyl group. The same can be applied to "a group having an aryl group as a partial structure thereof".

Formula (MC-I) is more preferably a compound in which $R_2$ is a substituent represented by the following general formula (BL-1) or (BL-2) below:

(BL-1)

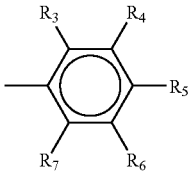

(BL-2)

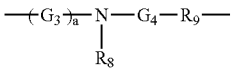

In the general formula (BL-1), each of $R_3$, $R_4$, $R_5$, $R_6$ and $R_7$ independently represents a hydrogen atom or a substituent, and at least one of them represents a substituent having the total carbon atoms of 4 to 70 and containing a substituted or unsubstituted alkyl group as a partial structure thereof, or a substituent having the total carbon atoms of 6 to 70 and containing a substituted or unsubstituted aryl group as a partial structure thereof.

A group represented by the general formula (BL-1) will be described below. Each of $R_3$, $R_4$, $R_5$, $R_6$, and $R_7$ independently represents a hydrogen atom or a substituent. Examples of the substituent are those enumerated above for $R_2$. At least one of $R_3$, $R_4$, $R_5$, $R_6$, and $R_7$ is a substituent having the total carbon atoms of 4 to 70 and containing a substituted or unsubstituted alkyl group as a partial structure thereof, or a substituent having the total carbon atoms of 6 to 70 and containing a substituted or unsubstituted aryl group as a partial structure thereof. Preferred examples are an alkoxy group, aryloxy group, acylamino group, aminocarbonylamino group, carbamoyl group, alkoxycarbonylamino group, sulfonyl group, sulfonamido groups, sulfamoyl group, sulfamoylamino group, and alkoxycarbonyl group, each containing a substituted or unsubstituted alkyl or aryl group as a partial structure thereof, and an alkyl group and aryl group, each having the total carbon atoms of 4 (6 if an aryl group is contained) to 70. Of these substituents, an alkyl group having 4 to 70 carbon atoms, and an alkoxy group, acylamino group and sulfonamido groups each having an alkyl group having 4 to 70 carbon atoms as a partial structure thereof are preferred.

Especially preferably, $R_3$, or both of $R_4$ and $R_6$ represent a substituent having the total carbon atoms of 4 (6 if aryl group is contained) to 70, and having a substituted or unsubstituted alkyl or aryl group as a partial structure thereof.

In the general formula (BL-2), $G_3$ represents a substituted or unsubstituted methylene group; a represents an integer from 1 to 3; $R_8$ represents a hydrogen atom, alkyl group, or aryl group; $G_4$ represents —CO— or —$SO_2$—; and $R_9$ represents a substituent having the total carbon atoms of 6 to 70 and containing a substituted or unsubstituted alkyl or aryl group as a partial structure thereof. If $R_9$ has a substituent, examples of this substituent are those enumerated above for $R_2$. If a is 2 or more, a plurality of $G_3$s may be the same or different to each other. The substituted or unsubstituted methylene group represented by $(G_3)_a$ is preferably —$CH_2$—, —$C_2H_4$—, —$C(CH_3)H$—$CH_2$—, —$C(CH_3)_2$—$CH_2$—, —$C(CH_3)_2$—$C(CH_3)H$—, —$C(CH_3)H$—$C(CH_3)H$—, or —$C(CH_3)_2$—$C(CH_3)_2$—, $R_8$ is a hydrogen atom, $G_4$ is —CO— or —$SO_2$—, and $R_9$ is a substituted or unsubstituted alkyl or aryl group having the total carbon atoms of 10 to 70.

Among the compounds represented by the general formula (MC-I), if $G_1$ is a nitrogen atom, $G_2$ is a carbon atom, and $X_1$ is a hydrogen atom, it is preferable that $R_1$ is a tertiary alkyl group, and $R_2$ is a group represented by the general formula (BL-1), wherein each of $R_4$ and $R_6$ is a group selected from an acylamino group, sulfonamido group, aminocarbonylamino group, alkoxycarbonylamino group, sulfonyl group, carbamoyl group, sulfamoyl group, sulfamoylamino group, and alkoxycarbonyl group, each of which is substituted by a substituted or unsubstituted alkyl group having the total carbon atoms of 4 or more, or by a substituted or unsubstituted aryl group having carbon atoms of 6 or more.

Among the compounds represented by the general formula (MC-I), if $G_1$ is a carbon atom, $G_2$ is a nitrogen atom, and $X_1$ is a hydrogen atom, it is preferable that $R_1$ is a tertiary alkyl group, $R_2$ is a group represented by the general formula (BL-1) or (BL-2). It is especially preferable that $R_2$ is a group represented by the general formula (BL-2).

Among the compounds represented by the general formula (MC-I), if $G_1$ is a nitrogen atom, $G_2$ is a carbon atom, and $X_1$ is a split-off group other than a hydrogen atom, it is preferable that $R_1$ is a tertiary alkyl group, $R_2$ is a group represented by the general formula (BL-1), $R_3$ is a group selected from an acylamino group, sulfonamido group, aminocarbonylamino group, alkoxycarbonylamino group, sulfonyl group, carbamoyl group, sulfamoyl group, sulfamoylamino group and alkoxycarbonyl group, each of which is substituted by a substituted or unsubstituted alkyl group having the total carbon atoms of 4 or more, or by a substituted or unsubstituted aryl group having carbon atoms of 6 or more, and $X_1$ is a chlorine atom.

Among the compounds represented by the general formula (MC-I), if $G_1$ is a carton atom, $G_2$ is a nitrogen atom, and $X_1$ is a split-off group other than a hydrogen atom, it is preferable that $R_1$ is a tertiary alkyl group, $R_2$ is a group represented by the general formula (BL-1) or (BL-2). It is especially preferable that $R_2$ is a group represented by the general formula (BL-2).

In the present invention, it is preferable that $G_1$ is a carbon atom and $G_2$ is a nitrogen atom, $R_1$ is a tertiary alkyl group, $R_2$ is represented by the general formula (BL-2), wherein $G_4$ is —$SO_2$—, $R_9$ is a phenyl group having, as a substituent, at least one group containing an alkyl group of 6- to 50-carbon atoms as a partial structure thereof, and a is 1 or 2. Among these especially preferable is that X is a hydrogen atom or chlorine atom, or substituted phenyloxy group.

The coupler represented by the general formula (MC-I) may form a dimer or higher polymer via at least one of $R_1$ and $R_2$. The coupler represented by the general formula (MC-I) may be bonded to a high molecular weight chain via $R_1$ or $R_2$. The molecular weight of the high molecular weight chain is not particularly limited but is preferably around 8,000 to 100,000. The number of the coupler represented by the general formula (MC-I) that bonds to the high molecular weight chain is not particularly limited but the molecular weight of the high molecular weight chain per coupler is preferably 500 to 1,000.

Specific compound examples of the general formula (MC-I) are shown below, but the present invention is not limited to these specific examples.

MC-1
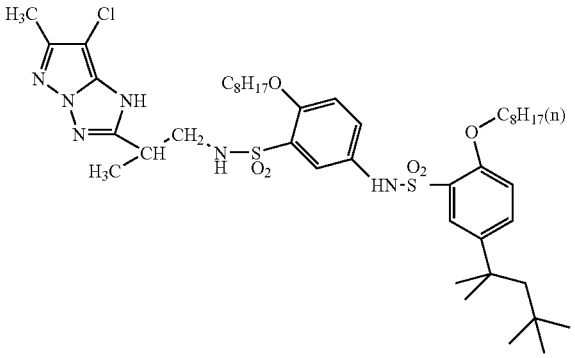
MC-2
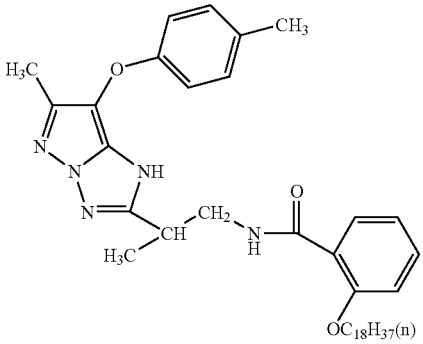
MC-3
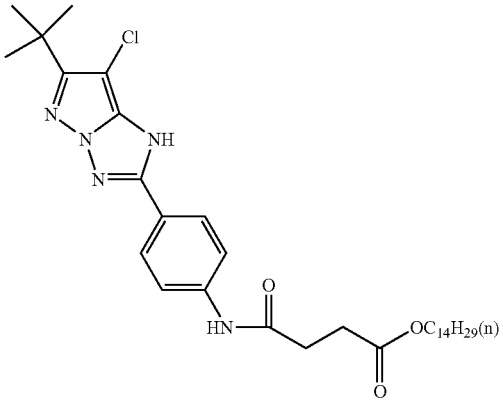
MC-4
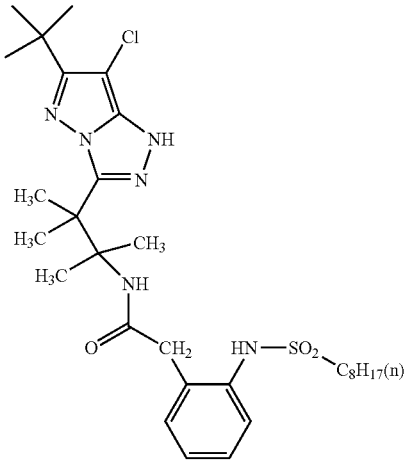
-continued
MC-5
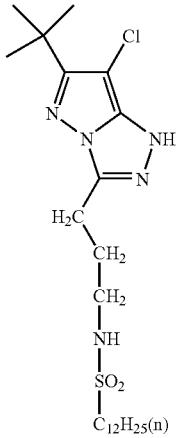
MC-6
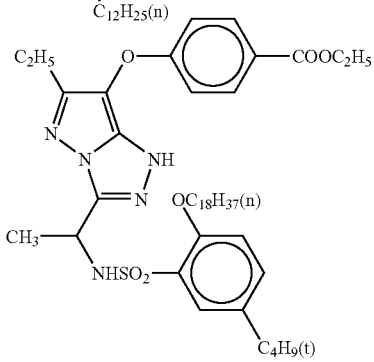
MC-7
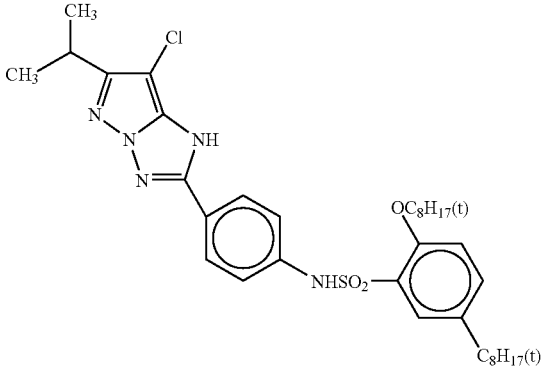
MC-8
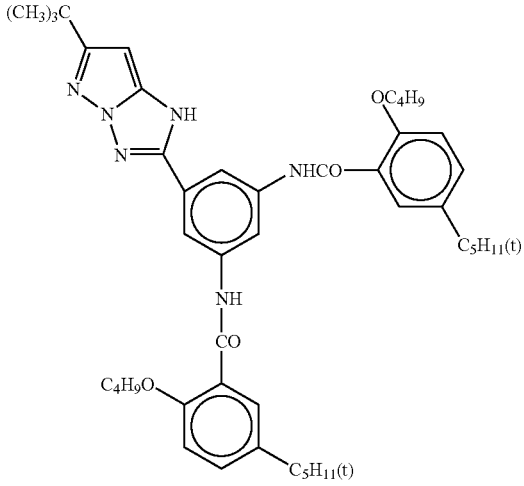

-continued
MC-9
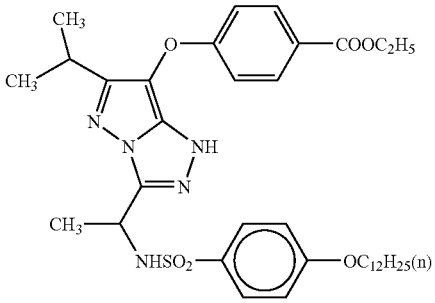
MC-10
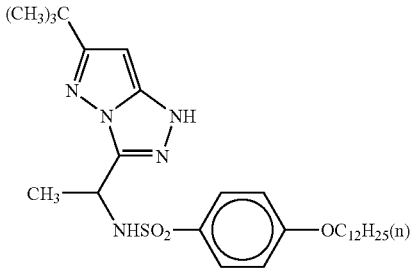
MC-11
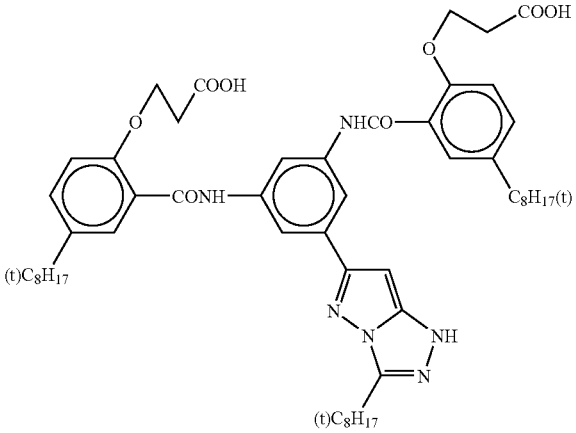
MC-12
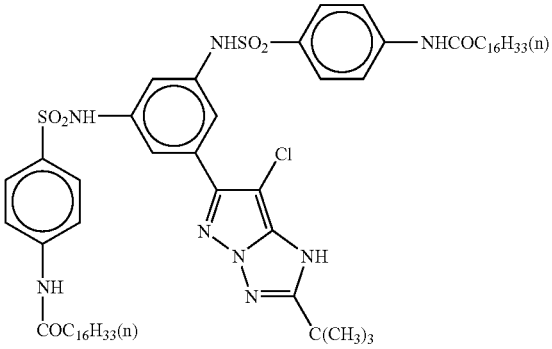
-continued
MC-13
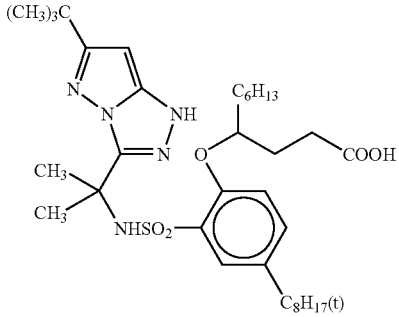
MC-14
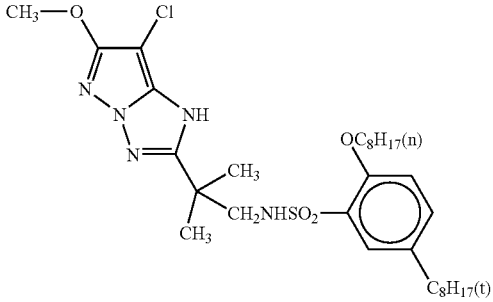
MC-15
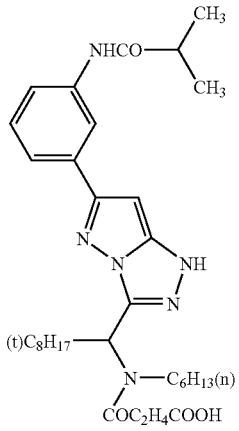
MC-16
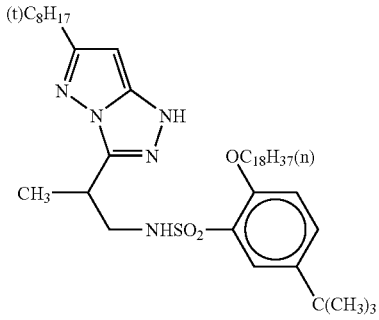

-continued
MC-17
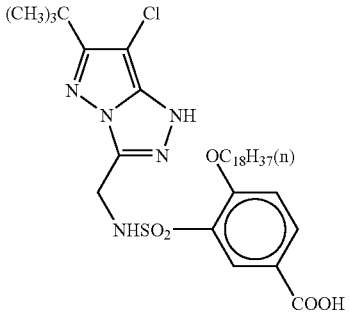
MC-18
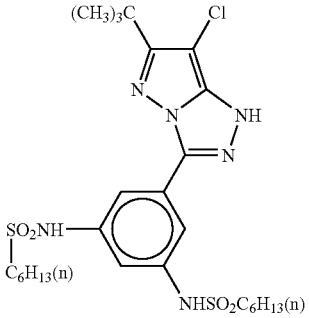
MC-19
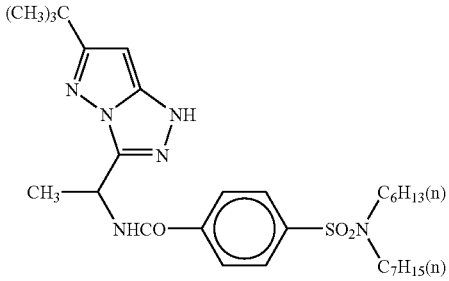
MC-20
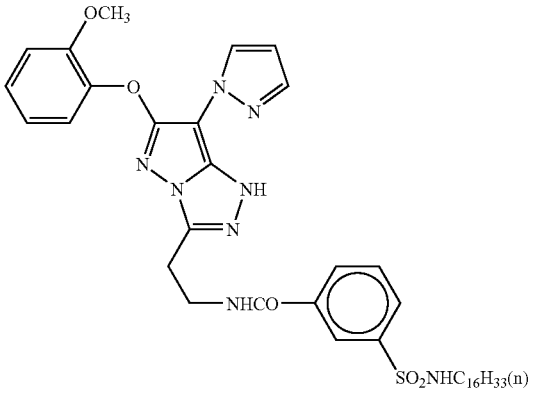
MC-21
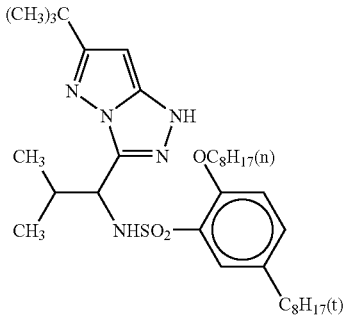
-continued
MC-22
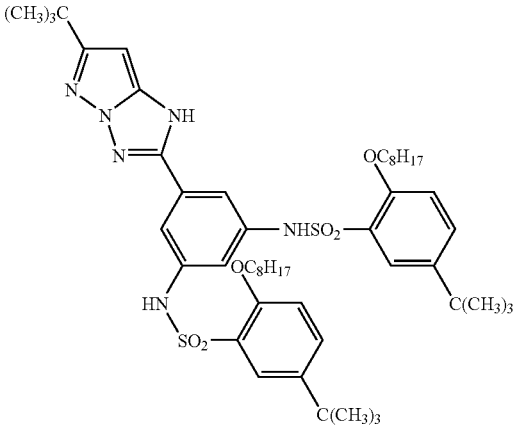
MC-23
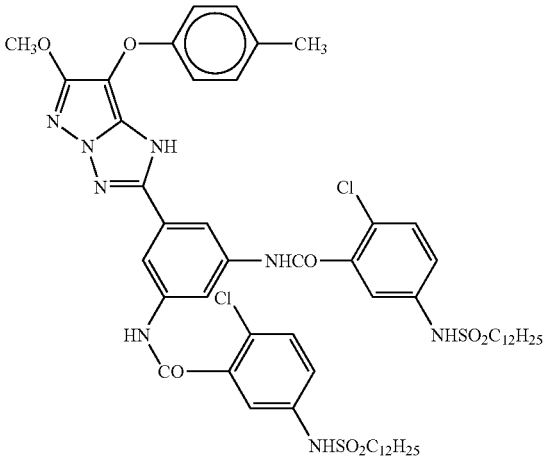
MC-24
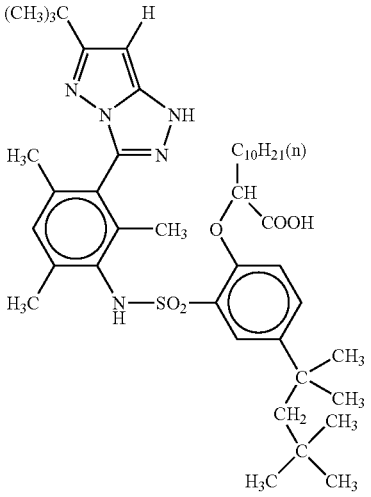

-continued
MC-25
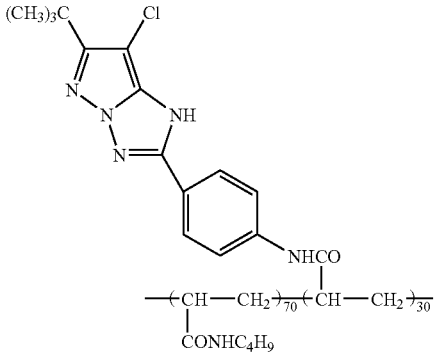
MC-26
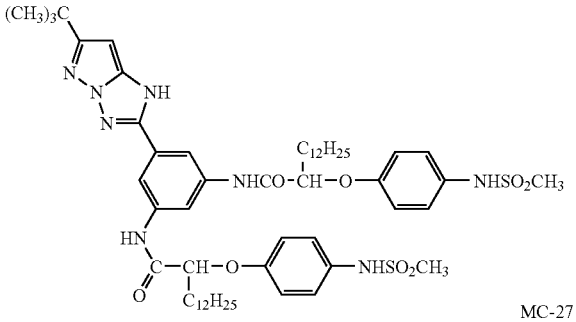
MC-27
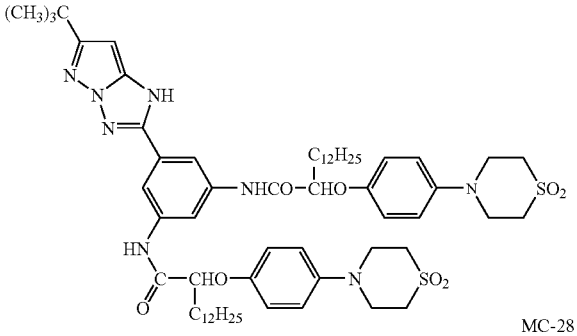
MC-28
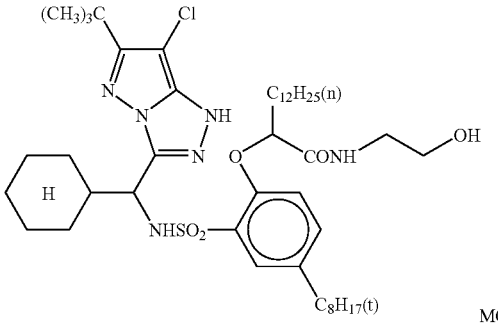
MC-29
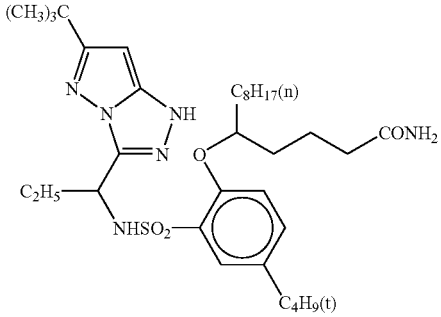
-continued
MC-30
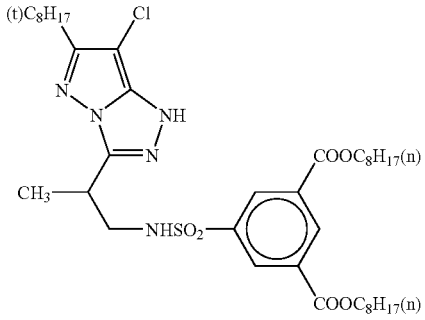
MC-31
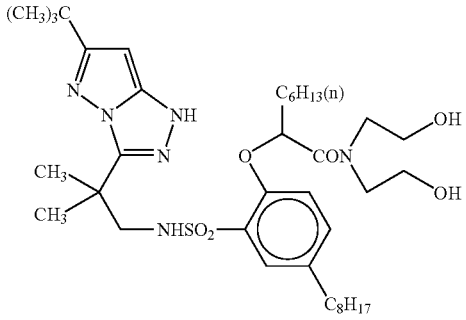
MC-32
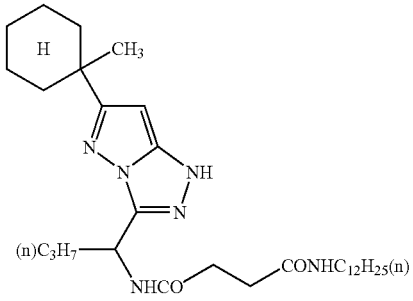
MC-33
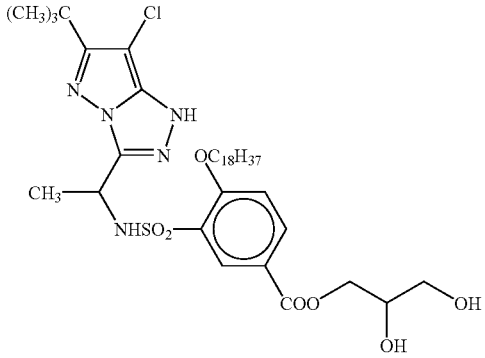

-continued
MC-34
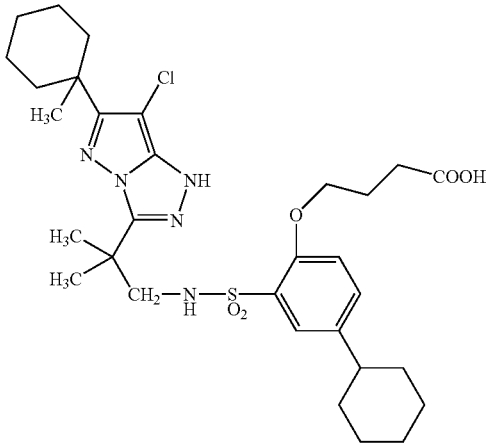
MC-35
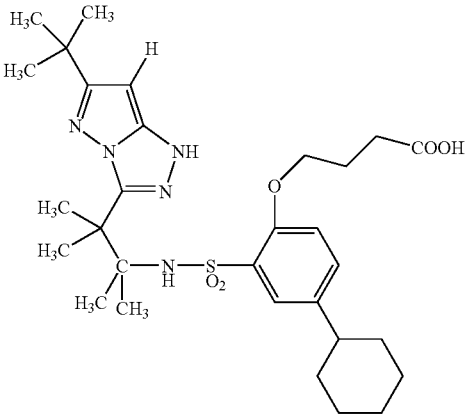
-continued
MC-36
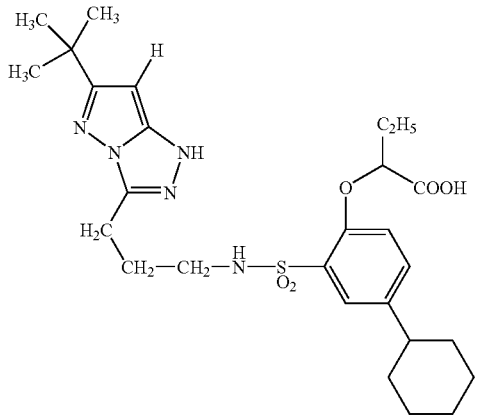
MC-37
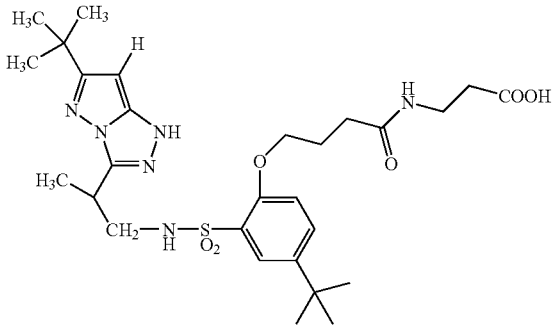
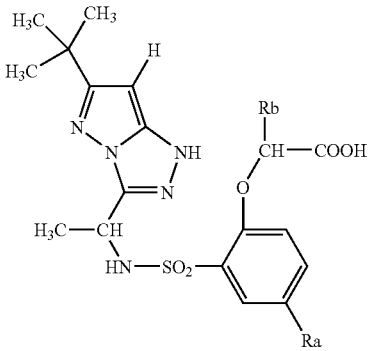
| Compound No. | Ra | Rb* |
|---|---|---|
| MC-38 | 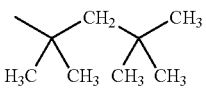 | $—C_{10}H_{21}$ |
*Rb's are normal alkyl groups unless otherwise noted.

-continued
| | | |
|---|---|---|
| MC-39 | 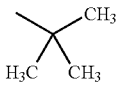 | $—C_8H_{17}$ |
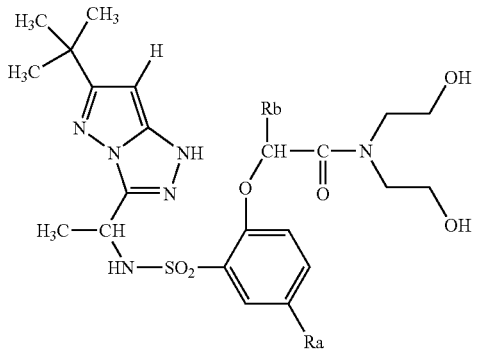
| Compound No. | Ra | Rb |
|---|---|---|
| MC-40 | 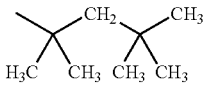 | $—C_8H_{17}$ |
| MC-41 | 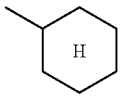 | $—C_8H_{17}$ |
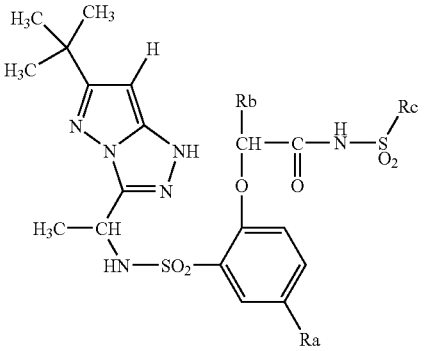
| Compound No. | Ra | Rb | Rc |
|---|---|---|---|
| MC-42 | 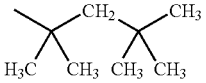 | $—C_{10}H_{21}$ | $—CH_3$ |
| MC-43 | 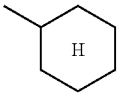 | $—C_8H_{17}$ | $—CH_3$ |
| MC-44 | 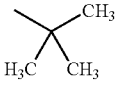 | $—C_{10}H_{21}$ | 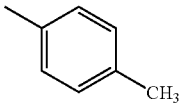 |

-continued
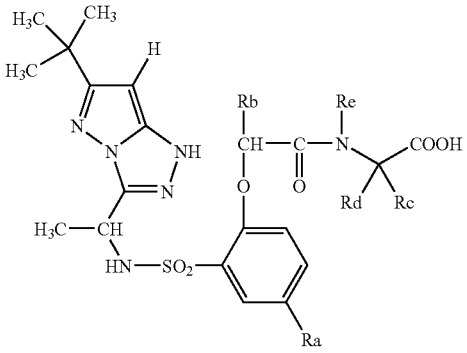
| Compound No. | Ra | Rb | Rc | Rd | Re |
|---|---|---|---|---|---|
| MC-45 | 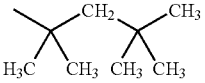 | —$C_{12}H_{25}$ | —$CH_3$ | —H | —H |
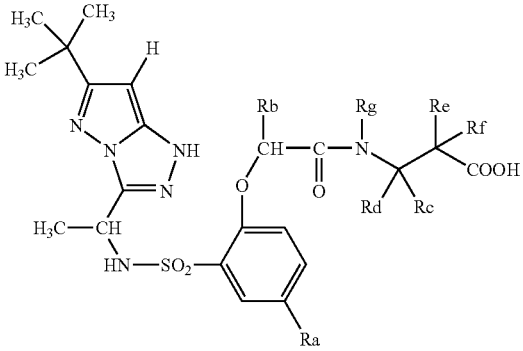
| Compund No. | Ra | Rb | Rc | Rd | Re | Rf | Rg |
|---|---|---|---|---|---|---|---|
| MC-46 | 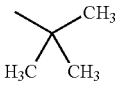 | —$C_{10}H_{21}$ | —H | —H | —H | —H | —H |
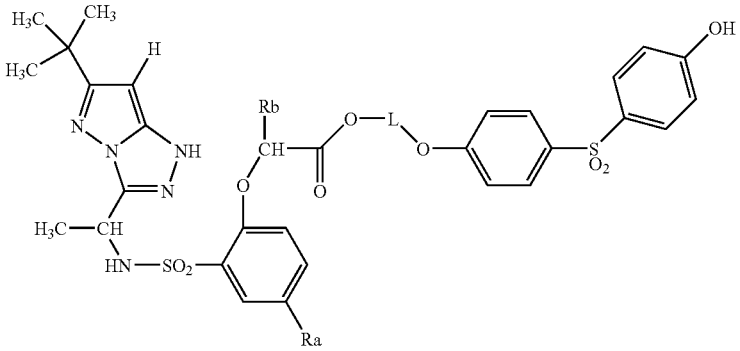
| Compound No. | Ra | Rb | L |
|---|---|---|---|
| MC-47 | 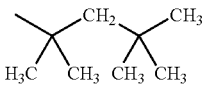 | —$C_{10}H_{21}$ | 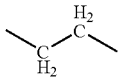 |

The couplers represented by the general formula (MC-I) of the present invention may be synthesized by known methods. For example, such methods are described in the specifications of U.S. Pat. Nos. 4,540,654, 4,705,863 and 5,451,501, JP-A's-61-65245, 62-209457, 62-249155, 63-41851, Jpn. Pat. Appln. KOKOKU Publication No. (hereinafter referred to as "JP-B") 7-122744, JP-B's-5-105682, 7-13309 and 7-82252 or U.S. Pat. Nos. 3,725,067 and 4,777,121, and JP-A's-2-201442, 2-101077, 3-125143 and 4-242249.

The coupler represented by the general formula (CC-I) will be described.

In the general formula (CC-1), Ga represents —C($R_{13}$)═ or —N═; Gb represents —C($R_{13}$)═ when Ga represents —N═, or Gb represents —N═ when Ga represents —C($R_{13}$)═.

Each of $R_{11}$ and $R_{12}$ is an electron-withdrawing group with a Hammett substituent constant σp value (hereinafter simply referred to as σp value) of 0.20 to 1.0. The sum of σp value of $R_{11}$ and $R_{12}$ is preferably 0.65 or more. The couplers represented by the general formula (CC-I) of the invention have excellent performance as cyan couplers by the introduction of such strong electron-withdrawing groups as these. The sum of σp value of $R_{11}$ and $R_{12}$ is preferably 0.70 or more, with the upper limit thereof around 1.8.

Preferably each of $R_{11}$ and $R_{12}$ is an electron-withdrawing group having a σp value of 0.30 to 0.8. The Hammett's rule is an empirical rule proposed by L. P. Hammett in 1935 in order to quantitatively argue the effects of substituents on reaction or equilibrium of benzene derivatives. The rule is widely regarded as appropriate in these days. The substituent constants obtained by the Hammett rule include a σp value and a σm value, and these values are described in a large number of general literature. For example, the values are described in detail in J. A. Dean ed., "Lange's Hand Book of Chemistry," the 12th edition, 1979 (McGraw-Hill), "The Extra Number of The Domain of Chemistry," Vol. 122, pages 96 to 103, 1979 (Nanko Do) and Chemical Reviews, vol. 91, pp. 165–195 (1991). In the invention, each of $R_{11}$ and $R_{12}$ is defined by the Hammett substituent constant σp value. However, this does not mean that $R_{11}$ and $R_{12}$ are limited to substituents having the already known values described in these literature. That is, the invention includes, of course, substituents having values that fall within the above range when measured on the basis of the Hammett's rule even if they are unknown in literature.

Practical examples of $R_{11}$ and $R_{12}$, as the electron-withdrawing group with a σp value of 0.20 to 1.0, are an acyl group, acyloxy group, carbamoyl group, aliphatic oxycarbonyl group, aryloxycarbonyl group, cyano group, nitro group, dialkylphosphono group, diarylphosphono group, diarylphosphinyl group, alkylsulfinyl group, arylsulfinyl group, alkylsulfonyl group, arylsulfonyl group, sulfonyloxy group, acylthio group, sulfamoyl group, thiocyanate group, thiocarbonyl group, alkyl group substituted by at least two halogen atoms, alkoxy group substituted by at least two halogen atoms, aryloxy group substituted by at least two halogen atoms, alkylamino group substituted by at least two halogen atoms, alkylthio group substituted by at least two halogen atoms, aryl group substituted by another electron-withdrawing group with a σp value of 0.20 or more, heterocyclic group, chlorine atom, bromine atom, azo group, and selenocyanate group. Of these substituents, those capable of further having substituents can further have substitutes to be mentioned later for $R_{13}$.

The aliphatic portion of the aliphatic oxycarbonyl group can be straight-chain, branched-chain, or cyclic and can be saturated or can contain an unsaturated bond. This aliphatic oxycarbonyl group includes, e.g., alkoxycarbonyl, cycloalkoxycarbonyl, alkenyloxycarbonyl, alkinyloxycarbonyl, and cycloalkenyloxycarbonyl.

The σp values of representative electron-withdrawing groups having a σp value of 0.2 to 1.0 are a bromine atom (0.23), chlorine atom (0.23), cyano group (0.66), nitro group (0.78), trifluoromethyl group (0.54), tribromomethyl group (0.29), trichloromethyl group (0.33), carboxyl group (0.45), acetyl group (0.50), benzoyl group (0.43), acetyloxy group (0.31), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), ethoxycarbonyl group (0.45), phenoxycarbonyl group (0.44), pyrazolyl group (0.37), methanesulfonyloxy group (0.36), dimethoxyphosphoryl group (0.60), and sulfamoyl group (0.57). Each of the numbers in parenthesis is σp value.

$R_{11}$ preferably represents a cyano group, aliphatic oxycarbonyl group (a 2- to 36-carbon, straight-chain or branched-chain alkoxycarbonyl group, aralkyloxycarbonyl group, alkenyloxycarbonyl group, alkinyloxycarbonyl group, cycloalkoxycarbonyl group, or cycloalkenyloxycarbonyl group, e.g., methoxycarbonyl, ethoxycarbonyl, dodecyloxycarbonyl, octadecyloxycarbonyl, 2-ethylhexyloxycarbonyl, sec-butyloxycarbonyl, oleyloxycarbonyl, benzyloxycarbonyl, propargyloxycarbonyl, cyclopentyloxycarbonyl, cyclohexyloxycarbonyl, or 2,6-di-t-butyl-4-methylcylohexyloxycarbonyl); dialkylphosphono group (a 2- to 36-carbon dialkylphosphono group, e.g., diethylphosphono or dimethylphosphono); alkylsulfonyl or arylsulfonyl group (a 1- to 36-carbon alkylsulfonyl or 6- to 36-carbon arylsulfonyl group, e.g., a methanesulfonyl group, butanesulfonyl group, benzenesulfonyl group, or p-toluenesulfonyl group); or fluorinated alkyl group (a 1- to 36-carbon fluorinated alkyl group, e.g., trifluoromethyl). $R_{11}$ is particularly preferably a cyano group, aliphatic oxycarbonyl group, or fluorinated alkyl group, and most preferably, a cyano group.

$R_{12}$ preferably represents an aliphatic oxycarbonyl group as mentioned above for $R_{11}$; carbamoyl group (a 1- to 36-carbon carbamoyl group, e.g., diphenylcarbamoyl or dioctylcarbamoyl); sulfamoyl group (a 1- to 36-carbon sulfamoyl, e.g., dimethylsulfamoyl or dibutylsulfamoyl); dialkylphosphono group mentioned above for $R_{11}$; diarylphosphono group (a 12- to 50-carbon diarylphosphono group, e.g., diphenylphosphono or di(p-tolyl)phosphono). $R_{12}$ is particularly preferably a group represented by the following formula (A)

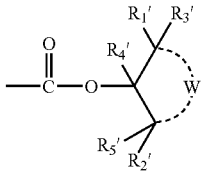

In the formula (A), each of $R_1'$ and $R_2'$ represents an aliphatic group, e.g., a 1- to 36-carbon, straight-chain or branched-chain alkyl group, aralkyl group, alkenyl group, alkinyl group, cycloalkyl group, or cycloalkenyl group, and more specifically, methyl, ethyl, propyl, isopropyl, t-butyl, t-amyl, t-octyl, tridecyl, cyclopentyl, cyclohexyl, vinyl ethnyl. Each of $R_3'$, $R_4'$ and $R_5'$ represents a hydrogen atom or aliphatic group. Examples of the aliphatic group are those mentioned above for $R_1'$ and $R_2'$. Each of $R_3'$, $R_4'$, and $R_5'$ is preferably a hydrogen atom.

W represents a non-metallic atomic group required to form a 5- to 8-membered ring. This ring may be substituted, may be a saturated ring, or can have an unsaturated bond. A non-metallic atom is preferably a nitrogen atom, oxygen atom, sulfur atom, or carbon atom, and more preferably, a carbon atom.

Examples of a ring formed by W are a cyclopentane ring, cyclohexane ring, cycloheptane ring, cyclooctane ring, cyclohexene ring, piperazine ring, oxane ring, and thiane ring. These rings can be substituted by a substituents represented by $R_{13}$ to be described below.

A ring formed by W is preferably a cyclohexane ring which may be substituted, and most preferably, a cyclohexane ring whose 4-position is substituted by a 1- to 36-carbon alkyl group (which may be substituted by a substituent represented by $R_{13}$ to be described below).

$R_{13}$ represents a substituent. Examples are those mentioned above for $R_1$ in formula (MC-I).

Among the substituents, $R_{13}$ is preferably an alkoxy group, acylamino group, aliphatic group or aryl group, which may be substituted by a substituent mentioned as $R_{13}$.

$Y_1$ represents a hydrogen atom or a group capable of splitting-off when the coupler reacts with an oxidized aromatic primary amine color developing agent. When $Y_1$ represents a split-off group, examples are those to be described lator in the explanation of $X_1$ of the general formula (MC-I).

$Y_1$ is preferably a hydrogen atom, halogen atom, aryloxy group, heterocyclic acyloxy group, dialkylphosphonooxy group, arylcarbonyloxy group, arylsulfonyloxy group, alkoxycarbonyloxy group, or carbamoyloxy group. Also, it is also preferable that the split-off group or a compound released from the split-off group has a property of further reacting with an oxidized aromatic primary amine color developing agent. For example, the split-off group is a non-color-forming coupler, hydroquinone derivative, aminophenol derivative, sulfonamidophenol derivative.

The coupler represented by the general formula (CC-I) may be in a form of a dimer or higher polymer wherein the group represented by $R_{12}$ or $R_{13}$ has a residue of the coupler represented by the general formula (CC-I). The coupler represented by the general formula (CC-I) may be in a homopolymer or copolymer wherein the group represented by $R_{12}$ or $R_{13}$ has a polymer chain. A typical example of the homopolymer or copolymer containing the polymer chain is a homopolymer or copolymer of an addition polymerized ethylenic unsaturated compounds having the coupler resiude represented by the general formula (CC-I). In this case, one or more kinds of cyan color-forming repeating unit having the coupler residue represented by the general formula (CC-I) may be contained in the polymer. The copolymer may be one having, as copolymerization component, one or more non-color-forming ethylenic monomer that does not couple with an oxidized aromatic primary amine developing agent, such as acrylic ester, methacrylic ester and maleic ester.

Specific examples of the couplers of the general formula (CC-I) will be shown below, which should not be construed as limiting the scope of the present invention.

(CC-1)

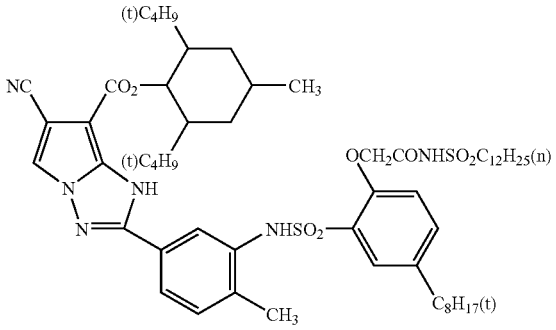

(CC-2)

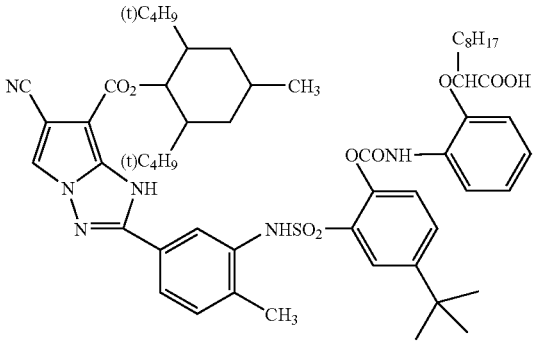

(CC-3)

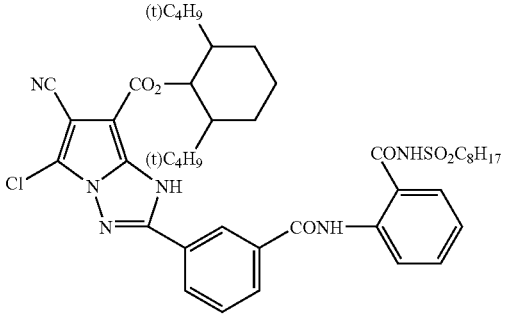

(CC-4)

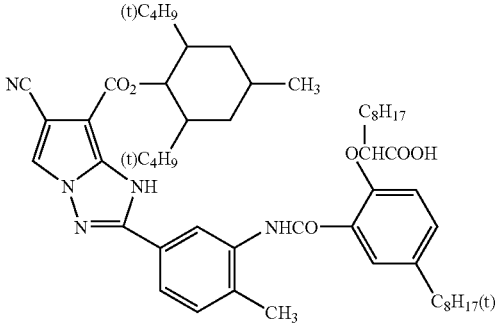

-continued
(CC-5)
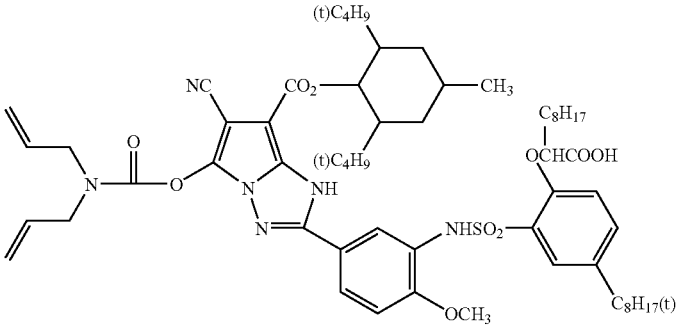
(CC-6)
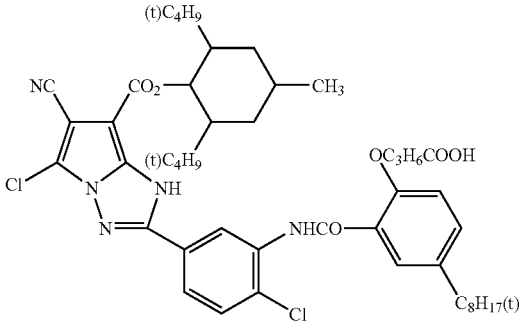
(CC-7)
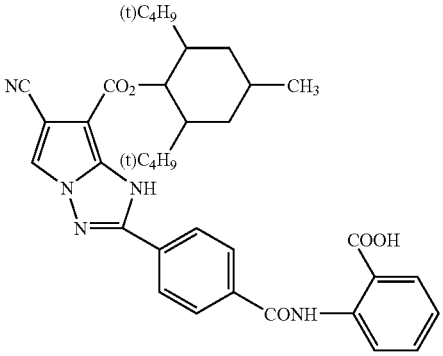
(CC-8)
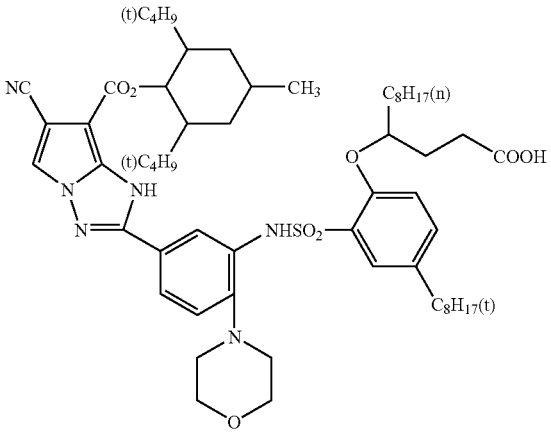
(CC-9)
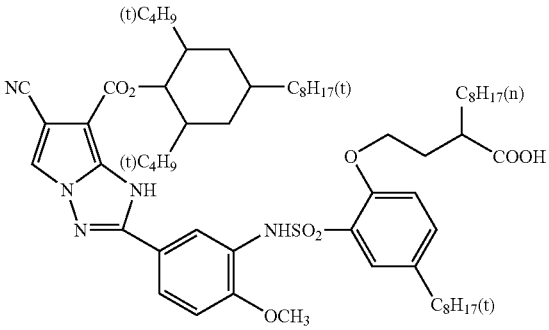
(CC-10)
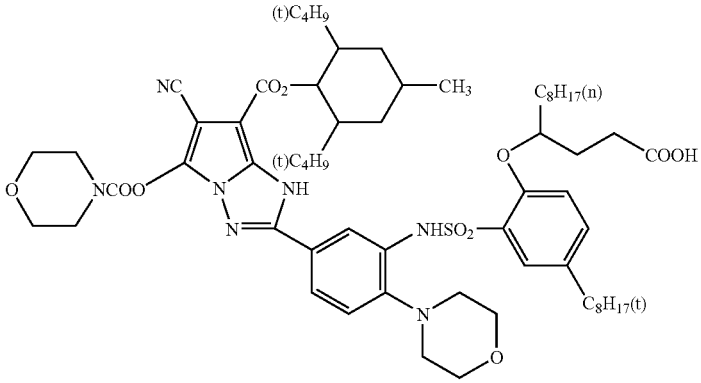

-continued
(CC-11)
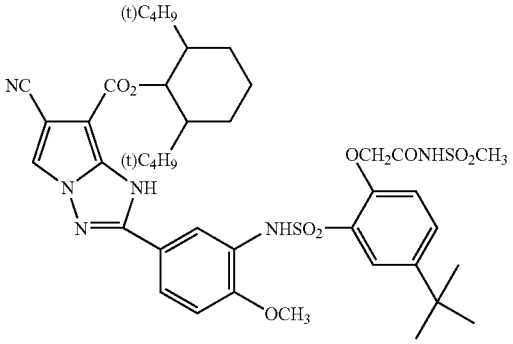
(CC-12)
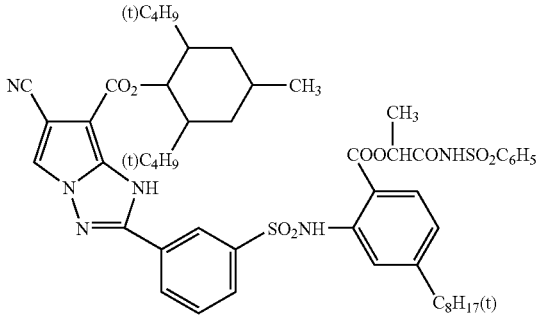
(CC-13)
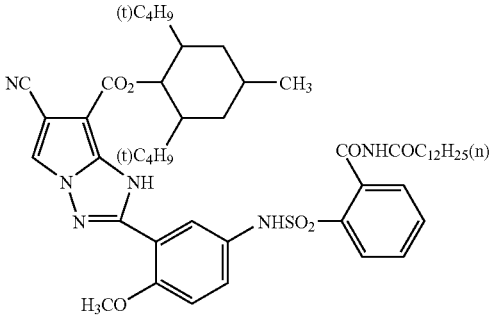
(CC-14)
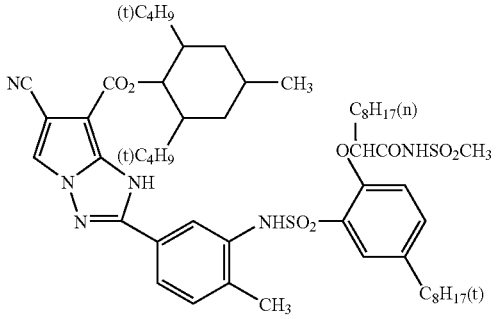
(CC-15)
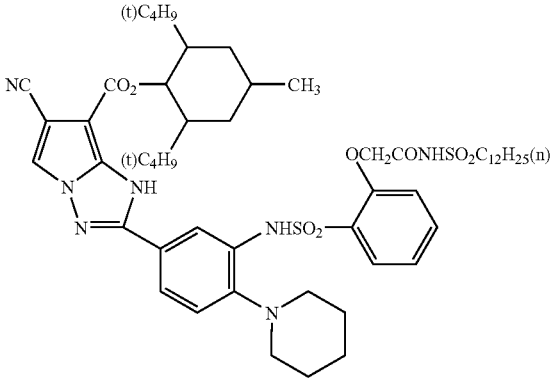
(CC-16)
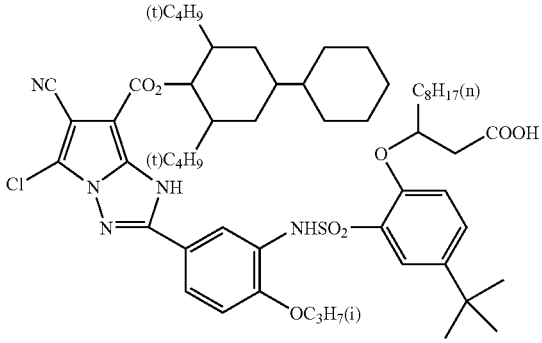
(CC-17)
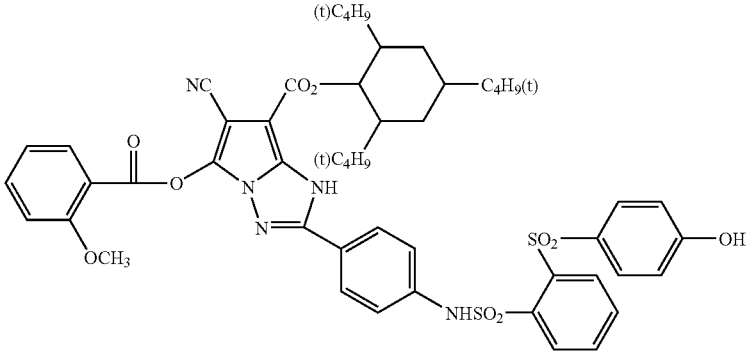

-continued
(CC-18)
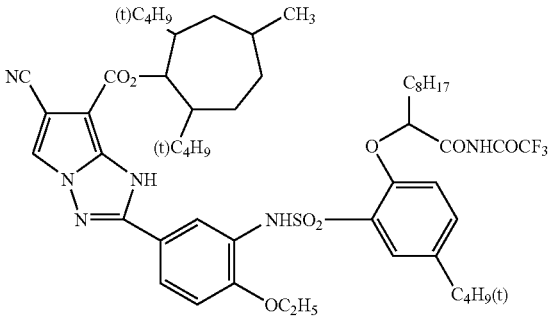
(CC-19)
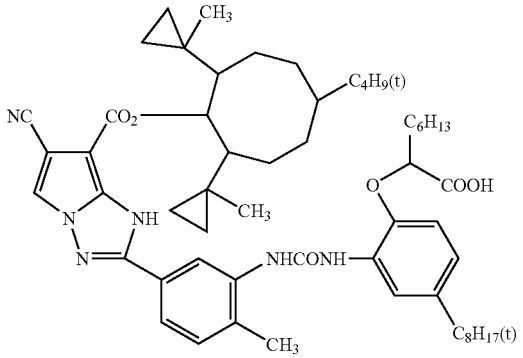
(CC-20)
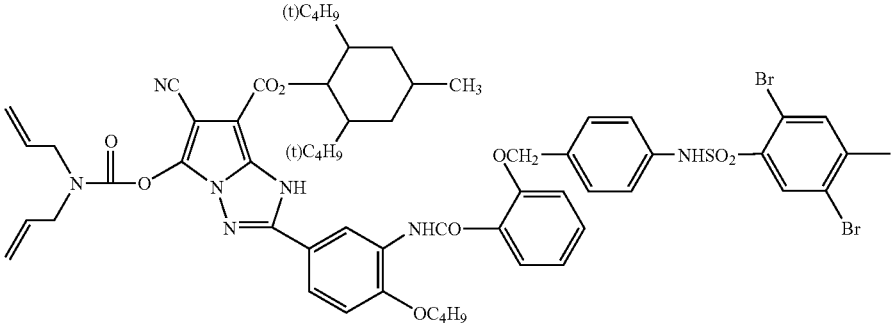
(CC-21)
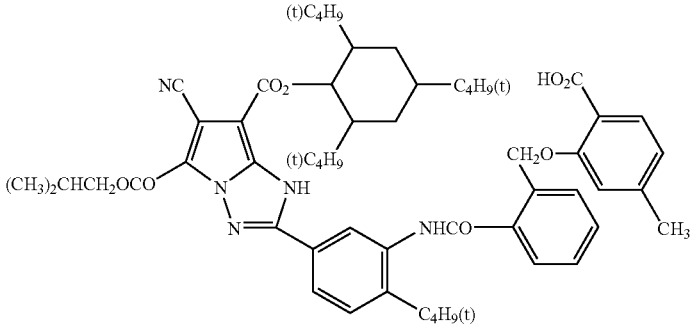
(CC-22)
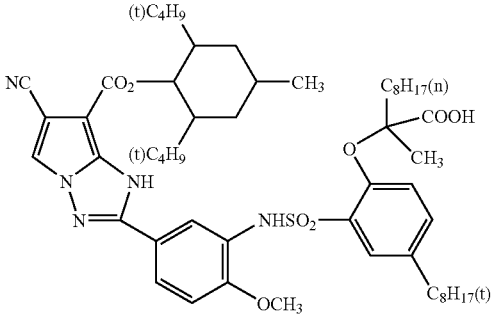
(CC-23)
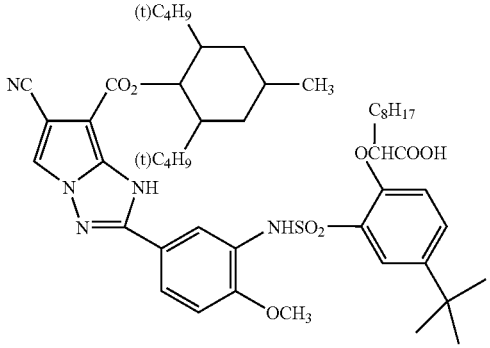

-continued
(CC-24)
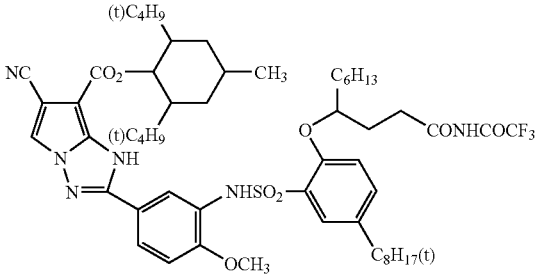
(CC-25)
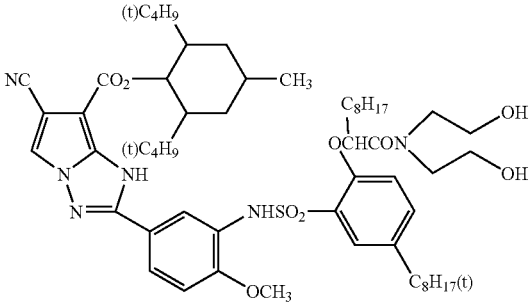
(CC-24)
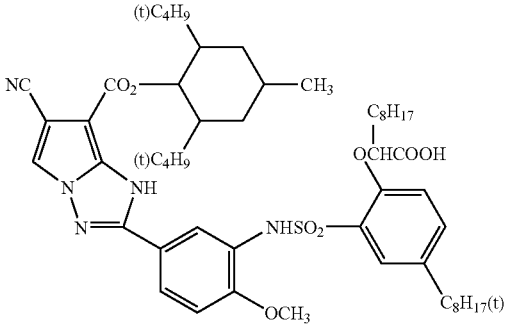
(CC-27)
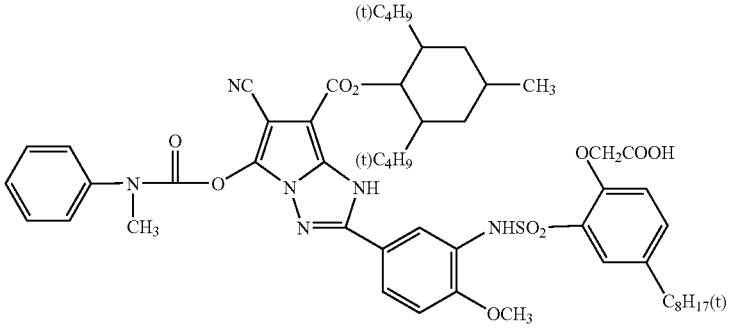
(CC-28)
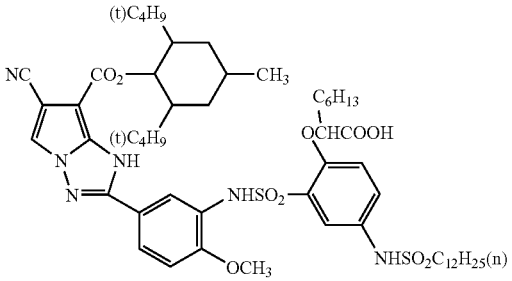
(CC-29)
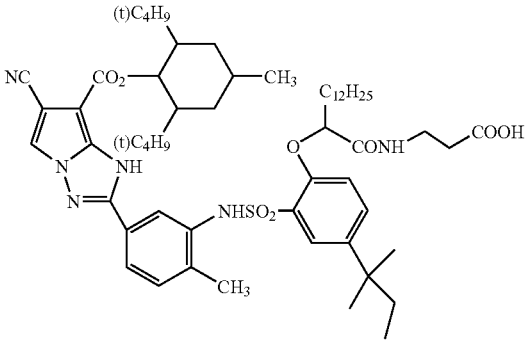

-continued
(CC-30)
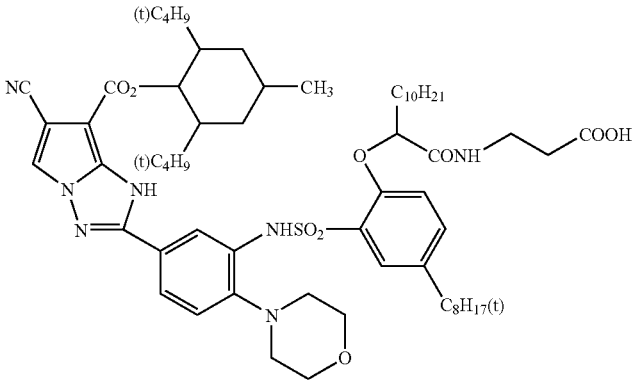
(CC-31)
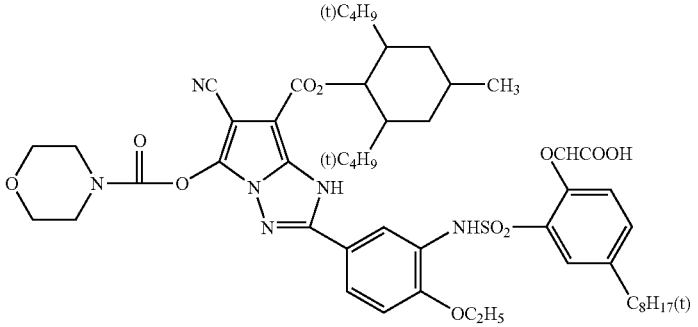
(CC-32)
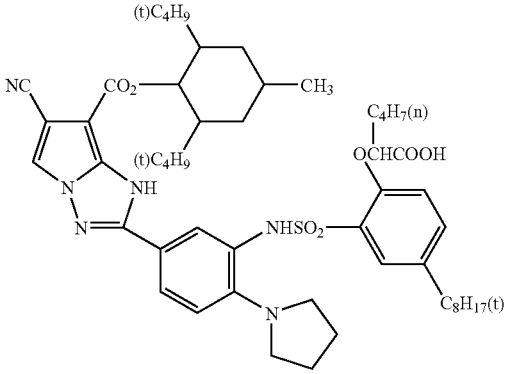
(CC-33)
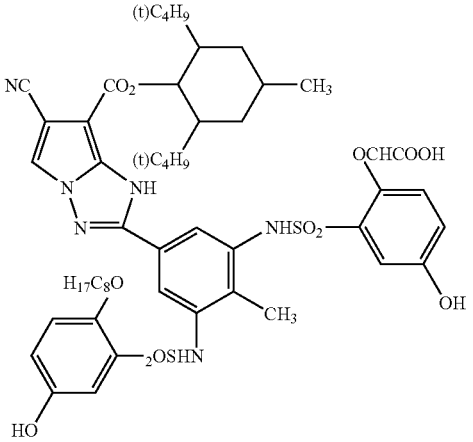
(CC-34)
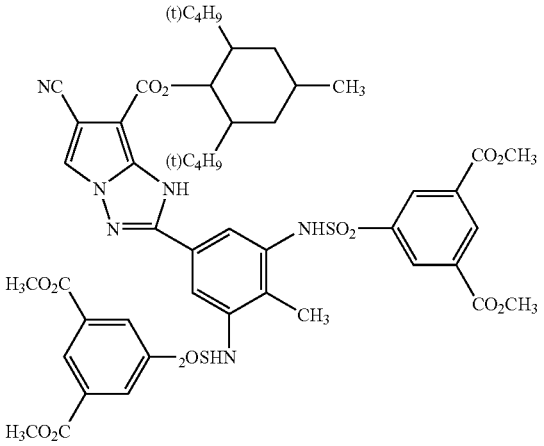

-continued
(CC-35)
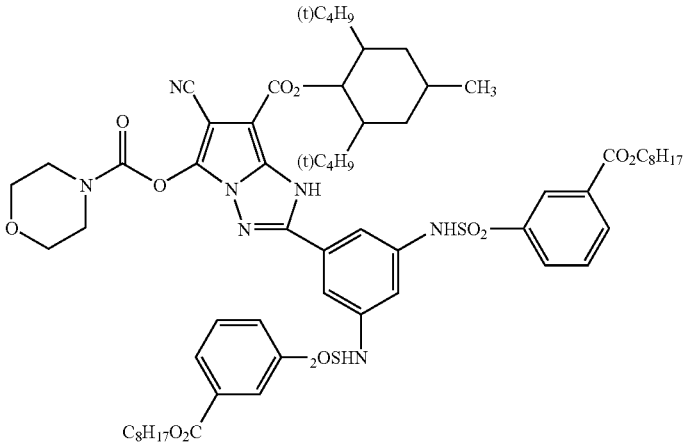
(CC-36)
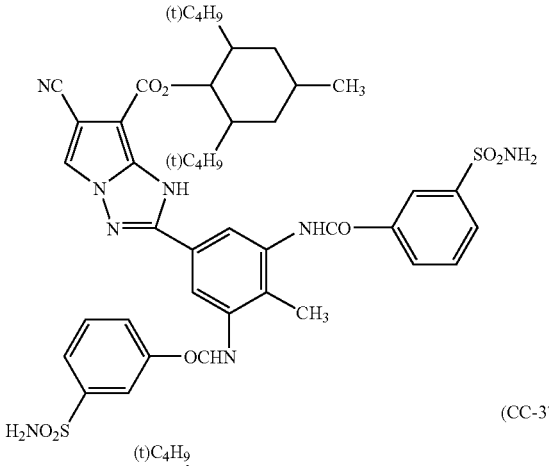
(CC-37)
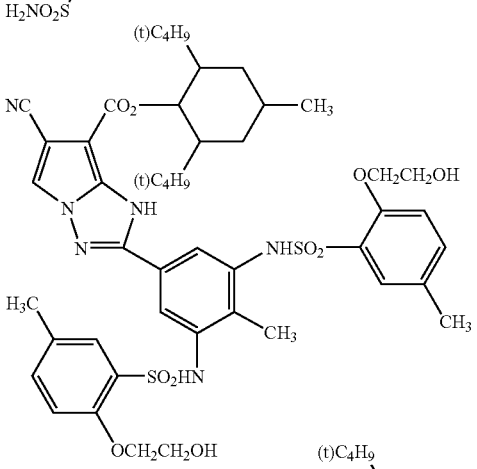
(CC-38)
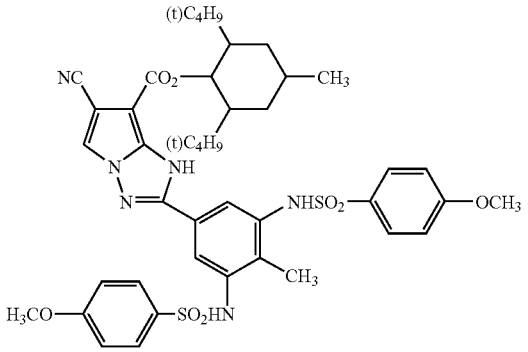
(CC-39)
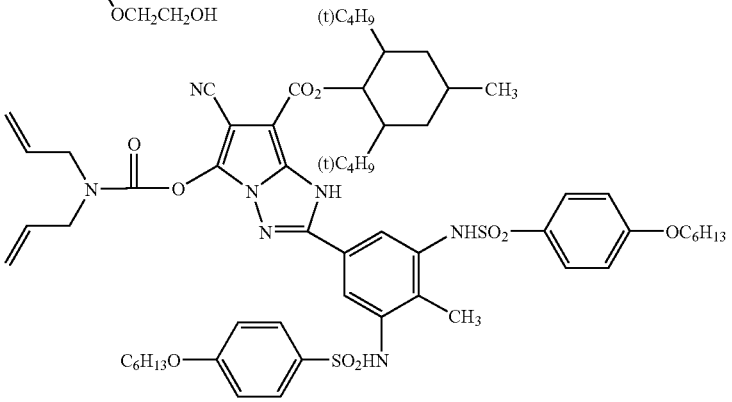

-continued
(CC-40)
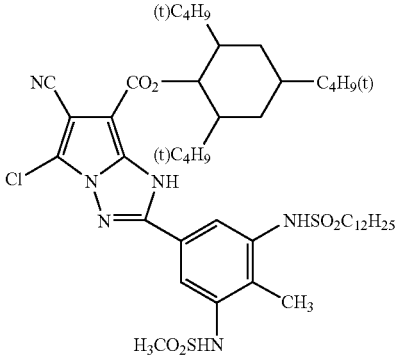
(CC-41)
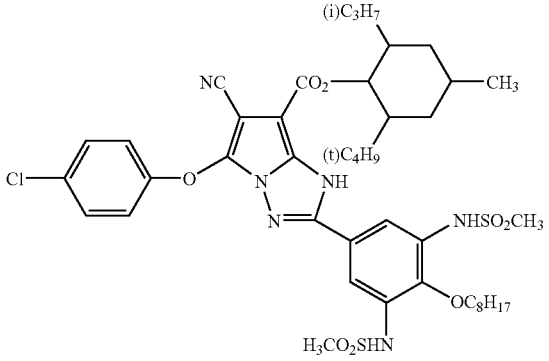
(CC-42)
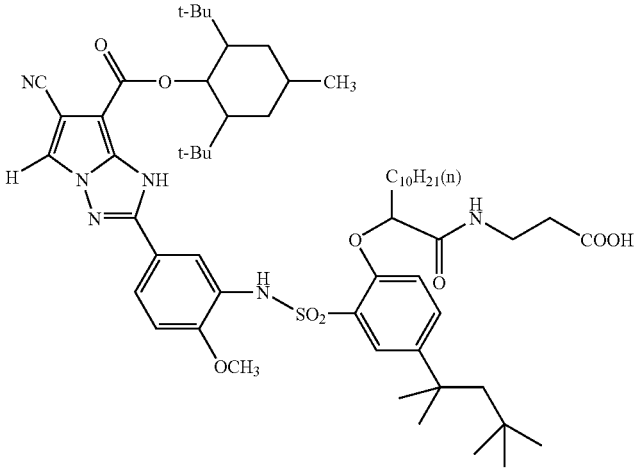
(CC-43)
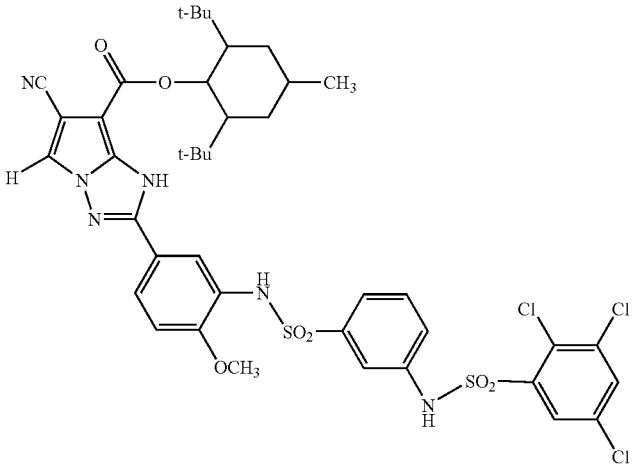

-continued
(CC-44)
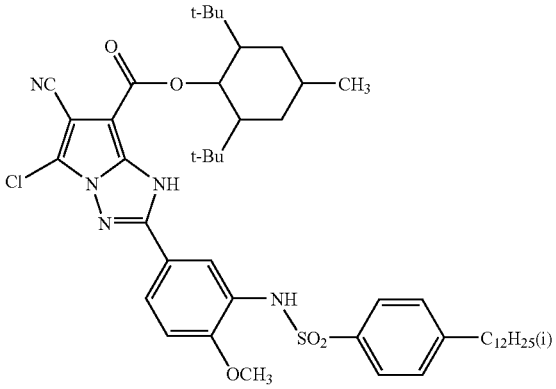
(CC-45)
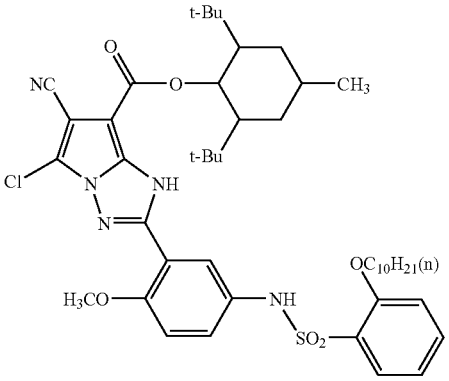
(CC-46)
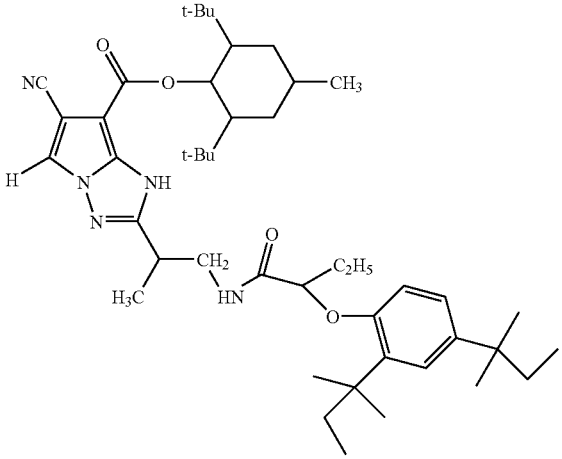
(CC-47)
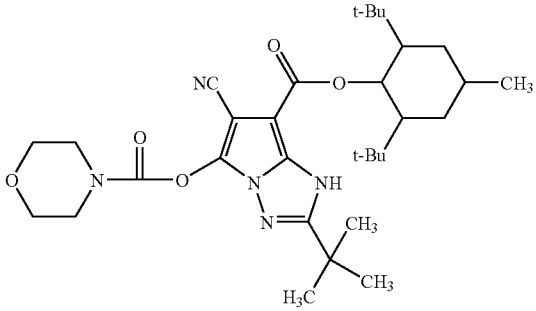
(CC-48)
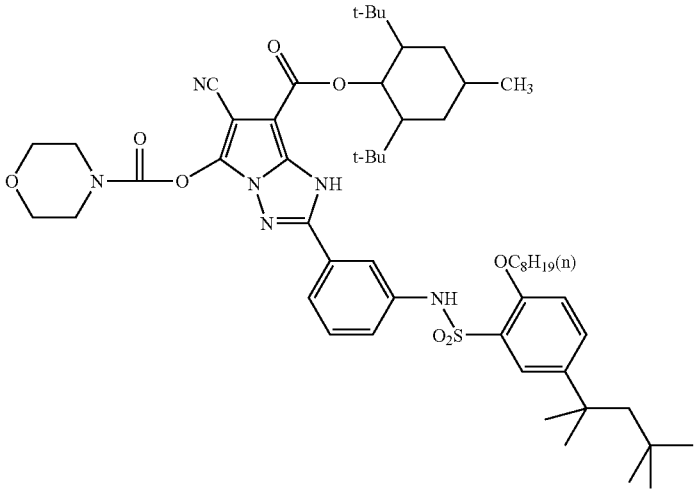

-continued (CC-49)

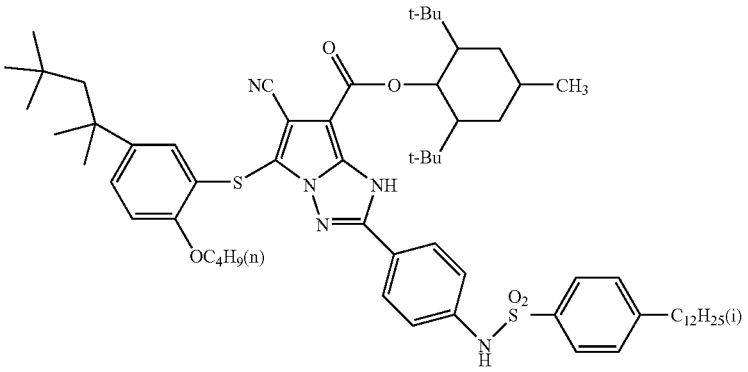

(CC-50)

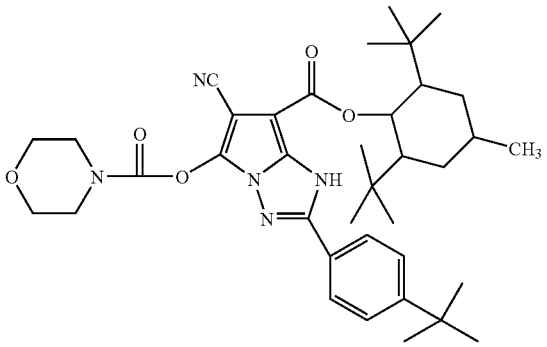

The compound represented by the general formula (CC-I) of the invention may be synthesized by known methods such as those described, for example, in J. C. S., 1961, page 518; J. C. S., 1962, page 5149; Angew. Chem., vol. 72, page 956 (1960) and Berichte, vol. 97, page 3436 (1964) or methods cited therein or analogous methods.

Next, the coupler represented by the general formula (YC-I) will be described.

In the formula $R_{21}$ represents an alkyl group having 7 or more carbon atoms, preferably 7 to 40 carbon atoms, and more preferably 7 to 30 carbon atoms, which may be substituted by another substituent.

As the substituent for $R_{21}$, there can be mentioned, for example, a halogen atom, alkyl group (including cycloalkyl and bicycloalkyl), alkenyl group (including cycloalkenyl and bicycloalkenyl), alkynyl group, aryl group, heterocycle group, cyano group, hydroxyl group, nitro group, carboxyl group, alkoxy group, aryloxy group, silyloxy group, heterocyclic oxy group, acyloxy group, carbamoyloxy group, alkoxycarbonyloxy group, aryloxycarbonyloxy group, amino group (including alkylamino and anilino), acylamino group, aminocarbonylamino group, alkoxycarbonylamino group, aryloxycarbonylamino group, sulfamoylamino group, alkyl- or aryl-sulfonylamino group, mercapto group, alkylthio group, arylthio group, heterocyclic thio group, sulfamoyl group, sulfo group, alkyl- or aryl-sulfinyl group, alkyl- or aryl-sulfonyl group, acyl group, aryloxycarbonyl group, alkoxycarbonyl group, carbamoyl group, aryl- or heterocyclic-azo group, imido group, phosphino group, phosphinyl group, phosphinyloxy group, phosphinylamino group or silyl group.

When $R_{21}$ is substituted by a plurality of substituents, these may be the same or different, or two adjacent substituents may be bonded to form a ring, preferably a 5- or 6-membered saturated or unsaturated ring. Note that the above-mentioned substituents may be further substituted with a substituent, which may be enumerated those mentioned above.

Examples of the substituents that $R_{21}$ may have in more detail are halogen atom (e.g., a chlorine atom, bromine atom, and iodine atom), an alkyl group (which is a straight-chain or branched, substituted or unsubstituted alkyl group, preferably a 1- to 30-carbon, substituted or unsubstituted alkyl group, e.g., methyl, ethyl, n-propyl, isopropyl, t-butyl, n-octyl, eicosyl, 2-chloroethyl, 2-cyanoethyl, and 2-ethylhexyl), cycloalkyl group {(preferably a 3- to 30-carbon, substituted or unsubstituted cycloalkyl group, e.g., cyclohexyl, cyclopentyl, and 4-n-dodecylcyclohexyl), multicycloalkyl group, e.g., bicycloalkyl group (preferably a 5- to 30-carbon, substituted or unsubstituted bicycloalkyl group, e.g., bicyclo[1,2,2]heptane-2-yl and bicyclo[2,2,2]octane-3-yl), tricycloalkyl or four or more cycloalkyl group, preferably monocycloalkyl group and bicycloalkyl group, and especially preferably monocycloalkyl group}, an alkenyl group (which is a straight-chain or branched, substituted or unsubstituted alkenyl group, preferably a 2- to 30-carbon, substituted or unsubstituted alkenyl group, e.g., vinyl, allyl, prenyl, geranyl, and oleyl), cycloalkenyl group {(preferably a 3- to 30-carbon, substituted or unsubstituted cycloalkenyl group, e.g., 2-cyclopentene-1-yl and 2-cyclohexene-1-yl), multicycloalkenyl, e.g., bicycloalkenyl group (preferably a substituted or unsubstituted bicycloalkenyl group, preferably a 5- to 30-carbon, substituted or unsubstituted bicycloalkenyl group, e.g., bicyclo[2,2,1]hepto-2-ene-1-yl and bicyclo[2,2,2]octo-2-ene-4-yl), and tricycloalkenyl, preferably a monocycloalkenyl and bicycloalkenyl, and especially preferably a monocycloalkenyl}, an alkynyl group (preferably a 2- to 30-carbon, substituted or unsubstituted alkynyl group, e.g., ethynyl, propargyl, and trimethylsilylethynyl), aryl group (preferably a 6- to 30-carbon, substituted or unsubstituted aryl group, e.g., phenyl, p-tolyl, naphthyl, m-chlorophenyl, and o-hexadecanoylaminophenyl), heterocyclic group (preferably a 5- to 7-membered, substituted or unsubstituted, saturated or unsaturated, aromatic or nonaromatic, monocyclic or condensed heterocyclic group, more preferably a heterocyclic group, the constituting atom of which is selected from a carbon atom, nitrogen atom and sulfur atom, and having at least one hetero atom selected from nitrogen atom, oxygen atom and sulfur atom, and more preferably, a 3- to 30-carbon, 5- or 6-membered aromatic heterocyclic group, e.g., 2-furyl, 2-thienyl, 2-pyridyl, 4-pyridyl, 2-pyrimidinyl, and 2-benzothiazolyl), cyano group, hydroxyl group, nitro group, carboxyl group, alkoxy group (preferably a 1- to 30-carbon, substituted or unsubstituted alkoxy group, e.g., methoxy, ethoxy, isopropoxy, t-butoxy, n-octyloxy, and 2-methoxyethoxy), an aryloxy group (preferably a 6- to 30-carbon, substituted or unsubstituted aryloxy group, e.g., phenoxy, 2-methylphenoxy, 4-t-butylphenoxy, 3-nitrophenoxy, and 2-tetradecanoylaminophenoxy), silyloxy group (preferably a 3- to 20-carbon silyloxy group, e.g., trimethylsilyloxy and t-butyldimethylsilyloxy), heterocyclic oxy group (preferably a 2- to 30-carbon, substituted or unsubstituted heterocyclic oxy group, the heterocyclic moiety of which is preferably those described in the above heterocyclic group, e.g., 1-phenyltetrazole-5-oxy and 2-tetrahydropyranyloxy), acyloxy group (preferably a formyloxy group, 2- to 30-carbon, substituted or unsubstituted alkylcarbonyloxy group, and 7- to 30-carbon, substituted or unsubstituted arylcarbonyloxy group, e.g., formyloxy, acetyloxy, pivaloyloxy, stearoyloxy, benzoyloxy, and p-methoxyphenylcarbonyloxy), carbamoyloxy group (preferably a 1- to 30-carbon, substituted or unsubstituted carbamoyloxy group, e.g., N,N-dimethylcarbamoyloxy, N,N-diethylcarbamoyloxy, morpholinocarbonyloxy, N,N-di-n-octylaminocarbonyloxy, and N-n-octylcarbamoyloxy), alkoxycarbonyloxy group (preferably a 2- to 30-carbon, substituted or unsubstituted alkoxycarbonyloxy group, e.g., methoxycarbonyloxy, ethoxycarbonyloxy, t-butoxycarbonyloxy, and n-octylcarbonyloxy), aryloxycarbonyloxy group (preferably a 7- to 30-carbon, substituted or unsubstituted aryloxycarbonyloxy group, e.g., phenoxycarbonyloxy, p-methoxyphenoxycarbonyloxy, and p-(n-hexadecyloxy) phenoxycarbonyloxy), an amino group (preferably an amino group, 1- to 30-carbon, substituted or unsubstituted alkylamino group, 6- to 30-carbon, substituted or unsubstituted arylamino group, or 0- to 30-carbon substituted or unsubstituted heterocyclic amino group, e.g., amino, methylamino, dimethylamino, anilino, N-methyl-anilino, diphenylamino, N-1,3,5-triadine-2-ylamino), acylamino group (preferably a formylamino group, 2- to 30-carbon, substituted or unsubstituted alkylcarbonylamino group, and 7- to 30-carbon, substituted or unsubstituted arylcarbonylamino group, e.g., formylamino, acetylamino, pivaloylamino, lauroylamino, benzoylamino, and 3,4,5-tri-(n-octyloxy)phenylcarbonylamino), aminocarbonylamino group (preferably a 1- to 30-carbon, substituted or unsubstituted aminocarbonylamino, e.g., carbamoylamino, N,N-dimethylaminocarbonylamino, N,N-diethylaminocarbonylamino, and morpholinocarbonylamino), an alkoxycarbonylamino group (preferably a 2- to 30-carbon, substituted or unsubstituted alkoxycarbonylamino group, e.g., methoxycarbonylamino, ethoxycarbonylamino, t-butoxycarbonylamino, n-octadecyloxycarbonylamino, and N-methyl-methoxycarbonylamino), aryloxycarbonylamino group (preferably a 7- to 30-carbon, substituted or unsubstituted aryloxycarbonylamino group, e.g., phenoxycarbonylamino, p-chlorophenoxycarbonylamino, and m-(n-octyloxy)phenoxycarbonylamino), sulfamoylamino group (preferably a 0- to 30-carbon, substituted or unsubstituted sulfamoylamino group, e.g., sulfamoylamino, N,N-dimethylaminosulfonylamino, and N-(n-octyl)aminosulfonylamino), alkyl- and aryl-sulfonylamino groups (preferably 1- to 30-carbon, substituted or unsubstituted alkylsulfonylamino and 6- to 30-carbon, substituted or unsubstituted arylsulfonylamino, e.g., methylsulfonylamino, butylsulfonylamino, phenylsulfonylamino, 2,3,5-trichlorophenylsulfonylamino, and p-methylphenylsulfonylamino), mercapto group, alkylthio group (preferably a 1- to 30-carbon, substituted or unsubstituted alkylthio group, e.g., methylthio, ethylthio, and n-hexadecylthio), arylthio group (preferably a 6- to 30-carbon, substituted or unsubstituted arylthio group, e.g., phenylthio, p-chlorophenylthio, and m-methoxyphenylthio), heterocyclic thio group (preferably a 2- to 30-carbon, substituted or unsubstituted heterocyclic thio group, the heterocyclic moiety of which is preferably those described in the above heterocyclic group, e.g., 2-benzothiazolylthio and 1-phenyltetrazole-5-ylthio), sulfamoyl group (preferably a 0- to 30-carbon, substituted or unsubstituted sulfamoyl group, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), sulfo group, alkyl- and aryl-sulfinyl groups (preferably a 1- to 30-carbon, substituted or unsubstituted alkylsulfinyl group and 6- to 30-carbon, substituted or unsubstituted arylsulfinyl group, e.g., methylsulfinyl, ethylsulfinyl, phenylsulfinyl, and p-methylphenylsulfinyl), alkyl- and aryl-sulfonyl groups (preferably a 1- to 30-carbon, substituted or unsubstituted alkylsulfonyl group and 6- to 30-carbon, substituted or unsubstituted arylsulfonyl group, e.g., methylsulfonyl, ethylsulfonyl, phenylsulfonyl, and p-methylphenylsulfonyl), acyl group (preferably a formyl group, 2- to 30-carbon, substituted or unsubstituted alkylcarbonyl group, and 7- to 30-carbon, substituted or unsubstituted arylcarbonyl group, e.g., acetyl, pivaloyl, 2-chloroacetyl, stearoyl, benzoyl, and p-(n-octyloxy)phenylcarbonyl), aryloxycarbonyl group (preferably a 7- to 30-carbon, substituted or unsubstituted aryloxycarbonyl group, e.g., phenoxycarbonyl, o-chlorophenoxycarbonyl, m-nitrophenoxycarbonyl, and p-(t-butyl)phenoxycarbonyl), alkoxycarbonyl group (preferably a 2- to 30-carbon, substituted or unsubstituted alkoxycarbonyl group, e.g., methoxycarbonyl, ethoxycarbonyl, t-butoxycarbonyl, and n-octadecyloxycarbonyl), carbamoyl group (preferably 1- to 30-carbon, substituted or unsubstituted carbamoyl, e.g., carbamoyl, N-methylcarbamoyl, N,N-dimethylcarbamoyl, N,N-di-n-octylcarbamoyl, and N-(methylsulfonyl)carbamoyl), aryl- and heterocyclic-azo groups (preferably a 6- to 30-carbon, substituted or unsubstituted arylazo group and 3- to 30-carbon, substituted or unsubstituted heterocyclic azo group, the heterocyclic moiety of which is preferably those described in the above heterocyclic group, e.g., phenylazo, p-chlorophenylazo, and 5-ethylthio-1,3,4-thiadiazole-2-ylazo), imido group (preferably a 2- to 30-carbon, substituted or unsubstituted imido group, e.g., N-succinimido and N-phthalimido), phosphino group (preferably a 2- to 30-carbon, substituted or unsubstituted phosphino group, e.g., dimethylphosphino, diphenylphosphino, and methylphenoxyphosphino), phosphinyl group (preferably a 0- to 30-carbon, substituted or unsubstituted phosphinyl group, e.g., phosphinyl, dioctyloxyphosphinyl, and diethoxyphosphinyl), phosphinyloxy group (preferably a 2- to 30-carbon, substituted or unsubstituted phosphinyloxy group, e.g., diphenoxyphosphinyloxy and dioctyloxyphosphinyloxy), phosphinylamino group (preferably a 2- to 30-carbon, substituted or unsubstituted phosphinylamino group, e.g., dimethoxyphosphinylamino and dimethylaminophosphinylamino), silyl group (preferably a 3- to 30-carbon, substituted or unsubstituted silyl group, e.g., trimethylsilyl, t-butyldimethylsilyl, and phenyldimethylsilyl).

Of the above substituents that $R_{21}$ may have, those having a hydrogen atom may be further substituted by the above groups by removing the hydrogen atom. Examples of such substituents that $R_{21}$ may further have are an alkylcarbonylaminosulfonyl group, arylcarbonylaminosulfonyl group, alkylsulfonylaminocarbonyl group, and arylsulfonylaminocarbonyl group. Specific examples of these groups are methylsulfonylaminocarbonyl, p-methylphenylsulfonylaminocarbonyl, acetylaminosulfonyl, benzoylaminosulfonyl, dodecylcarbonylaminosulfonyl, p-chlorophenylcarbonylaminosulfonyl, dodecanesulfonylaminocarbonyl, p-toluenesulfonylaminocarbonyl, and p-dodecyloxybenzenesulfonylaminocarbonyl.

The groups neighboring to each other may be bonded to form a ring, which is preferably a 5- to 7-membered, saturated or unsaturated ring, which may be an alicycle, aromatic ring or heterocycle, e.g., benzene ring, furan ring, thiophene ring, cyclopentane ring or cyclohexane ring.

These substituents and the rings formed by bonding a plurality of the neighboring substituents each other may be further substituted by a substituent (including groups exemplified as a substituent that the above mentioned $R_{21}$ may include). The total number of carbon atoms of the substituent that $R_{21}$ may include is preferably 2 to 50, more preferably 8 to 45. And further preferably 15 to 40 is preferable. Among these substituents, preferable one is an alkyl group, alkenyl group, aryl group, heterocyclic group, halogen atom, alkoxy group, aryloxy group, alkylthio group, arylthio group, cyano group, acylamino group, alkyl- or aryl-sulfonylamino group, alkoxycarbonyl group, carbamoyl group, sulfamoyl group, alkylamino group or arylamino group.

Preferably $R_{21}$ is a straight-chain alkyl group having 7 carbon atoms or more, and more preferably $R_{21}$ is an unsubstituted straight-chain alkyl group having 7 carbon atoms or more.

In the general formula (YC-I), Q represents a residue that forms a nitrogen-containing 6-membered heterocyclic ring with a —N—C═N— moiety. The nitrogen-containing heterocyclic ring is a substituted or unsubstituted heterocyclic ring, which is more preferably a heterocyclic group consisting of at least one carbon atom and at least one nitrogen atom as ring-constituting atoms and the number of the nitrogen atom of the heterocyclic ring is 2 to 4. Further preferably, it is a nitrogen-containing 6-membered heterocyclic ring including 2 to 30 carbon atoms and 2 nitrogen atoms. Examples of the nitrogen-containing 6-memeberd ring that Q forms with —N—C═N— moiety include 4-pyrimidon, 1,3-diazine-4,6-dione, 1,3,5-triazine-2-one and 1,2,4-triazine-5-one. The nitrogen-containing 6-membered ring that is formed by Q together with the —N—C═N— moiety may have a substituent. Examples of the substituent are the same as those of the substituent, which the above-mentioned $R_{21}$ may have. Further, the substituents adjacent to each other may bond together to form a ring, and a 5- to 7-membered saturated or unsaturated ring is preferable. The ring may be an alicyclic ring, aromatic ring or heterocyclic ring. Examples of the ring include a benzene ring, furan ring, thiophene ring, cyclopentane ring and cyclohexane ring.

These substituents and the rings formed by mutual bonding of a plurality of the neighboring substituents each other also may have a substituent. Examples of the substituent are the same as those of the substituent, which the above-mentioned $R_{21}$ may have. The total number of carbon atoms of the above-mentioned substituent is preferably 2 to 50, more preferably 8 to 45, furthermore preferably 15 to 40. A preferable example of the substituent is an alkyl group, alkenyl group, aryl group, heterocyclic group, halogen atom, alkoxy group, aryloxy group, alkylthio group, arylthio group, cyano group, acylamino group, alkyl- or aryl-sulfonylamino group, alkoxycarbonyl group, carbamoyl group, sulfamoyl group, alkylamino group or arylamino group.

Q is preferably a residue that forms a 4-pyrimidone ring. More preferably Q is represented by —C(—$R_{22}$)═C(—$R_{23}$)—CO—. $R_{22}$ and $R_{23}$ represent groups that combine with each other to form a 5- to 7-membered ring together with the —C═C— moiety, or hydrogen atoms or substituent groups independently each other. The ring, which is formed by combination of $R_{22}$ and $R_{23}$ together with the —C═C— moiety, is preferably a 5- to 7-membered alicyclic, aromatic or heterocyclic ring. Examples of the ring include a benzene ring, pyrazole ring, furan ring, thiophene ring, cyclopentene ring and cyclohexene ring. More preferably the ring is a 6-membered aromatic ring. The benzene ring is most preferred. When $R_{22}$ and $R_{23}$ represent substituents, they may be the same or different from each other. Examples of the substituent are the same as those of the substituent, which the above-mentioned $R_{21}$ may have.

In a color-forming coupler represented by the general formula (YC-I), when Q is represented by —C(—$R_{22}$)═C(—$R_{23}$)—CO— wherein $R_{22}$ and $R_{23}$ are groups that bind with each other to form a benzene ring together with the —C═C— moiety, preferably the benzene ring has an electron-withdrawing substituent having a Hammett's substituent constant σp of 0 or more on it, and more preferably it has an electron-withdrawing substituent having a Hammett's substituent constant σp of 0 to 1.5. The sum of σp's of substituents that the benzene ring has is preferably 0 or more, more preferably 0.40 or more, further preferably 0.60 or more, and the most preferably 0.80 or more. Here the sum of σp's is preferably 3.90 or smaller. In this connection, as for Hammett's constants σp and σm, documents such as Inamoto Naoki, "Hammett's rule—structure and reactivity—" (Maruzen), The Chemical Society Japan ed. "Shin Jikkenkagaku Koza (New course of experimental chemistry) 14 Synthesis and reaction of organic compounds V" p. 2605 (Maruzen), Nakaya Tadao "Description of theoretical organic chemistry" p. 217 (Tokyo Kagaku Dozin) and Chem. Rev. vol. 91, pp. 165–195 (1991) commentate in detail.

In the general formula (YC-I), $X_2$ represents an aryl group. Preferable examples of the aryl group include substituted or unsubstituted aryl groups having 6 to 30 carbon atoms such as phenyl and naphthyl. $X_2$ may have a substituent. Examples of the substituent are the same as those of the substituent, which the above-mentioned $R_{21}$ may have. Preferably $X_2$ has a substituent such as an alkyl group, alkenyl group, aryl group, heterocyclic group, halogen atom, alkoxy group, aryloxy group, alkylthio group, arylthio group, cyano group, acylamino group, alkyl- or aryl-sulfonylamino group, alkoxycarbonyl group, carbamoyl group, sulfamoyl group, alkylamino group or arylamino group. Preferably a site adjacent to the position to which the amido moiety is bonded on the aryl group contains a halogen atom (for example, a fluorine atom or chlorine atom), alkyl group (for example, methyl), alkoxy group (for example, methoxy, isopropyloxy or dodecyloxy), or aryloxy group (for example, phenoxy). More preferably, it contains a halogen atom or alkoxy group, and further more preferably an alkoxy group. In a coupler according to the invention represented by the general formula (YC-I), $X_2$ is preferably an phenyl group and, among them, while defining the position at which the phenyl group binds to the amido moiety as 1-site, those having the above described substituent at least at 2-site are preferable, and those having the substituents at 2-site and 5-site are more preferable.

In the general formula (YC-I), $Y_2$ represents a hydrogen atom or a group capable of splitting off by a coupling reaction with an oxidized aromatic primary amine color developing agent. Examples of $Y_2$ are a group that splits off at a nitrogen atom, a group that splits off at an oxygen atom, a group that splits off at a sulfur atom, and a halogen atom (e.g., chlorine or bromine atom). The group that splits off at a nitrogen atom can be, for example, a heterocyclic group [preferably 5- to 7-membered, substituted or unsubstituted, saturated or unsaturated, aromatic (herein meaning those having 4n+2 cyclic conjugated electrons) or nonaromatic, monocyclic or condensed-ring heterocyclic group; more preferably a 5- or 6-membered heterocyclic group having its ring forming atoms selected from among carbon, nitrogen and sulfur atoms and having at least one of nitrogen, oxygen and sulfur hetero atoms, such as any of groups from imidazoline-2,4-dione, oxazolidine-2,4-dione, succinimide, maleinimide, phthalimide, diglycolimide, pyrrole, pyrazole, imidazole, 1,2,4-triazole, tetrazole, indole, benzopyrazle, benzimidazole, benzotriazole, thiazolidin-2-one, benzimidazolin-2-one, benzoxazolin-2-one, benzothiazolin-2-one, 2-pyrrolin-5-one, 2-imidazolin-5-one, indoline-2,3-dione, 2,6-dioxypurine parabanic acid, 1,2,4-triazolidine-3,5-dione, 2-pyridone, 4-pyridone, 2-pyrimidone, 6-pyridazone, 2-pyrazone and 2-amino-1,3,4-thiazolidin-4-one], a carbonamido group (e.g., acetamido or trifluoroacetamido), a sulfonamido group (e.g., methanesulfonamido or benzenesulfonamido), an arylazo group (e.g., phenylazo or naphthylazo) or a carbamoylamino group (e.g., N-methylcarbamoylazo).

Among the groups that splits off at a nitrogen atom, a heterocyclic group is preferred. An aromatic heterocyclic group having one, two, three or four nitrogen atoms as ring-constituting atoms, or a heterocyclic group represented by the following general formula (L) is more preferred.

(L)

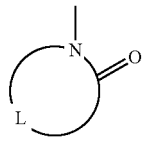

In the formula, L represents a residue capable of forming a 5- or 6-membered nitrogen-containing heterocycle in cooperation with —NC(═O)—.

Examples thereof are as mentioned above in the description of heterocyclic groups, which are more preferred. In particular, it is preferred that L represents a residue capable of forming a 5-membered nitrogen-containing heterocycle.

As the group that splits off at an oxygen atom, there can be mentioned, for example, aryloxy group (e.g., phenoxy or 1-naphthoxy), heterocyclic oxy group (e.g., pyridyloxy or pyrazolyloxy), acyloxy group (e.g., acetoxy or benzoyloxy), alkoxy group (e.g., methoxy or dodecyloxy), carbamoyloxy group (e.g., N,N-diethylcarbamoyloxy or morpholinocarbamoyloxy), aryloxycarbonyloxy group (e.g., phenoxycarbonyloxy), alkoxycarbonyloxy group (e.g., methoxycarbonyloxy or ethoxycarbonyloxy), alkylsulfonyloxy group (e.g., methanesulfonyloxy) or arylsulfonyloxy group (e.g., benzenesulfonyloxy or toluenesulfonyloxy). Among the groups that split off at an oxygen atom, an aryloxy group, acyloxy group and heterocyclic oxy group are preferred.

As the group that splits off at a sulfur atom, there can be mentioned, for example, arylthio group (e.g., phenylthio or naphthylthio), heterocyclic thio group (e.g., tetrazolylthio, 1,3,4-thiadiazolylthio, 1,3,4-oxazolylthio or benzimidazolylthio), alkylthio group (e.g., methylthio, octylthio or hexadecylthio), alkylsulfinyl group (e.g., methanesulfinyl), arylsulfinyl group (e.g., benzenesulfinyl), arylsulfonyl group (e.g., benzenesulfonyl) or alklylsulfonyl group (e.g., methanesulfonyl). Among the groups that split off at a sulfur atom, arylthio group and heterocyclic thio group are preferred. Heterocyclic thio group is more preferred.

$Y_2$ may have a substituent. The substituent for $Y_2$ can be, for example, any of those mentioned above as examples of the substituent that $R_{21}$ may have. Preferably, $Y_2$ represents a group that splits off at a nitrogen atom, a group that splits off at an oxygen atom or a group that splits off at a sulfur atom. More preferably, $Y_2$ represents a group that splits off at a nitrogen atom. Still more preferably, $Y_2$ represents any of preferred groups mentioned above with respect to the group that splits off at a nitrogen atom. Describing preferable groups of $Y_2$, the preferable groups are an aromatic heterocyclic group having 1, 2 or 4 nitrogen atoms as the ring-forming atom, or a heterocyclic group represented by the general formula (L) (especially preferably, a heterocyclic group represented by the general formula (L)), or a group that splits off at a sulfur atom (preferably, arylthio group or heterocyclic thio group, especially preferably a heterocyclic thio group). Moreover, $Y_2$ may be a photographically useful group. As the photographically useful group, there can be mentioned a development inhibitor, desilvering accelerator, redox compound, dye, coupler or the like, or a precursor thereof. More preferably, $Y_2$ is a development inhibitor or the precursor thereof. Examples thereof are the development inhibitors and precursors thereof described in the publication of JP-A-2000-17195, the contents of which are incorporated herein by reference. Among the examples, those described as preferable in the publication are preferable.

For the immobilization of the coupler in the photosensitive material, it is preferred that the total number of carbon atoms, including those of substituents, of at least one of Q, $R_{21}$, $X_2$ and $Y_2$ be in the range of 8 to 50. More preferably, the total number of carbon atoms is in the range of 10 to 40.

Among the couplers represented by the general formula (YC-I) according to the present invention, preferred specific examples will be shown below, which however should not be construed as limiting the scope of the present invention. Note that tautomers resulting from moving of the hydrogen atom to a carbonyl group or to a nitrogen-containing 6-membered ring are also comprehended in the present invention. Herein, Me represents methyl, Et represents ethyl and Ph represents phenyl.

(1)
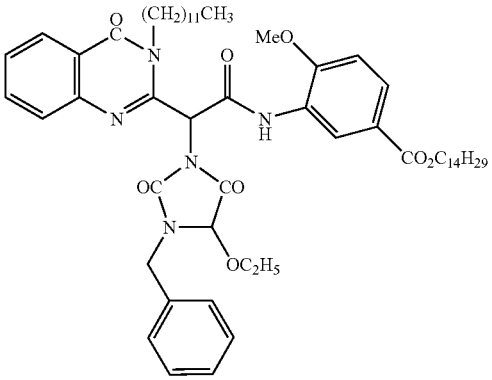
(2)
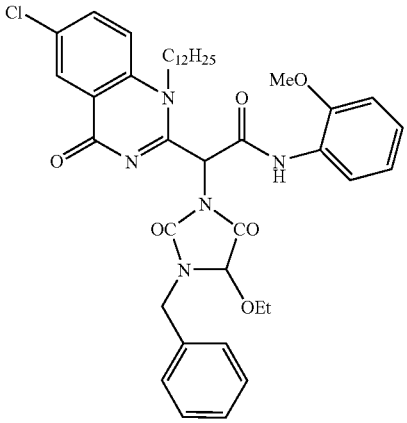
(3)
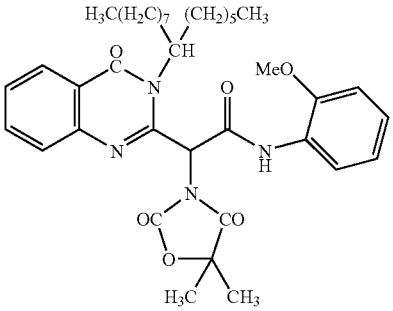
(4)
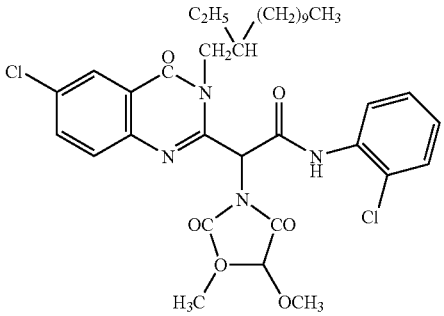
-continued
(5)
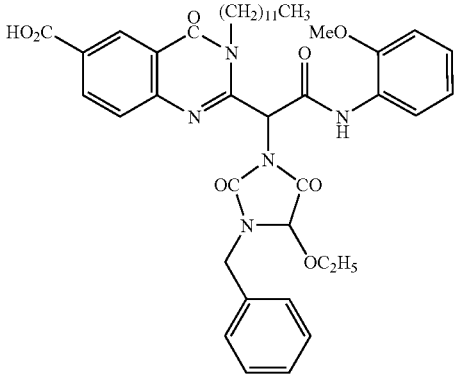
(6)
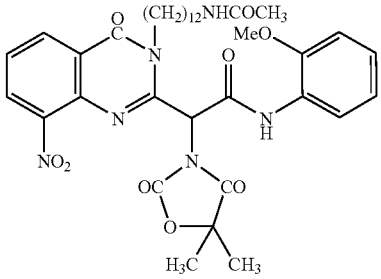
(7)
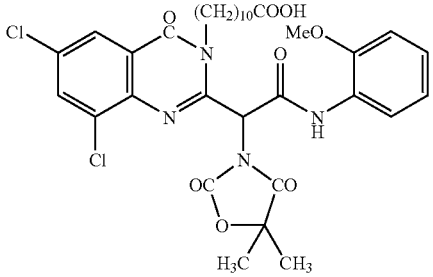
(8)
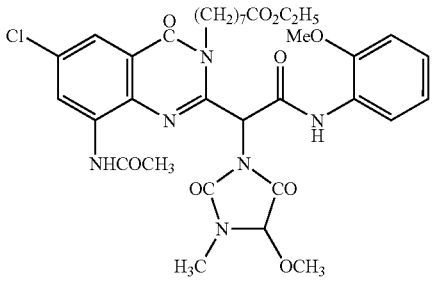
(9)
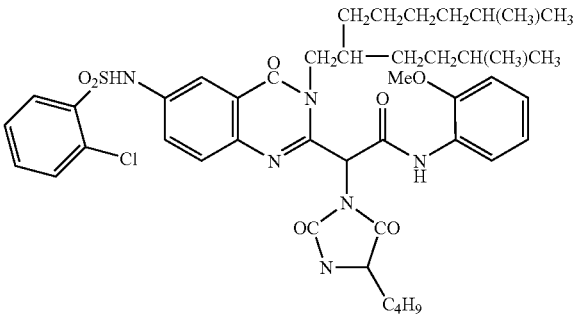

-continued
(10)
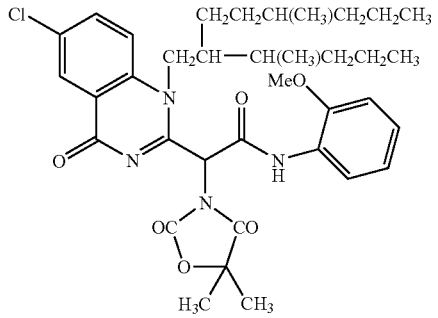
(11)
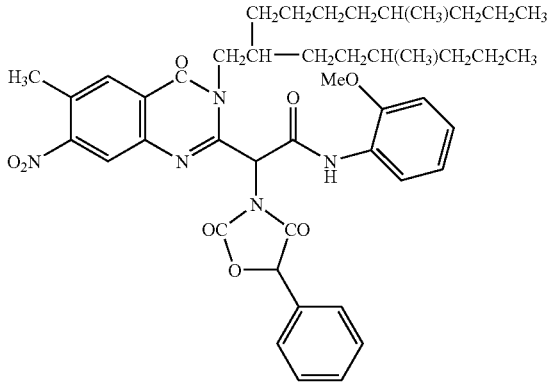
(12)
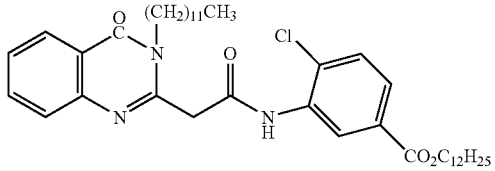
(13)
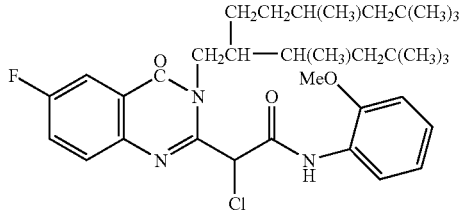
(14)
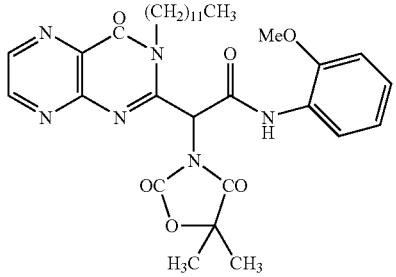
-continued
(15)
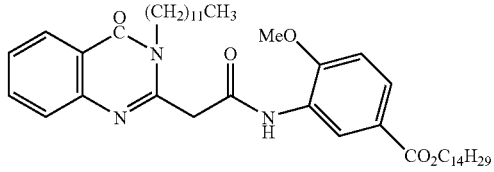
(16)
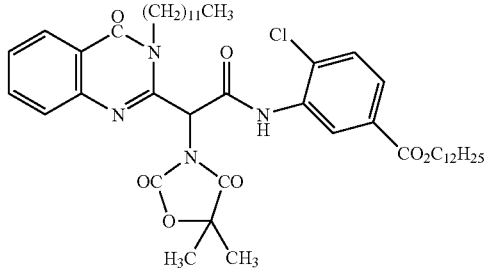
(17)
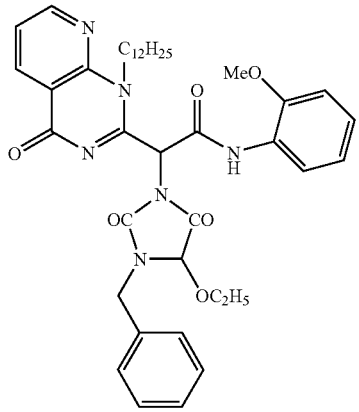
(18)
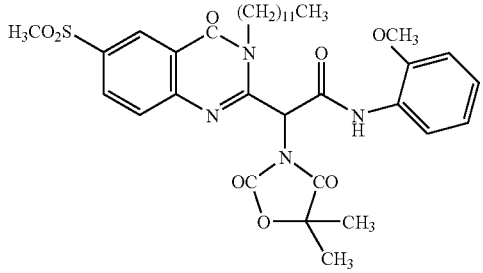
(19)
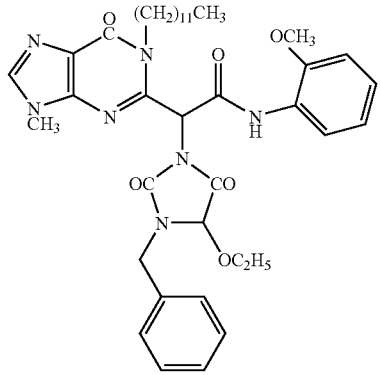

-continued
(20)
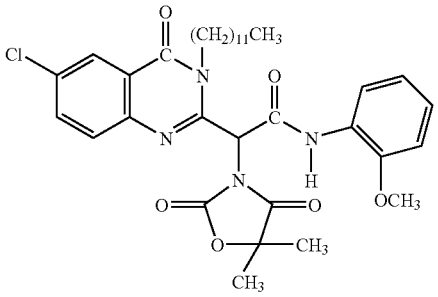
(21)
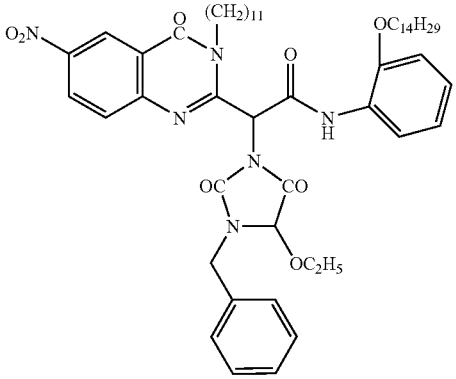
(22)
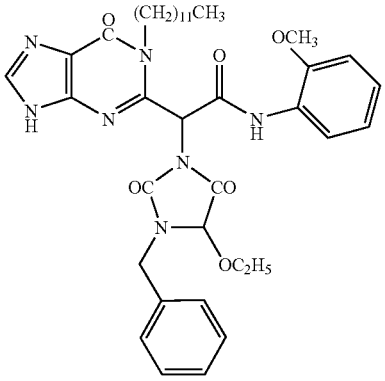
(23)
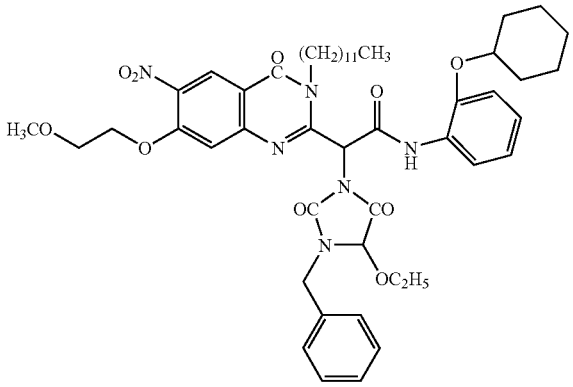
-continued
(24)
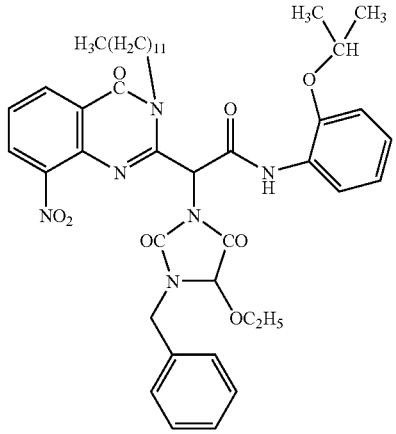
(25)
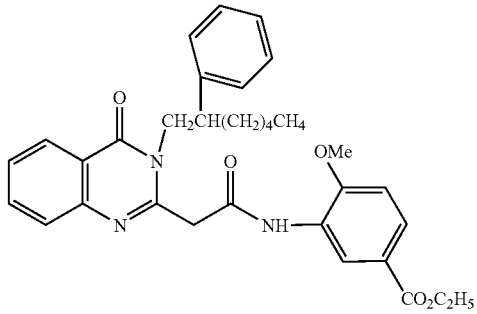
(26)
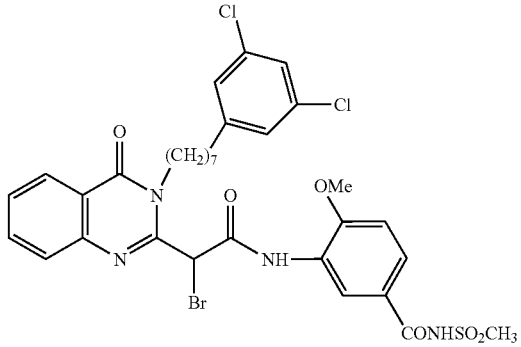
(27)
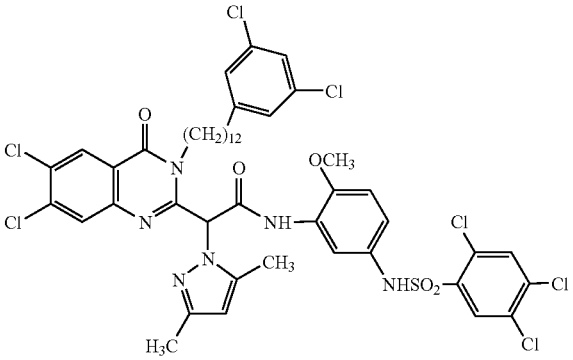

-continued (28)

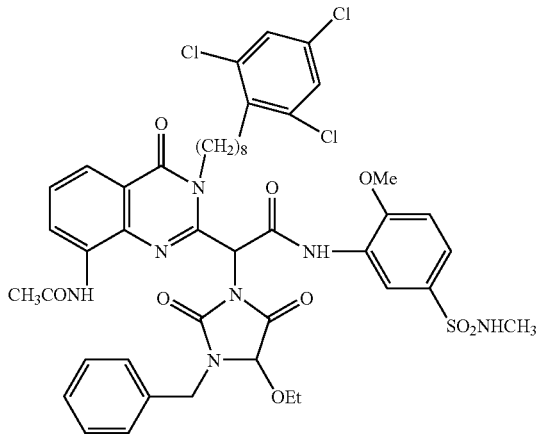

(29)

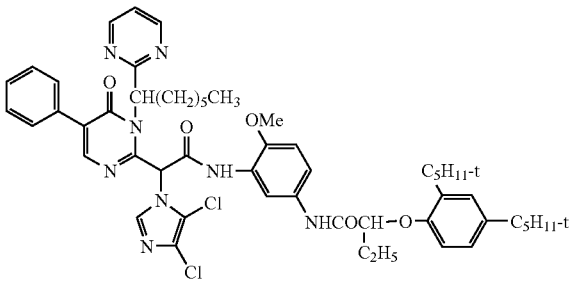

(30)

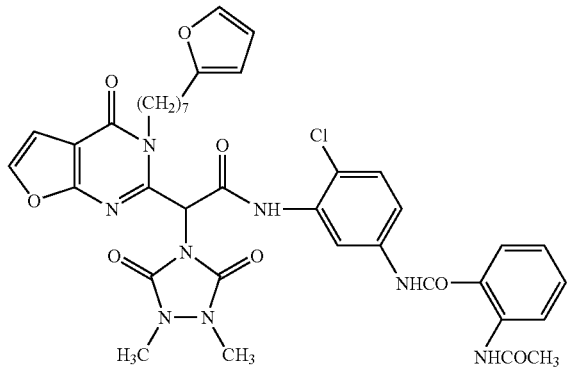

(31)

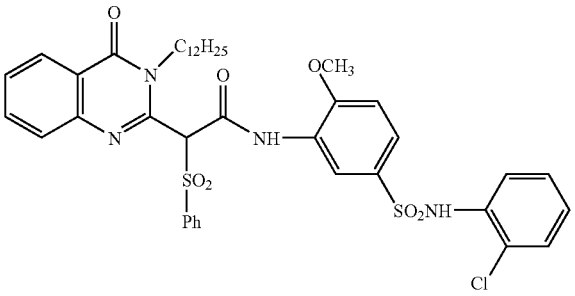

-continued (32)

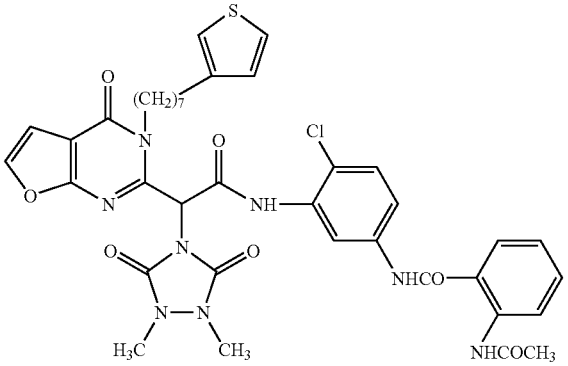

(33)

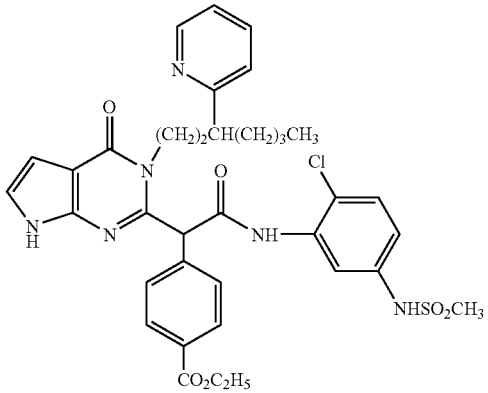

(34)

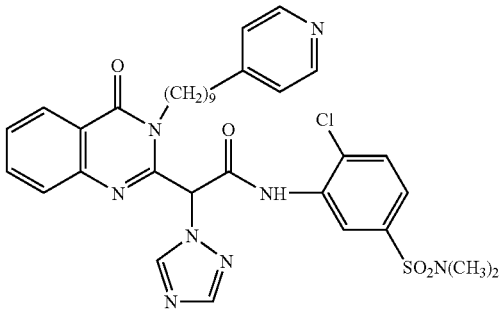

The compound represented by the general formula (YC-I) of the present invention may be synthesized according to known methods, for example, the method described in the publication of JP-A-2002-318443.

The couplers of the present invention, preferably couplers that give a maximum density of 3.0 or more of yellow, magenta or cyan in color images after color development (the same can be applied to below), may be introduced into a photosensitive material by various known dispersing methods. It is preferable to use the oil-in-water dispersion method in which the coupler is dissolved into a high-boiling organic solvent, together with a low-boiling solvent if necessary, and emulsified into an aqueous gelatin solution to disperse therein, and added to a silver halide emulsion Examples of the high-boiling solvent used in this oil-in-water dispersion method are described in, e.g., U.S. Pat. No. 2,322,027, the contents of which are incorporated herein by reference. Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230, JP-B-53-41091, and EP029104, the contents of which are incorporated herein by reference. Dispersion using an organic solvent-soluble polymer is described in PCT International Publication WO88/00723, the contents of which are incorporated herein by reference.

Examples of the high-boiling solvent usable in the above-mentioned oil-in-water dispersion method are phthalic esters (e.g., dibutylphthalate, dioctylphthalate, dicyclohexylphthalate, di(2-ethylhexyl)phthalate, decylphthalate, bis(2,4-di-tert-amylphenyl)isophthalate, and bis(1,1-diethylpropyl)phthalate), esters of phosphoric acid and phosphonic acid (e.g., diphenylphosphate, triphenylphosphate, tricresylphosphate, 2-ethylhexyldiphenylphosphate, dioctylbutylphosphate, tricyclohexylphosphate, tri-2-ethylhexylphosphate, tridodecylphosphate, and di(2-ethylhexylphenylphosphate), benzoic esters (e.g., 2-ethylhexylbenzoate, 2,4-dichlorobenzoate, dodecylbenzoate, and 2-ethylhexyl-p-hydroxybenzoate), amides (e.g., N,N-diethyldodecaneamide, N,N-diethyllaurylamide, N,N,N,N-tetrakis(2-ethlhexyl)isophthalamide and N,N,N,N-tetrokiscyclohexylisophthalamide), alcohols and phenols (e.g., isostearylalcohol and 2,4-di-tert-amylphenol), aliphatic esters (e.g., dibutoxyethyl succinate, bis(2-ethylhexyl) succinate, 2-hexyldecyl tetradecanoate, tributyl citrate, diethyl azelate, isostearyl lactate, and trioctyl tosylate), aniline derivatives (e.g., N,N-dibutyl-2-butoxy-5-tert-octylaniline), chlorinated paraffins (paraffins containing 10% to 80% of chlorine), trimesic esters (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol), carboxylic acids (e.g., 2-(2,4-di-tert-amylphenoxy butyric acid and 2-ethoxyoctanedecanoic acid), alkylphosphoric acids (e.g., di-(2-ethylhexyl)phosphoric acid and diphenylphosphoric acid). In addition to the above high-boiling solvents, compounds described in, e.g., JP-A-6-258803, the contents of which are incorporated herein by reference.

Among these, phosphoric esters are preferable, and the combined use of phosphoric esters and alcohols or phenols is also preferable.

The ratio of the amount of the high-boiling organic solvent in relation to each coupler used together is 0 to 2.0 by weight ratio, preferably 0 to 1.0 by weight ratio, and especially preferably 0 to 0.5 by weight ratio.

Also, an organic solvent having a boiling point of 30° C. to about 160° C. (e.g., ethyl acetate, butyl acetate, ethyl propionate, methyl ethyl ketone, cyclohexanone, 2-ethoxyethylacetate, or dimethylformamide) may be used in combination as an auxiliary solvent.

The content of the couplers of the present invention in the photosensitive material is in the range of 0.01 to 10 g, preferably 0.1 to 2 g per $m^2$. The content per mol of silver halides contained in the same photosensitive emulsion layer is appropriately in the range of $1\times10^{-3}$ to 1 mol, preferably $2\times10^{-3}$ to $3\times10^{-1}$ mol.

When the light-sensitive emulsion layer of the photosensitive material of the present invention has a unit construction consisting of tow or more light-sensitive emulsion layers having different speeds to each other, the content of the coupler per mol of silver halide is preferably $2\times10^{-3}$ to $2\times10^{-1}$ mol in the lowest speed layer, and is preferably $3\times10^{-2}$ to $3\times10^{-1}$ mol in the highest speed layer.

In the present invention, although the use of at least one type of coupler selected from couplers represented by the general formula (MC-I), the general formula (CC-I) and the general formula (YC-I) is preferred, use can be made of other couplers in combination. When the degree of contribution of color-forming dye of coupler of the present invention to the total density of dyes forming substantially the same color is higher, more favorable results are obtained. In particular, the coupler of the present invention is preferably used in such an amount that at least the degree of the contribution to color formation density is 50% or more, more preferably 70% or more. It is noted that preferable contents of these couplers represented by the general formula (YC-I), the general formula (MC-I) and the general formula (CC-I) are 30 to 100 mol %, preferably 50 to 100 mol %, more preferably 70 to 100 mol % of image-forming couplers contained in the corresponding blue-sensitive emulsion layer unit, the corresponding green-sensitive emulsion layer unit, and the corresponding red-sensitive emulsion layer unit, respectively, to which these couplers are added.

The contents of the couplers in the photosensitive material is, as the total weight of yellow couplers, the total weight of magenta couplers and the total weight of cyan couplers, 0.01 g to 10 g per $m^2$, and preferably 0.1 g to 2 g per $m^2$; and suitably $1\times10^{-3}$ mole to 1 mole, preferably $2\times10^{-3}$ mole to $3\times10^{-1}$ mole per mole of silver halide in the same light-sensitive emulsion layer.

The photosensitive material according to the invention may contain a competing compound (a compound which reacts with an oxidized aromatic primary amine-color developing agent in competition with an image-forming coupler and does not form a dye image) at the same time. Examples of the competing compound include reducing compounds such as hydroquinones, catechols, hydrazines, sulfonamidophenols, or a compound which couples with the oxidized aromatic primary amine color developing agent but does not form substantially a color image (for example, a colorless coupler disclosed in German Pat. No. 1,155,675, Great Britain Pat. No. (hereinafter referred to as "GB") 861,138 and U.S. Pat. Nos. 3,876,428 and 3,912,513, or a flow out coupler disclosed in JP-A-6-83002, the contents of all of which are incorporated herein by reference.).

The competing compound is used by an addition amount of 0.01 g to 10 g, preferably 0.10 g to 5.0 g per 1 $m^2$ of the photosensitive material, and 1 to 1000 mol %, preferably 20 to 500 mol % in relation to the coupler of the invention.

Further, in the photosensitive material according to the invention, a photosensitive unit of the same color sensitivity may have an interlayer without color formation ability and, in addition, the interlayer preferably contains a compound which may be selected as the above described competing compound.

In order to prevent deterioration of photographic performance due to formaldehyde gas, the photosensitive material according to the invention preferably contains a compound capable of reacting with formaldehyde gas to fix it, such as the compound disclosed in U.S. Pat. Nos. 4,411,987 and 4,435,503.

The photosensitive material according to the invention may only have each at least one blue-sensitive silver halide emulsion layer unit, green-sensitive silver halide emulsion unit and red-sensitive silver halide emulsion unit, and at least one interimage effect-donating layer which substantially does not form an image, on a transparent support. It is preferable to coat and constitute these layers in this order from the side farther from the support. However, the order may be different from this order. In the invention, it is preferable to coat a red-sensitive silver halide emulsion layer unit, a green-sensitive silver halide emulsion layer unit and a blue-sensitive silver halide emulsion layer unit in this order from the side nearer to the support. In addition, although each color sensitive layer unit may be constituted by a single layer, a unit constitution containing two or more light-sensitive emulsion layers having different sensitivities from each other is preferable. Particularly, a three-layer unit construction, in which each unit has three light-sensitive emulsion layers consisting of a low-speed layer, a medium-speed layer and a high-speed layer from the side nearer to the support, is preferable. These are described in JP-B-49-15495, JP-A-59-202464 and so on.

As one of preferable embodiment of the invention, a photosensitive element can be mentioned, in which each layer is coated on a support in the order of a subbing layer/an anti-halation layer/a first intermediate layer/a short wave green-sensitive unit (a donor layer 1)/a long wave red-sensitive unit (a donor layer 2)/a second intermediate layer/a red-sensitive emulsion layer unit (consisting of three layers including a low-speed red-sensitive layer/a medium-speed red-sensitive layer/a high-speed red-sensitive layer from the side nearer to the support)/a third intermediate layer/a green-sensitive emulsion layer unit (consisting of three layers including a low-speed green-sensitive layer/a medium-speed green-sensitive layer/a high-speed green-sensitive layer from the side nearer to the support)/a yellow filter layer/a short wave blue-sensitive layer unit (a donor layer 3)/a blue-sensitive emulsion layer unit (consisting of three layers including a low-speed blue-sensitive layer/a medium-speed blue-sensitive layer/a high-speed blue-sensitive layer from the side nearer to the support)/a first protective layer/a second protective layer. The fist, second and third intermediate layers may be constituted of a single layer or two layers or more, respectively. Preferably, the third intermediate layer is constituted of two layers or more and the layer directly adjacent to the green-sensitive emulsion layer unit contains yellow colloidal silver. In addition, further arrangement of a forth intermediate layer between the yellow filter layer and the blue-sensitive emulsion layer unit is also preferable. The interimage effect-donating layer itself may contain a color mixing-preventing agent.

The intermediate layer may contain a coupler, a DIR compound or the like described in JP-A's-61-43748, 59-113438, 59-113440, 61-20037 and 61-20038, or a color mixing-preventing agent as is usually used.

Further, a protective layer of three-layer construction including a first protective layer to a third protective layer is also preferable. When the protective layer has two or three layers, a second protective layer preferably contains fine grain silver halide having the average equivalent-sphere diameter of 0.10 μm or less. Preferably the silver halide is silver bromide or silver iodobromide.

The emulsion used in the silver halide photosensitive material according to the invention preferably contains tabular silver halide grains having an aspect ratio ranging from 1.5 to 100. Here, the tabular silver halide grain is the generic term of the silver halide grain having one twin face or two or more parallel twin faces. The twin face means a (111) face when ions on the all lattice points are in mirror image relationship on both sides of the (111) face. The tabular grain comprises two main planes parallel to each other and side planes connecting these main planes. When viewing the grain from above of the main plane, the main plane has a figure of triangle, hexagon, or circle formed by making them round. The tabular grain of a triangular figure, a hexagonal figure or a circular figure has triangular, hexagonal or circular main planes parallel to each other, respectively.

The aspect ratio of the tabular grain means a value obtained by dividing the grain diameter by the thickness. The thickness of the grain can easily be determined by vapor depositing metal to the grain along with latex for reference from an oblique direction followed by measuring the length of shadow of them on an electron microscopic photograph and conducting calculation with reference to the length of the shadow of the latex.

Grain diameter in the invention means the diameter of a circle having an area equal to the projected area of the parallel main planes of a grain.

The projected area of a grain can be obtained by measuring the area on the electron microscopic photograph followed by compensating the photographing magnification.

The diameter of the tabular grain is preferably 0.3 to 5.0 μm. Thickness of the tabular grain is preferably 0.05 to 0.5 μm.

Sum of the projected areas of the tabular grains used in the invention occupies preferably 50% or more, and particularly preferably 80% or more of the total projected areas of all the silver halide grains in the emulsion. Further, the aspect ratio of the tabular grains accounting for these certain area ranges preferably is from 1.5 to less than 100. More preferably, it ranges from 2 to less than 20, and furthermore preferably from 2 to less than 8.

In addition, use of monodisperse tabular grains sometimes results in a more preferable result. Structure and the preparation method of the monodisperse tabular grains follow the description of JP-A-63-151618, for example. Briefly describing the figure thereof, 70% or more of the total projected areas of the silver halide grains are hexagons having the ratio of 2 or less in the relation of the length of the edges having the longest length to the edges having the shortest length in the main plane, and occupied by tabular silver halides having two parallel planes as outer surfaces, and further the hexagonal tabular silver halide grains have monodispersion property with 20% or less of the coefficient of variation of the grain size distribution (the value obtained by dividing the variation of the grain size (standard deviation) represented by equivalent-circle diameter of the projected area by the average grain size).

Further, the tabular grain used in the invention preferably has a dislocation line.

The dislocation line of the tabular grain can be observed by a direct method using a transmission electron microscope at a low temperature described, for example, in above mentioned J. F. Hamilton, Phot. Sci. Eng., 11, 57 (1967) or Shiozawa, J. Soc. Phot. Sci. Japan. 35, 213 (1972). That is, silver halide grains are taken out of an emulsion with taking care not to give a strong pressure which may induce dislocation to the grains, placed on the mesh for electron microscope observation and observed by a transmission method while cooling the sample in order to avoid damage by electron beams (print our or the like). In this case, since thicker thickness of the grain makes the electron beam more difficult to transmit, use of a high voltage type (acceleration voltage of 200 kV or higher for grains with thickness of 0.25 μm) electron microscope can make a more clear observation possible. Using the photograph of the grain obtained by the method, position of the dislocation line seen from the perpendicular direction to the main plain can be obtained.

As for position of the dislocation line of the tabular grain used in the invention, it starts from the distance of x % of the length between the center and the edge to the edge, in relation to the long axis direction. The value of x is preferably $10 \leqq x < 100$, more preferably $30 \leqq x < 98$, and further more preferably $50 \leqq x < 95$. On this occasion, figure that is formed by binding the position where the dislocation lines start is nearly analogous to the figure of the grain, however sometimes it twists to become not completely analogous. Direction of the dislocation line is approximately the direction from the center to the edge. But it often meanders.

As for number of the dislocation lines of the tabular grains used in the invention, presence of grains having 10 dislocation lines or more by 50% (number of pieces) or more is preferable. More preferably the tabular grains including grains having 10 dislocation lines or more by 80% (number of pieces) or more, and particularly preferably those including grains having 20 dislocation lines or more by 80% (number of pieces) or more, are recommended.

Manufacturing method of the tabular grain used in the invention will be described.

The tabular grain used in the invention can be manufactured by improving methods described in Cleve, Photography Theory and Practice (1930), p13; Gutuff, Photographic Science and Engineering Vol. 14, pp 248–257 (1970); U.S. Pat. Nos. 4,434,226, 4,414,310, 4,433,048 and 4,439,520, GB 2,112,157 and the like.

In the tabular silver halide emulsion used in the invention, any of silver halides including silver bromide, silver iodobromide, silver iodochlorobromide and silver chlorobromide may be used. Preferable silver halides is silver iodochlorobromide or silver iodobromide containing 30 mol % or less of silver iodide.

Further, the silver halide emulsion used in the invention may have a multiple-structure concerning halogen composition in the grain. For example, it may have a quintuple structure. Here, the structure means that it has a structure concerning distribution of silver iodide, and that content of the silver iodide differs between respective structures by 1 mol % or more. The structures concerning the distribution of silver iodide can be basically determined by calculation from the prescription value of preparation process of grains. There can be a case of abrupt variation and a case of mild variation in the variation of the silver iodide content in the interface between the respective structures. It is required to consider the measurement accuracy on analysis in order to confirm these, but the electron probe micro analyzer (EPMA) method is usually effective. The elemental analysis of a very fine region to which electron beam was irradiated can be carried out by preparing a sample in which emulsion grains are dispersed so as not to be mutually brought into contact and analyzing X-ray irradiated when electron beam was irradiated thereto. It is preferable to carry out the measurement at this time by cooling at a low temperature in order to prevent the damage of a sample caused by electron beam. The distribution of silver iodide in grains when the tabular grains are viewed from a direction perpendicular to the main plane can be analyzed by the same procedure, but the distribution of silver iodide in grains at the section of the tabular grains can be also analyzed by solidifying the same sample and using samples cut into ultra thin fragments by a microtome.

In the process of nucleation for grain formation, using gelatin with a little content of methionine as described in U.S. Pat. Nos. 4,713,320 and 4,942,120, carrying out the nucleation in high pBr as described in U.S. Pat. No. 4,914,014, and carrying out the nucleation in a short period of time as described in JP-A-2-222940 are highly effective for preparing tabular gains. In addition, in ripening process, carrying out under the presence of a low concentration of a base as described in U.S. Pat. No. 5,254,453 and carrying out at a high pH as described in U.S. Pat. No. 5,013,641 are effective for the ripening process in some cases.

The method for forming the tabular grain using a polyalkyleneoxide compound as described in U.S. Pat. Nos. 5,147,771, 5,147,772, 5,147,773, 5,171,659, 5,210,013 and 5,252,453 is preferably used for preparing core grains used in the invention.

For the purpose of obtaining tabular grains with a large aspect ratio and monodisperse, additional gelatin is added during forming grains in some cases. In this case, the gelatin to be used is preferably a chemically modified gelatin described in JP-A's-10-148897 and 11-143002 or gelatin with low methionine content described in U.S. Pat. Nos. 4,713,320 and 4,942,120. Particularly, the former chemically modified gelatin is characterized by newly introducing carboxyl groups by at least two upon chemically modifying amino groups in the gelatin, and use of succinated gelatin or trimellitated gelatin is preferable. It is preferable to add the chemically modified gelatin before growth process, and more preferable to add it just after formation of the nucleus. The addition amount of 50% or more, preferably 70% or more in relation to the total weight of the dispersion media is recommended.

Examples of silver halide solvents that can be used in the invention include (a) organic thioethers described in U.S. Pat. Nos. 3,271,157, 3,531,286 and 3,574,628, JP-A's-54-1019 and 54-158917 and the like, (b) thiourea derivatives described in JP-A's-53-82408, 55-77737 and 55-2982 and the like, (c) silver halide solvent having a thiocarbonyl group sandwiched between an oxygen or sulfur atom and a nitrogen atom described in JP-A-53-144319, (d) imidazoles described in JP-A-54-100717, (e) sulfites, (f) ammonia, (g) thiocyanates and the like. As particularly preferable silver halide solvents, thiocyanates, ammonia and tetramethyl thiourea can be mentioned. The amount of silver halide solvent to be used depends on the kind of the solvent and, in the case of thiocyanate for example, a preferable amount to be used ranges from $1\times10^{-4}$ to $1\times10^{-2}$ mole per mole of silver halide. Any solvent used can be removed basically when water washing process is provided after formation of the first shell, as is described above.

Dislocation of the tabular grain used in the invention is introduced by providing a high-iodide phase inside the grain.

The high-iodine phase means a silver halide solid solution containing iodine. As silver halide in this case, silver iodide, silver iodobromide or silver chloroiodobromide is preferable, silver iodide or silver iodobromide is more preferable, and silver iodide is particularly preferable.

Amount of silver halide forming the high-iodide phase is, in terms of silver, 30 mol % or less, and more preferably 10 mol % or less of the total amount of silver in the grains. A layer to be grown outside the high-iodide phase need contain a less content of iodide than that in the high-iodide phase. Preferably the iodide content is 0 to 12 mol %, more preferably 0 to 6 mol %, and most preferably 0 to 3 mol %.

As the preferable method for forming the high-iodide phase, there is a method in which it is formed by adding an emulsion containing fine grains of silver iodobromide or silver iodide (hereinafter, referred to as "silver iodide fine grain emulsion"). As these fine grains, those that have been previously prepared can be used and, more preferably, those that have been just prepared can be also used.

Firstly, the case, in which previously prepared fine grains are used, will be described. In this case, there is a method such that previously prepared fine grains are added and ripped to be dissolved. As a more preferable method, there is a method such that the silver iodide fine grain emulsion is added and then a silver nitrate aqueous solution, or a silver nitrate aqueous solution and halide aqueous solution are added. In this case, dissolution of the silver iodide fine grains is accelerated by the addition of the silver nitrate aqueous solution. Rapid addition of the silver iodide fine grain emulsion is preferable.

"Rapid addition of the silver iodide fine grain emulsion" means to complete preferably the addition of the silver iodide fine grain emulsion within 10 minutes. More preferably, it means to complete the addition within 7 minutes. Although this condition may vary depending on the adding system, such as temperature, pBr, pH, kind and concentration of protective colloid such as gelatin, and presence or absence and kind and concentration of a silver halide solvent, a shorter period of time is preferable, as described above. When adding, it is preferable not to add substantially an aqueous solution of silver salt such as silver nitrate. Temperature of the system at addition ranges preferably from 40 to 90° C., and particularly preferably from 50 to 80° C.

Fine grains contained in the silver iodide fine grain emulsion may be substantially silver iodide, and contain silver bromide and/or silver chloride only when they can form mixed crystal. Preferably they are silver iodide by 100%. As for crystalline structure of silver iodide, there may be β-phase, γ-phase and, as described in U.S. Pat. No. 4,672,026, α-phase or α-phase homologous structure. In the invention, there is no restriction on the crystalline structure, but a mixture of β-phase and γ-phase, and more preferably β-phase is used. As the silver iodide fine grain emulsion, those subjected to a normal washing process is preferably used. The silver iodide fine grain emulsion can be easily formed by the method described in U.S. Pat. No. 4,672,026 and the like. A double-jet addition method of an aqueous solution of silver salt and that of iodide salt, in which pI value during grain formation is kept constant, is preferable. Here, pI is logarithm of an inverse number of $I^-$ ion concentration of the system. There is no particular restriction on temperature, pI, pH, kind and concentration of protective colloid such as gelatin, presence or absence and kind and concentration of an silver halide solvent and the like, but size of grains of 0.1 μm or less, and more preferably 0.07 μm or less is convenient for the invention. Although figure of grains can be not completely specified because the grains are fine, but coefficient of variation of the grain size is preferably 25% or less. Particularly, when it is 20% or less, effect of the invention is significant. Here, the size and the size distribution of the fine grains are directly obtained by placing them on a mesh for electron microscope observation and observing them with a transmission method, instead of a carbon replica method. The reason is why observation with the carbon replica method results in a large measurement error because of the small grain size. The grain size is defined as the diameter of a circle having a projected area equal to that of the observed grain. Distribution of the grain size is also obtained by using the diameter of the circle having the equal projected area. The most effective fine grains in the invention have the grain size ranging from 0.02 μm to 0.06 μm and the coefficient of variation of the distribution of the grain sizes is 18% or less.

After formation of the grains above described, the silver iodide fine grain emulsion is preferably subjected to normal water washing described in U.S. Pat. No. 2,614,929 and the like, and adjustment of pH, pI, concentration of a protective colloid agent such as gelatin and concentration of contained silver iodide. Preferable pH ranges from 5 to 7. Preferably pI value is set the pI value that makes solubility of the silver iodide minimum, or a value higher than it. As the protective colloid agent, usual gelatin with an average molecular weight of 100,000 is preferably used. Low molecular weight gelatin with an average molecular weight of 20,000 or less is also preferably used. Further, a mixture of above described gelatins with different molecular weights is convenient in some cases. Amount of gelatin per kg of the emulsion is preferably from 10 g to 100 g. More preferably, it is from 20 g to 80 g. Amount of silver in terms of silver atom per kg of emulsion is preferably from 10 g to 100 g. More preferably, it is from 20 g to 80 g. It is preferable to select the amount of gelatin and/or silver so that it makes rapid addition of the silver iodide fine grain emulsion suitable.

Usually, the silver iodide fine grain emulsion is added after it has been previously dissolved, however, stirring efficiency need be made sufficiently high when it is added. Preferably, rotation number of stir is set higher than usual. In order to prevent generation of foam during stir, addition of a defoaming agent is effective. Concretely, a defoaming agent described in Examples and so on of U.S. Pat. No. 5,275,929 is used.

In the case where the fine grain just after preparation is used, as for details of a mixer for forming the silver halide fine grain, description in JP-A-10-43570 can be referred to.

The silver halide grain according to the invention preferably has a coefficient of variation of 20% or less for distribution of silver iodide content among the grains. More preferably, it is 15% or less, and particularly preferably, it is 10% or less. The case where the coefficient of variation is larger than 20% is not preferable, since it results in not hard tone and a larger reduction of sensitivity upon pressurization. The content of silver iodide in respective grains can be measured by using an X-ray micro analyzer and analyzing composition of each of grains. The coefficient of variation for silver iodide content distribution among grains is a value defined from the relational formula: (standard deviation/average silver iodide content)×100=coefficient of variation, while using the standard deviation of silver iodide content and average silver iodide content when silver iodide content in emulsion grains is measured for at least 100 grains, more preferably for at least 200 grains, and particularly preferably for at least 300 grains. Measurement of the silver iodide content in each of grains is described, for example, in EP 147,868. There are cases where correlation exists and does not exist between silver iodide content Yi (mol %) of respective grains and an equivalent-sphere diameter Xi (μm) of respective grains, but absence of the correlation is desirable.

In the emulsions used in the present invention, it is preferable to provide a positive hole-capturing zone in at least a part of the inside of silver halide grain. The positive hole-capturing zone herein indicates a region having a function of capturing, so to say, a positive hole, for example, a positive hole that arises in pair with a photo-electron generated by photo-excitation. In the present invention such a positive hole-capturing zone is defined as a zone provide with an intentional reduction sensitization.

In the present invention, "intentional reduction sensitization" means the procedure of adding a reduction sensitizer, thereby introducing positive hole-capturing silver nucleus at least a part of or a whole of the inside of the silver halide grain. The positive hole-capturing silver nucleus is a small silver nucleus having a little development activity. This silver nucleus can prevent recombination loss in the exposure step and increase the sensitivity.

As the reduction sensitizer, stannous chloride, ascorbic acid and its derivatives, amines and polyamines, hydrazine derivatives, formamidinesulfinic acid, silane compounds, and borane compounds are publicly known. In reduction sensitization performed for the emulsion of the present invention, it is possible to selectively use these reduction sensitizers or to use two or more types of compounds together. Stannous chloride, thiourea dioxide, dimethylamineborane, ascorbic acid and derivatives thereof are preferable compounds as the reduction sensitizers. The addition amount of the reduction sensitizer, although it is necessary to select the addition amount because it depends on the emulsion preparation conditions, is appropriately in the range of $10^{-7}$ to $10^{-3}$ mol per mol of silver halide.

The reduction sensitizer may be dissolved into a solvent such as water, alcohols, glycols, ketones, esters and amides, and added during grain growth.

In the present invention, the reduction sensitizer is preferably added after the completion of nucleation and physical ripening and immediately before the initiation of grain growth, thereby a positive hole-capturing zone is formed. However, it is also possible to add the reduction sensitizer on or after the completion of grain growth, thereby introducing positive hole-capturing nucleus on the grain surface.

The addition of the reduction sensitizer during grain growth allows a part of the formed silver nuclei to remain inside the grain, but a part of the formed silver nuclei ooze out, thereby silver nuclei are formed also on the grain surface. In the present invention the oozed silver nucleus may be used as positive hole-capturing silver nucleus.

In the present invention, the intentional reduction sensitization during a step of grain formation in order to form positive hole-capturing silver nucleus inside silver halide grain is performed preferably in the presence of the compound represented by general formula (II-1) or general formula (II-2) below.

Herein, during the step of grain formation does not include a step after performing the final desalting. For example, the step in which silver halide grains grow as a result of adding a silver salt aqueous solution or fine grain silver halide and so on in a step of chemical sensitization and so on is excluded from during the step of grain formation.

(II-1)

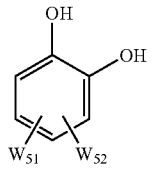

(II-2)

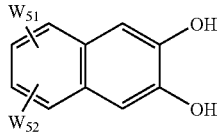

In formulas (II-1) and (II-2), each of $W_{51}$ and $W_{52}$ represents a sulfo group or hydrogen atom. However, at least one of $W_{51}$ and $W_{52}$ represents a sulfo group. The sulfo group is generally in an alkali metal salt such as sodium or potassium or a water-soluble salt such as ammonium salt. Specifically, preferable examples are 3,5-disulfocatechol disodium salt, 4-sulfocatechol ammonium salt, 2,3-dihydroxy-7-sulfonaphthalene sodium salt, 2,3-dihydroxy-6,7-disulfonaphthalene potassium salt. A preferred addition amount can vary in accordance with, e.g., the temperature, pBr, and pH of the system to which the compound is added, the type and concentration of a protective colloid agent such as gelatin, and the presence/absence, type, and concentration of a silver halide solvent. Generally, the addition amount is preferably 0.0005 to 0.5 mol, and more preferably, 0.003 to 0.02 mol per mol of a silver halide.

An oxidizer capable of oxidizing silver is preferably used during the process of preparing the emulsion of the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from ozone, hydrogen peroxide and adducts thereof, halogen elements and thiosulfonates and organic oxidizers selected from quinones. Especially preferable oxidizers are thiosulfonates described in JP-A-2-191938, the contents of which are incorporated herein by reference.

The addition of the oxidizer to silver may be at any time before the initiation of an intentional reduction sensitization, during reduction sensitization, or immediately before or after the completion of reduction sensitization. The addition may be divided into several times. The addition amount, although it varies depending on the type of the oxidizer, is preferably $1\times10^{-7}$ to $1\times10^{-3}$ mol per mol of silver halide.

As the binder or protective colloid which can be used in the preparation of the emulsion used in the present invention, although using of gelatin is advantageous, other hydrophilic colloids can be used.

For example, use can be made of a wide variety of synthetic hydrophilic polymeric substances, including gelatin derivatives, graft polymers from gelatin and other polymers, and proteins such as albumin and casein; cellulose derivatives such as hydroxyethylcellulose, carboxymethylcellulose and cellulose sulfates, and sugar derivatives such as sodium alginate and starch derivatives; and homopolymers and copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

As the gelatin, use may be made of not only a lime-processed gelatin but also an acid-processed gelatin or an enzyme-processed gelatin as described in Bull. Soc. Sci. Photo. Japan, No. 16, p30 (1966). Further, use can be made of a gelatin hydrolyzate or enzymolyzate.

The emulsion of the present invention is preferably washed for desalting and dispersed in a newly provided protective colloid. Although the water temperature can be selected in conformity with the object, it is preferably selected within the range of 5 to 50° C. Although the pH at which the washing is conducted can also be selected in conformity with the object, it is preferably selected within the range of 2 to 10, more preferably within the range of 3 to 8. Although the pAg at which the washing is conducted can also be selected in conformity with the object, it is preferably selected within the range of 5 to 10. The method of washing can be selected from among the noodle washing technique, the dialysis with the use of a semipermeable membrane, the centrifugation method, the coagulation precipitation method and the ion exchange method. The coagulation precipitation can be conducted according to a method selected from among the method in which a sulfate is used, the method in which an organic solvent is used, the method in which a water soluble polymer is used and the method in which a gelatin derivative is used.

In the preparation of the emulsion of the present invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as water, methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se and Te, cyanate, thiocyanate, selenocyanate, carbonate, phosphate, or acetate may be present.

In the formation of silver halide grains of the present invention, at least one of chalcogen sensitization including sulfur sensitization and selenium sensitization, and noble metal sensitization including gold sensitization and palladium sensitization and reduction sensitization can be performed at any point during the process of manufacturing a silver halide emulsion. The use of two or more different sensitizing methods is preferable.

Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization speck can be selected in accordance with the intended use.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom. More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

It is preferable to also perform gold sensitization for emulsions of the present invention. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

As a preferable sensitizing method for the emulsion of the invention, selenium sensitization can be mentioned. As a selenium sensitize used in the invention, selenium compounds disclosed in hitherto published patents can be used as the selenium sensitizer in the present invention. In the use of labile selenium compound and/or nonlabile selenium compound, generally, it is added to an emulsion and the emulsion is agitated at high temperature, preferably 40° C. or above, for a given period of time. Compounds described in, for example, JP-B's-44-15748 and 43-13489, JP-A's-4-25832 and 4-109240 are preferably used as the unlabile selenium compound.

Specific examples of the labile selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2,6-dimethoxybenzoyl)selenide), selenophosphates, phosphine selenides and colloidal metal selenium.

The labile selenium compounds, although preferred types thereof are as mentioned above, are not limited thereto. It is generally understood by persons of ordinary skill in the art to which the invention pertains that the structure of the labile selenium compound as a photographic emulsion sensitizer is not so important as long as the selenium is labile and that the labile selenium compound plays no other role than having its selenium carried by organic portions of selenium sensitizer molecules and causing it to present in labile form in the emulsion. In the present invention, the labile selenium compounds of this broad concept can be used advantageously.

Compounds described in JP-B's-46-4553, 52-34492 and 52-34491 can be used as the nonlabile selenium compound used in the present invention. Examples of the nonlabile selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in water or in a single solvent or a mixture of organic solvents selected from methanol and ethanol and added at the time of chemical sensitization. Preferably, the addition is performed prior to the initiation of chemical sensitization. The use of the above selenium sensitizers is not limited to a single kind, but the combined use of two or more kinds may be acceptable. The combined use of a labile selenium compound and an unlabile selenium compound is preferred.

The addition amount of the selenium sensitizer for use in the invention, although varied depending on the activity of employed selenium sensitizer, the type and size of silver halide, the ripening temperature and time, etc., is preferably in the range of $1\times10^{-8}$ or more. More preferably, the amount is $1\times10^{-7}$ mol or more and $5\times10^{-5}$ mol or less per mol of silver halide. The temperature of chemical ripening in the use of a selenium sensitizer is preferably 40° C. or more and 80° C. or less. The pAg and pH are arbitrary. For example, with respect to pH, the effect of the present invention can be exerted even if it widely ranges from 4 to 9.

Selenium sensitization is preferably used in combination with sulfur sensitization or noble metal sensitization or both of them. Further, in the present invention, a thiocyanic acid salt is preferably added in the silver halide emulsion at the chemical sensitization. As the thiocyanate, potassium thiocyanate, sodium thiocyanate, ammonium thiocyanate, and the like are used. It is usually added by being dissolved in an aqueous solution or a water-soluble solvent. The addition amount per mol of silver halide is $1\times10^{-5}$ mol to $1\times10^{-2}$ mol, and more preferably $5\times10^{-5}$ mol to $5\times10^{-3}$ mol.

It is preferred that in the silver halide emulsion of the present invention, an appropriate amount of calcium ion and/or a magnesium ion be contained. Thereby, the graininess is made better, the quality of an image is improved, and the preservability is made better. The range of the appropriate amount is 400 to 2500 ppm for calcium and/or 50 to 2500 ppm for magnesium, and calcium is more preferably 500 to 2000 ppm and magnesium is 200 to 2000 ppm. Herein, 400 to 2500 ppm for calcium and/or 50 to 2500 ppm for magnesium means that at least one of calcium and magnesium is a concentration within the range prescribed. When the content of calcium or magnesium is higher than these values, it is not preferable that inorganic salts which calcium salt, magnesium salt, a gelatin or the like has preliminarily retained precipitate and become the cause of trouble at the manufacture of the photographic material. Herein, the content of calcium or magnesium is represented by weight converted to calcium atom or magnesium atom for all of the compounds containing calcium or magnesium such as a calcium ion, a magnesium ion, a calcium salt, a magnesium salt and the like, and represented by concentration based on the unit weight of the emulsion.

The adjustment of the calcium content in the silver halide tabular emulsion of the invention is preferably carried out adding the calcium salt at the chemical sensitization. The gelatin generally used at manufacturing an emulsion contains already calcium by 100 to 4000 ppm as a solid gelatin, and calcium may be adjusted by adding a calcium salt to the gelatin to be increased. Further, if necessary, after carrying out the desalting (removal of calcium) from the gelatin according to a known method such as a washing method with water or an ion exchange method or the like, the content can be also adjusted by a calcium salt. As the calcium salt, calcium nitrate and calcium chloride are preferable, and calcium nitrate is most preferable. Similarly, the adjustment of the magnesium content can be carried out adding a magnesium salt. As the magnesium salt, magnesium nitrate, magnesium sulfate and magnesium chloride are preferable, and magnesium nitrate is most preferable. As the quantitative determination method of calcium or magnesium, it can be determined by ICP emission spectral analysis method. Calcium and magnesium may be used alone and a mixture of both may be used. It is more preferable to contain calcium. The addition of calcium or magnesium can be carried out at the arbitrary period of the manufacturing steps of the silver halide emulsion, but is preferably from after the grain formation to just after completion of the spectral sensitization and the chemical sensitization, and more preferably after addition of a sensitizing dye. Further, it is preferable in particular to add after addition of a sensitizing dye and before carrying out the chemical sensitization.

Mercaptotetrazole compounds having a water-soluble group as described in the publication of JP-A-4-16838 may be mentioned as especially useful compounds for the purposes of suppressing enhancement of fog during storage, and decreasing fog of a silver halide emulsion. In the publication of JP-A-4-16838, it is also described that combined use of mercaptotetrazole compounds and mercaptothiadiazole compounds enhances preservability.

The emulsion grain use in the invention can be sensitized on the surface thereof or at arbitral position from the surface thereof. However, it is preferable for the emulsion grain to be sensitized on the surface thereof. A reference can be made of a method described in JP-A-63-264740 in the case of internal sensitization.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt; nitroimidazoles; nitrobenzimidazoles; chlorobenzimidazoles; bromobenzimidazoles; mercaptothiazoles; mercaptobenzothiazoles; mercaptobenzimidazoles; mercaptothiadiazoles; aminotriazoles; benzotriazoles; nitrobenzotriazoles; and mercaptotetrazoles (particularly 1-phenyl-5-mercaptotetrazole); mercaptopyrimidines; mercaptotriazines; a thioketo compound such as oxazolinethione; azaindenes such as triazaindenes, tetrazaindenes (particularly 4-hydroxy-substituted(1,3,3a,7)tetrazaindenes), and pentazaindenes. For example, compounds described in the specifications of U.S. Pat. Nos. 3,954,474 and 3,982,947 and the publication of JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

The photographic emulsion of the present invention is preferably subjected to a spectral sensitization with a methine dye or the like to thereby exert the effects of the invention. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, GB's 1,344,281 and 1,507,803, JP-B's-43-4936 and 53-12375, and JP-A's-52-110618 and 52-109925.

The emulsion used in the present invention may contain a dye which itself exerts no spectral sensitizing effect or a substance which absorbs substantially none of visible radiation and exhibits supersensitization, together with the above spectral sensitizing dye.

The addition timing of the spectral sensitizing dye to the emulsion may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

The addition thereof may be set from $4\times10^{-6}$ to $8\times10^{-3}$ mol per mol of silver halide.

The silver halide grain other than the tabular grain used in the lightsensitive material of the invention will be described below.

The preferable silver halide contained in the photographic emulsion layer of the photographic material of the invention is silver iodobromide, silver iodochloride or silver iodochlorobromide containing about 30 mol % or less of silver iodide. Silver iodobromide or silver iodochlorobromide containing about 1 mol % to about 10 mol % of silver iodide is preferable in particular.

The silver halide grains in the photographic emulsion may be those having a regular crystal such as cubic, octahedral and tetradecahedral; those having a regular crystal shape such as sphere and tabular; those having a crystal defect such as twin plane or the like, or a complex shape thereof.

The grain may be a fine grain having a grain seize of about 0.2 μm or less, and may be a large size grain having a projected area diameter up to about 10 μm. The emulsion containing the grains may be a polydisperse emulsion or a monodisperse emulsion.

The silver halide photographic emulsion which can be used in the invention can be prepared by, for example, "Research Disclosure (RD) No. 17643 (December in 1978), page 22 to 23", "I. Emulsion Preparation and types", "ibid., No. 18716 (November in 1979), page 648", "ibid., No. 307105 (November in 1989), page 863 to 865", "Chemie et Phisique Photographique" authored by P. Glafkides and published by Paul Montel Co., Ltd. (1967), "Photographic Emulsion Chemistry" authored by G. F. Duffin and published by Forcal Press Co., Ltd. (1966), and "Making and Coating Photographic Emulsion" authored by V. L. Zelikman et al and published by Forcal Press Co., Ltd.

Monodisperse emulsions described in U.S. Pat. Nos. 3,574,628 and 3,655,394, and GB 1,413,748 are preferable.

The crystal structure may be a uniform one, a structure consisting of a halogen composition in which inner part is different from outer part, and a laminar structure. Further, silver halide having a different composition may be joined by epitaxial junction, and may be joined with a compound such as silver rhodanide, lead oxide or the like other than silver halide. Further, a mixture of grains having various crystal shapes may be used.

The above-mentioned emulsion may be any one of a surface latent image type in which a latent image is mainly formed on a surface, an internal latent image type in which a latent image is formed in the inside of grains, and a type having latent images both on a surface and in the inside, but requires a negative emulsion. Among the internal latent image types, it may be a core/shell type internal latent image type emulsion described in JP-A-63-264740. The preparation method of the core/shell internal latent image type emulsion is described in JP-A-59-133542. The thickness of the shell of the emulsion differs according to development treatment and the like, but is preferably 3 to 40 nm and preferably 5 to 20 nm in particular.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in lightsensitive silver halide emulsion layers and/or essentially non-lightsensitive hydrophilic colloid layers. The internally fogged or surface-fogged silver halide grains means a silver halide grain which can be developed uniformly (non-imagewise) regardless of whether the location is a non-exposed or an exposed portion of the photosensitive material. A method of preparing the internally fogged or surface-fogged silver halide grain is described in U.S. Pat. No. 4,626,498 and JP-A-59-214852.

A silver halide which forms the core of an internally fogged core/shell type silver halide grain can have the same halogen composition or a different halogen composition. As the silver halide composition of the internally fogged or surface-fogged silver halide grains, any of silver chloride, silver chlorobromide, silver iodobromide and silver chloroiodobromide can be used. Although the grain size of these fogged silver halide grains is not particularly limited, the equivalent-sphere diameter thereof is 0.01 to 0.75 μm, and especially preferably 0.05 to 0.6 μm. Further, the grain shape is not specifically limited, and can be a regular grain and a polydisperse emulsion. However, it is preferably a monodisperse, i.e., at least 95% in weight or number of silver halide grains thereof have grain sizes falling within the range of ±40% of the average equivalent-sphere diameter).

In the lightsensitive material of the invention, two or more of emulsions having at least one of different properties of the grain size, grain size distribution, halogen composition, grain shape and sensitivity of the lightsensitive silver halide emulsion can be used in the same layer by mixing.

In the preparation method of the photographic material of the invention, photographically useful substances are usually added to a photographic coating solution, i.e., a hydrophilic colloidal solution.

In silver halide photosensitive material of the invention and the silver halide emulsion used therein, it is generally possible to use various techniques and inorganic and organic materials described in Research Disclosure Nos. 308119 (1989), 37038 (1995), and 40145 (1997).

In addition, techniques and inorganic and organic materials usable in color photosensitive materials of the invention can be applied are described in portions of EP436,938A2 and patents cited below, the disclosures of which are incorporated herein by reference.

| Items | Corresponding portions |
|---|---|
| 1) Layer configurations | page 146, line 34 to page 147, line 25 |
| 2) Silver halide emulsions usable together | page 147, line 26 to page 148 line 12 |
| 3) Yellow couplers usable together | page 137, line 35 to page 146, line 33, and page 149, lines 21 to 23 |
| 4) Magenta couplers usable together | page 149, lines 24 to 28; EP421, 453A1, page 3, line 5 to page 25, line 55 |
| 5) Cyan couplers usable together | page 149, lines 29 to 33; EP432, 804A2, page 3, line 28 to page 40, line 2 |
| 6) Polymer couplers | page 149, lines 34 to 38; EP435, 334A2, page 113, line 39 to page 123, line 37 |
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435, 334A2, page 3, line 1 To page 29, line 50 |
| 9) Antiseptic and mildewproofing agents | page 150, lines 25 to 28 |
| 10) Formalin scavengers | page 149, lines 15 to 17 |
| 11) Other additives usable together | page 153, lines 38 to 47; EP421, 453A1, page 75, line 21 to page 84, line 56, and page 27, line 40 to page 37, line 40 |
| 12) Dispersion methods | page 150, lines 4 to 24 |
| 13) Supports | page 150, lines 32 to 34 |
| 14) Film thickness·film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing·stabilizing step | page 153, lines 3 to 37 |

The photographic material of the invention is usually processed with an alkali developing solution containing a developing agent after it is subjected to an image wise exposure. After this color development, the color photographic material is subjected to an image-forming method in which it is processed with a processing solution containing a bleaching agent thereby having a bleaching ability.

EXAMPLE 1

The invention will be specifically described with reference to examples, but the invention is not limited to these.

(Preparation of Sample 101)

(1) Preparation of Triacetylcellulose Film

Triacetylcellulose was dissolved (13% by weight) by a common solution casting process in dichloromethane/methanol=92/8 (weight ratio), and triphenyl phosphate and biphenyldiphenyl phosphate in a weight ratio of 2:1, which are plasticizers, were added to the resultant solution so that the total amount of the plasticizers was 14% to the triacetylcellulose. Then, a triacetylcellulose film was made by a band process. The thickness of the support after drying was 97 μm.

(2) Components of Undercoat Layer

The two surfaces of the triacetylcellulose film were subjected to undercoating treatment. Numbers represent weight contained per liter of an undercoat solution.

The two surfaces of the triacetylcellulose film were subjected to corona discharge treatment before undercoating treatment.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

(3) Coating of Back Layers

One surface of the undercoated support was coated with the following back layers.

1st Layer

| | |
|---|---|
| 1st layer | |
| Binder: acid-processed gelatin (isoelectric point: 9.0) | 1.00 g |
| Polymeric latex: P-2 (average grain size: 0.1 μm) | 0.13 g |
| Polymeric latex: P-4 (average grain size 0.2 μm) | 0.23 g |
| Ultraviolet absorbent U-1 | 0.030 g |
| Ultraviolet absorbent U-2 | 0.010 g |
| Ultraviolet absorbent U-3 | 0.010 g |
| Ultraviolet absorbent U-4 | 0.020 g |
| High-boiling organic solvent Oil-2 | 0.030 g |
| Surfactant W-2 | 0.010 g |
| Surfactant W-4 | 3.0 mg |
| 2nd layer | |
| Binder: acid-processed gelatin (isoelectric point: 9.0) | 3.10 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-2 | 0.010 g |
| Surfactant W-4 | 3.0 mg |

-continued

| | |
|---|---|
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer | |
| Binder: acid-processed gelatin (isoelectric point: 9.0) | 3.30 g |
| Surfactant W-2 | 0.020 g |
| Potassium sulfate | 0.30 g |
| Sodium hydroxide | 0.03 g |
| 4th layer | |
| Binder: lime-processed gelatin (isoelectric point: 5.4) | 1.15 g |
| 1:9 copolymer of methacrylic acid and methylmethacrylate (average grain size: 2.0 μm) | 0.040 g |
| 6:4 copolymer of methacrylic acid and methylmethacrylate (average grain size: 2.0 μm) | 0.030 g |
| Surfactant W-2 | 0.060 g |
| Surfactant W-1 | 7.0 mg |
| Hardener H-1 | 0.23 g |

(4) Coating of Photosensitive Emulsion Layers

Sample 101 was prepared by coating photosensitive emulsion layers presented below on the side opposite, against the support, to the side having the back layers. Numbers represent addition amounts per $m^2$ of the coating surface. Note that the effects of added compounds are not restricted to the described purposes.

The gelatin shown below were those having molecular weight (weight-average molecular weight) of 100,000 to 200,000. Contents of major metal ions of calcium, iron and sodium were 2500 to 3000 ppm, 1 to 7 ppm and 1500 to 3000 ppm, respectively.

Gelatin having calcium content of 1000 ppm or less was also used.

The organic compounds to be contained in respective layers were prepared as emulsified dispersions containing gelatin (W-2, W-3 or W-4 was used as a surfactant), and respective light-sensitive emulsions and yellow colloidal silver were also prepared as gelatin dispersions. Coating liquids were prepared by mixing these so that the described addition amounts can be attained, and were subjected to coating. Cpd-H, -O, -P and -Q, Dyes D-1, -2, -3, -5, -6, -8, -9 and -10, H-1, P-3, F-1 to F-9 were dissolved to water or a suitable water miscible organic solvent such as methanol, dimethylformamide, ethanol and dimethylacetamide, and added to the coating liquids for respective layers.

The thus prepared gelatin concentrations (weight of solid gelatin/volume of coating liquid) were in the range of 2.5% to 15%, the pH's of the respective coating liquids were in the range of 5.0 to 8.5, pAg's in the coating liquids containing silver halide emulsions at a temperature of 40° C. and pH of 6.0 were in the range of 7.0 to 9.5.

After the coating, the photosensitive material were dried by a drying procedure of multiple steps maintaining the temperature at 10° C. to 45° C. to obtain the sample.

| | |
|---|---|
| 1st layer: Antihalation layer | |
| Black colloidal silver | 0.20 g |
| Gelatin | 2.20 g |
| Compound Cpd-B | 0.010 g |
| Ultraviolet absorbent U-1 | 0.050 g |

-continued

| | | |
|---|---|---|
| Ultraviolet absorbent U-3 | | 0.020 g |
| Ultraviolet absorbent U-4 | | 0.020 g |
| Ultraviolet absorbent U-5 | | 0.010 g |
| Ultraviolet absorbing agent U-2 | | 0.070 g |
| Compound Cpd-F | | 0.20 g |
| High-boiling organic solvent Oil-2 | | 0.020 g |
| High-boiling organic solvent Oil-6 | | 0.020 g |
| Dye D-4 | | 1.0 mg |
| Dye D-8 | | 1.0 mg |
| Fine crystal solid dispersion of dye E-1 | | 0.05 g |
| 2nd layer: Interlayer | | |
| Gelatin | | 0.4 g |
| Compound Cpd-F | | 0.050 g |
| Compound Cpd-R | | 0.020 g |
| Compound Cpd-S | | 0.020 g |
| High-boiling organic solvent Oil-6 | | 0.010 g |
| High-boiling organic solvent Oil-7 | | 5.0 mg |
| High-boiling organic solvent Oil-8 | | 0.020 g |
| Dye D-11 | | 2.0 mg |
| Dye D-7 | | 4.0 mg |
| 3rd layer: Interlayer | | |
| Gelatin | | 0.60 g |
| 4th layer: Low-speed red-sensitive emulsion layer | | |
| Emulsion A1 | silver | 0.15 g |
| Emulsion B1 | silver | 0.10 g |
| Emulsion C1 | silver | 0.15 g |
| Yellow colloidal silver | silver | 1.0 mg |
| Gelatin | | 0.60 g |
| Coupler C-1 | | 0.15 g |
| Coupler C-2 | | 7.0 mg |
| Ultraviolet absorbent U-2 | | 3.0 mg |
| Compound Cpd-J | | 2.0 mg |
| High-boiling organic solvent Oil-5 | | 0.050 g |
| High-boiling organic solvent Oil-10 | | 0.020 g |
| 5th layer: Medium-speed red-sensitive emulsion layer | | |
| Emulsion C1 | silver | 0.20 g |
| Emulsion D1 | silver | 0.15 g |
| Internally fogged silver bromide emulsion (cubic, equivalent sphere average grain size: 0.11 μm) | Silver | 0.010 g |
| Gelatin | | 0.60 g |
| Coupler C-1 | | 0.15 g |
| Coupler C-2 | | 7.0 mg |
| High-boiling organic solvent Oil-5 | | 0.050 g |
| High-boiling organic solvent Oil-10 | | 0.020 g |
| Compound Cpd-T | | 2.0 mg |
| 6th layer: High-speed red-sensitive emulsion layer | | |
| Emulsion E1 | silver | 0.15 g |
| Emulsion F1 | silver | 0.20 g |
| Gelatin | | 1.50 g |
| Coupler C-1 | | 0.70 g |
| Coupler C-2 | | 0.025 g |
| Coupler C-3 | | 0.020 g |
| Coupler C-8 | | 3.0 mg |
| Ultraviolet absorbent U-1 | | 0.010 g |
| High-boiling organic solvent Oil-5 | | 0.25 g |
| High-boiling organic solvent Oil-9 | | 0.05 g |
| High-boiling organic solvent Oil-10 | | 0.10 g |
| Compound Cpd-D | | 3.0 mg |
| Compound Cpd-L | | 1.0 mg |
| Compound Cpd-T | | 0.050 g |
| Additive P-1 | | 0.010 g |
| Additive P-3 | | 0.010 g |
| Dye D-8 | | 1.0 mg |
| 7th layer: Interlayer | | |
| Gelatin | | 0.50 g |
| Additive P-2 | | 0.030 g |
| Dye D-5 | | 0.010 g |
| Dye D-9 | | 6.0 mg |
| Compound Cpd-I | | 0.020 g |
| Compound Cpd-O | | 3.0 mg |
| Compound Cpd-P | | 5.0 mg |

-continued

| | | |
|---|---|---|
| 8th layer: Interlayer | | |
| Yellow colloidal silver | silver | 3.0 mg |
| Gelatin | | 1.00 g |
| Additive P-2 | | 0.010 g |
| Compound Cpd-A | | 0.030 g |
| Compound Cpd-M | | 0.10 g |
| Compound Cpd-O | | 2.0 mg |
| Ultraviolet absorbing agent U-1 | | 0.010 g |
| Ultraviolet absorbing agent U-2 | | 0.010 g |
| Ultraviolet absorbing agent U-5 | | 5.0 mg |
| High-boiling organic solvent Oil-3 | | 0.010 g |
| High-boiling organic solvent Oil-6 | | 0.10 g |
| 9th layer: Low-speed green-sensitive emulsion layer | | |
| Emulsion G | silver | 0.15 g |
| Emulsion H | silver | 0.15 g |
| Emulsion I | silver | 0.15 g |
| Gelatin | | 1.00 g |
| Coupler C-4 | | 0.060 g |
| Coupler C-5 | | 0.10 g |
| Compound Cpd-B | | 0.020 g |
| Compound Cpd-G | | 2.5 mg |
| Compound Cpd-K | | 1.0 mg |
| High-boiling organic solvent Oil-2 | | 0.010 g |
| High-boiling organic solvent Oil-5 | | 0.020 g |
| 10th layer: Medium-speed green-sensitive emulsion layer | | |
| Emulsion I | silver | 0.10 g |
| Emulsion J | silver | 0.20 g |
| Gelatin | | 0.50 g |
| Coupler C-4 | | 0.10 g |
| Coupler C-5 | | 0.050 g |
| Coupler C-6 | | 0.010 g |
| Compound Cpd-B | | 0.020 g |
| Compound Cpd-U | | 8.0 mg |
| High-boiling organic solvent Oil-2 | | 0.010 g |
| High-boiling organic solvent Oil-5 | | 0.020 g |
| Additive P-1 | | 0.010 g |
| 11th layer: High-speed green-sensitive emulsion layer | | |
| Emulsion J | silver | 0.15 g |
| Emulsion K | silver | 0.25 g |
| Internally fogged silver bromide emulsion (cubic, equivalent sphere average grain size: 0.11 μm) | silver | 5.0 mg |
| Gelatin | | 1.20 g |
| Coupler C-4 | | 0.50 g |
| Coupler C-5 | | 0.20 g |
| Coupler C-7 | | 0.10 g |
| Compound Cpd-B | | 0.030 g |
| Compound Cpd-U | | 0.020 g |
| High-boiling organic solvent Oil-5 | | 0.15 g |
| Additive P-1 | | 0.030 g |
| 12th layer: Yellow filter layer | | |
| Yellow colloidal silver | silver | 2.0 mg |
| Gelatin | | 1.0 g |
| Compound Cpd-C | | 0.010 g |
| Compound Cpd-M | | 0.020 g |
| High-boiling organic solvent Oil-1 | | 0.020 g |
| High-boiling organic solvent Oil-6 | | 0.020 g |
| Fine crystal solid dispersion of dye E-2 | | 0.25 g |
| 13th layer: Low-speed blue-sensitive emulsion layer | | |
| Emulsion L | silver | 0.10 g |
| Emulsion M | silver | 0.10 g |
| Emulsion N | silver | 0.10 g |
| Surface and internally fogged silver bromide emulsion (cubic, equivalent sphere average grain size: 0.11 μm) | silver | 0.010 g |
| Gelatin | | 0.80 g |
| Coupler C-8 | | 0.020 g |
| Coupler C-9 | | 0.020 g |
| Coupler C-10 | | 0.20 g |
| Compound Cpd-B | | 0.010 g |
| Compound Cpd-I | | 8.0 mg |
| Compound Cpd-K | | 2.0 mg |

-continued

| | | |
|---|---|---|
| Ultraviolet absorbent U-5 | | 0.010 g |
| Additive P-1 | | 0.020 g |
| 14th layer: Medium-speed blue-sensitive emulsion layer | | |
| Emulsion N | silver | 0.20 g |
| Emulsion O | silver | 0.20 g |
| Gelatin | | 0.80 g |
| Coupler C-8 | | 0.030 g |
| Coupler C-9 | | 0.030 g |
| Coupler C-10 | | 0.30 g |
| Compound Cpd-B | | 0.015 g |
| Compound Cpd-E | | 0.020 g |
| Compound Cpd-N | | 2.0 mg |
| Compound Cpd-T | | 0.010 g |
| Ultraviolet absorbing agent U-5 | | 0.015 g |
| Additive P-1 | | 0.030 g |
| 15th layer: High-speed blue-sensitive emulsion layer | | |
| Emulsion P | silver | 0.20 g |
| Emulsion Q | silver | 0.15 g |
| Gelatin | | 2.00 g |
| Coupler C-8 | | 0.10 g |
| Coupler C-9 | | 0.15 g |
| Coupler C-10 | | 1.10 g |
| Coupler C-3 | | 0.010 g |
| High-boiling organic solvent Oil-5 | | 0.020 g |
| Compound Cpd-B | | 0.060 g |
| Compound Cpd-D | | 3.0 mg |
| Compound Cpd-E | | 0.020 g |
| Compound Cpd-F | | 0.020 g |
| Compound Cpd-N | | 5.0 mg |
| Compound Cpd-T | | 0.070 g |
| Ultraviolet absorbent U-5 | | 0.060 g |
| Additive U-5 | | 0.10 g |
| 16th layer: 1st protective layer | | |
| Gelatin | | 0.70 g |
| Ultraviolet absorbent U-1 | | 0.020 g |
| Ultraviolet absorbent U-5 | | 0.030 g |
| Ultraviolet absorbent U-2 | | 0.10 g |
| Compound Cpd-B | | 0.030 g |

-continued

| | | |
|---|---|---|
| Compound Cpd-O | | 5.0 mg |
| Compound Cpd-A | | 0.030 g |
| Compound Cpd-H | | 0.20 g |
| Dye D-1 | | 2.0 mg |
| Dye D-2 | | 3.0 mg |
| Dye D-3 | | 2.0 mg |
| High-boiling organic solvent Oil-2 | | 0.020 g |
| High-boiling organic solvent Oil-3 | | 0.030 g |
| 17th layer: 2nd protective layer | | |
| Fine grain silver iodobromide emulsion (silver iodide content: 1 mol %, equivalent circle average grain diameter 0.06 μm) | silver | 0.10 g |
| Gelatin | | 0.80 g |
| Ultraviolet absorbent U-2 | | 0.030 g |
| Ultraviolet absorbent U-5 | | 0.030 g |
| High-boiling organic solvent Oil-2 | | 0.010 g |
| 18th layer: 3rd protective layer | | |
| Gelatin | | 1.00 g |
| Polymethylmethacrylate (average grain size 1.5 μm) | | 0.10 g |
| 6:4 copolymer of methylmethacrylate and methacrylic acid (average grain size 1.5 μm) | | 0.15 g |
| Silicone oil SO-1 | | 0.20 g |
| Surfactant W-1 | | 0.010 g |
| Surfactant W-2 | | 0.040 g |

In addition to the above compositions, additives F-1 to F-9 were added to all emulsion layers. Also, a gelatin hardener H-1 and surfactants W-2, W-3 and W-4 for coating and emulsification were added to each layer.

Furthermore, phenol, 1,2-benzisothiazoline-3-one, 2-phenoxyethanol, phenethyl alcohol, and p-benzoic butyl ester were added as antiseptic and mildewproofing agents.

The Sample 101 prepared as mentioned above had a coated layer thickness at the dried state of 24.0 μm and the swelling rate when swelled with purified water at a temperature of 25° C. of 1.78 times.

TABLE 1

Structure of silver halide emulsion

| | Silver iodobromide emulsion used in Sample 101 | | | | | | | | | | |
|---|---|---|---|---|---|---|---|---|---|---|---|
| | | | | | | | Other characteristics | | | | |
| Emulsion | Characteristics | Av. ESD (μm) | COV (%) | Av. AgI content (mol %) | Structure in halide composition of silver halide | Average AgI content at grain surface | (1) | (2) | (3) | (4) | (5) |
| A1 | Monodisperse tetradecahedral grains | 0.18 | 10 | 3.5 | Triple structure | 2.5 | ○ | ○ | | ○ | |
| B1 | Monodisperse (111) tabular grains Av. aspect ratio 3.0 | 0.20 | 10 | 2.5 | Quadruple structure | 2.5 | | | ○ | | ○ |
| C1 | Monodisperse (111) tabular grains Av. aspect ratio 4.5 | 0.32 | 11 | 1.8 | Triple structure | 0.1 | | ○ | | ○ | ○ |
| D1 | Monodisperse (111) tabular grains Av. aspect ratio 6.0 | 0.32 | 21 | 4.8 | Triple structure | 2.0 | | ○ | | ○ | ○ |
| E1 | Monodisperse (111) tabular grains Av. aspect ratio 6.0 | 0.48 | 12 | 2.0 | Quadruple structure | 1.3 | | ○ | | | |
| F1 | Monodisperse (111) tabular grains Av. aspect ratio 8.0 | 0.65 | 12 | 1.6 | Triple structure | 0.6 | | ○ | ○ | | ○ |
| G | Monodisperse cubic grains | 0.14 | 9 | 3.5 | Quadruple structure | 0.3 | ○ | | ○ | ○ | |

TABLE 1-continued

| | Structure of silver halide emulsion | | | | | | | | | | |
|---|---|---|---|---|---|---|---|---|---|---|---|
| | Silver iodobromide emulsion used in Sample 101 | | | | | | | | | | |
| Emulsion | Characteristics | Av. ESD (μm) | COV (%) | Av. AgI content (mol %) | Structure in halide composition of silver halide | Average AgI content at grain surface | Other characteristics (1) | (2) | (3) | (4) | (5) |
| H | Monodisperse cubic grains | 0.22 | 12 | 1.9 | Quadruple structure | 0.7 | | ○ | | | ○ |
| I | Monodisperse (111) tabular grains Av. aspect ratio 4.0 | 0.35 | 12 | 3.5 | Quintuple structure | 1.5 | ○ | ○ | | ○ | ○ |
| J | Monodisperse (111) tabular grains Av. aspect ratio 7.0 | 0.40 | 21 | 2.0 | Quadruple structure | 2.2 | | ○ | | ○ | ○ |
| K | Monodisperse (111) tabular grains Av. aspect ratio 8.5 | 0.65 | 13 | 1.7 | Triple structure | 1.3 | ○ | ○ | ○ | | ○ |
| L | Monodisperse tetradecahedral grains | 0.30 | 9 | 7.5 | Triple structure | 0.8 | | | ○ | | ○ |
| M | Monodisperse tetradecahedral grains | 0.30 | 9 | 7.5 | Triple structure | 2.5 | | ○ | | ○ | |
| N | Monodisperse (111) tabular grains Av. aspect ratio 3.0 | 0.35 | 13 | 2.1 | Quintuple structure | 4.0 | ○ | ○ | ○ | | |
| O | Monodisperse (111) tabular grains Av. aspect ratio 5.0 | 0.45 | 9 | 2.5 | Quadruple structure | 1.0 | | ○ | ○ | ○ | ○ |
| P | Monodisperse (111) tabular grains Av. aspect ratio 9.0 | 0.70 | 21 | 2.8 | Triple structure | 0.5 | ○ | ○ | | | ○ |
| Q | Monodisperse (111) tabular grains Av. aspect ratio 9.0 | 0.85 | 8 | 1.0 | Quadruple structure | 0.5 | ○ | ○ | | | ○ |
| R | Monodisperse (111) tabular grains Av. aspect ratio 5.0 | 0.40 | 15 | 8.0 | Quadruple structure | 4.0 | ○ | ○ | | | ○ |
| S | Monodisperse (111) tabular grains Av. aspect ratio 4.0 | 0.70 | 13 | 12.5 | Quadruple structure | 3.0 | | ○ | ○ | | ○ |
| T | Monodisperse (111) tabular grains Av. aspect ratio 4.0 | 0.45 | 13 | 10.5 | Quadruple structure | 2.8 | ○ | ○ | | | ○ |
| U | Monodisperse (111) tabular grains Av. aspect ratio 4.0 | 0.55 | 15 | 12.5 | Triple structure | 1.5 | | ○ | ○ | | ○ |

Av. ESD = Equivalent-sphere average grain size; COV = Coefficient of variation (Other characteristics)

The mark "○" means each of the conditions set forth below is satisfied.

(1) A reduction sensitizer was added during grain formation.

(2) A selenium sensitizer was used as an after-ripening agent.

(3) A rhodium salt was added during grain formation.

(4) A shell was provided subsequent to after-ripening by using silver nitrate in an amount of 10%, in terms of silver molar ratio, of the emulsion grains at that time, together with the equimolar amount of potassium bromide.

(5) The presence of dislocation lines in an average number of ten or more per grain was observed by a transmission electron microscope.

Note that all the lightsensitive emulsions were after-ripped by the use of sodium thiosulfate, potassium thiocyanate, and sodium aurichloride. Note, also, a iridium salt was added during grain formation.

Note, also, that chemically-modified gelatin whose amino groups were partially converted to phthalic acid amide, was added to emulsions B1, C1, E1, H, J, N, Q, R, S and T.

C-1
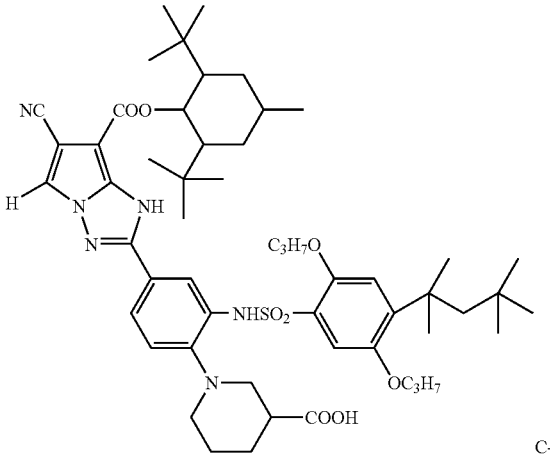
C-2
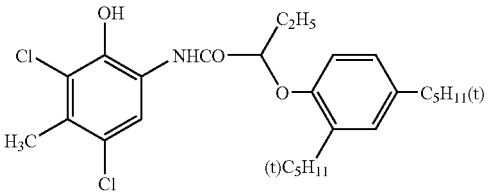
C-3
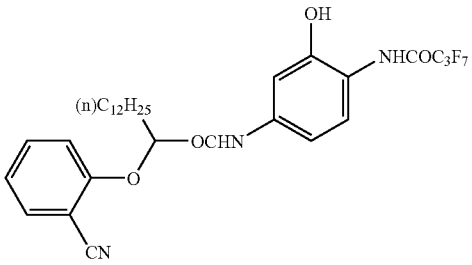
C-4
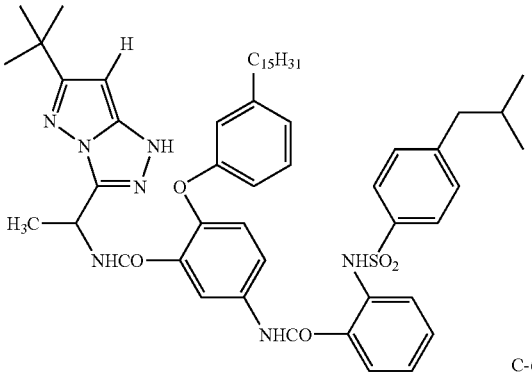
C-5
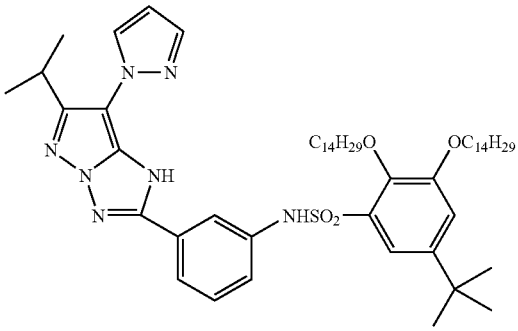
C-6
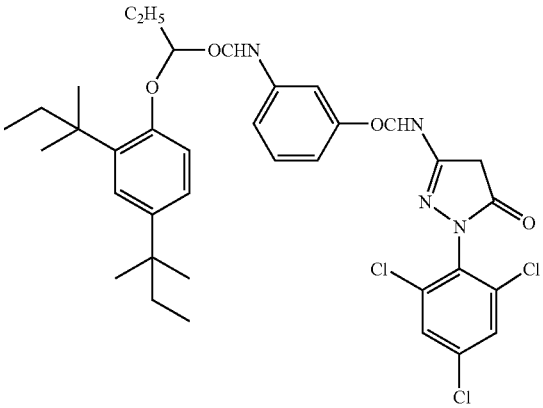
C-7
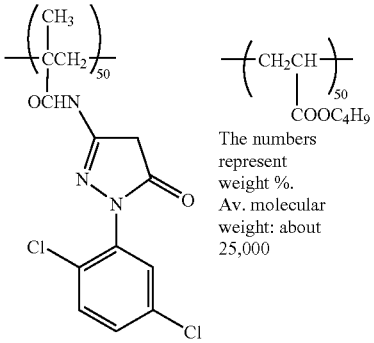
The numbers represent weight %. Av. molecular weight: about 25,000
C-8
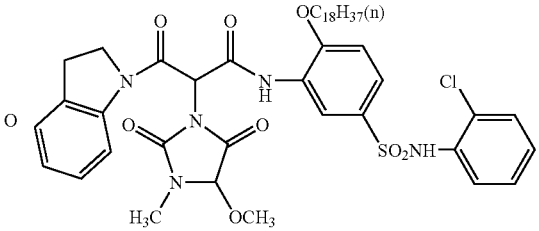

-continued
C-9
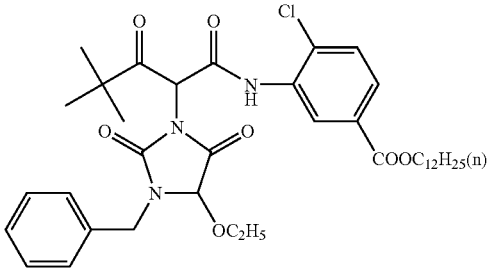
C-10
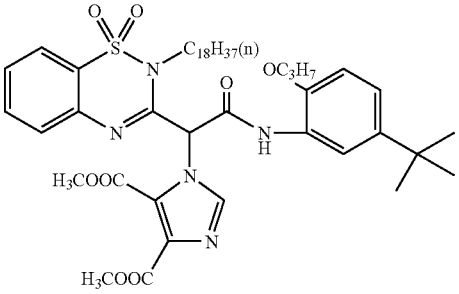
Oil-1
Tri (n-hexyl) phosphate
Oil-2
Tricresyl phosphate
Oil-3
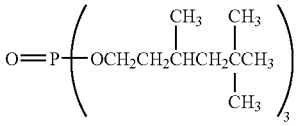
Oil-4
Tricyclohexyl phosphate
Oil-5
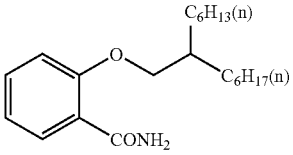
Oil-6
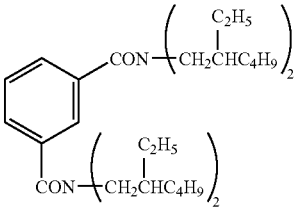
Oil-7
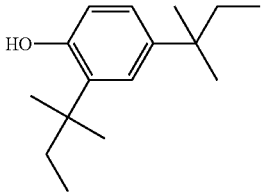
Oil-8
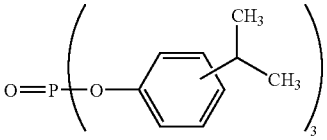
(A mixture of isomers)
Oil-9
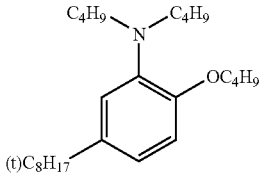
Oil-10
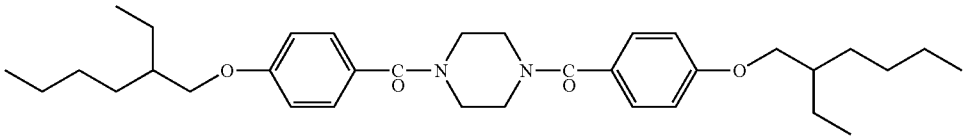
Cpd-A
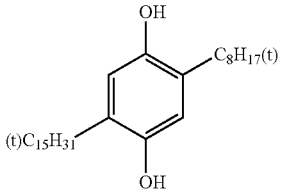
Cpd-B
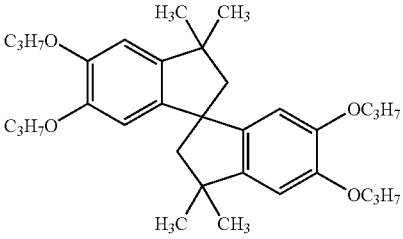

-continued
Cpd-C
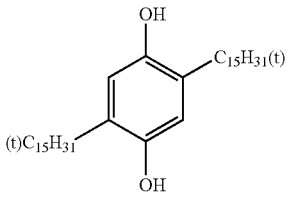
Cpd-D
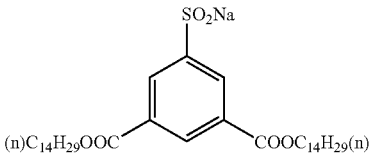
Cpd-E
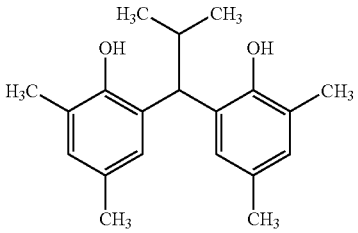
Cpd-F
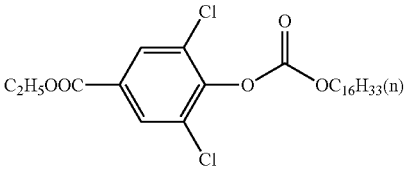
Cpd-G
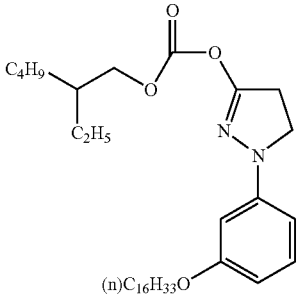
Cpd-H
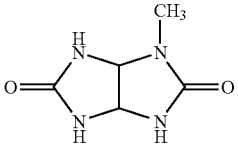
Cpd-I
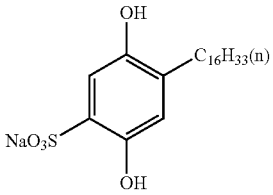
Cpd-J
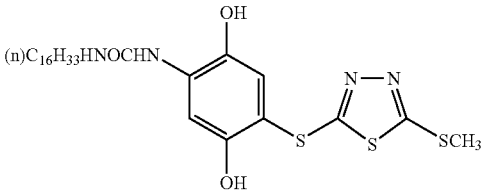
Cpd-K
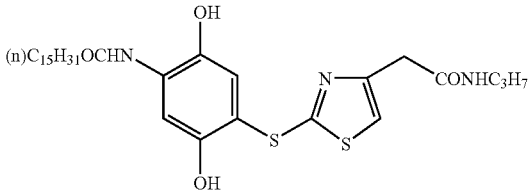
Cpd-L
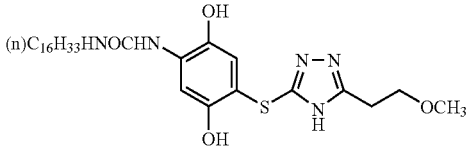
Cpd-M
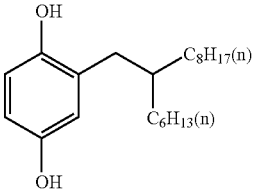
Cpd-N
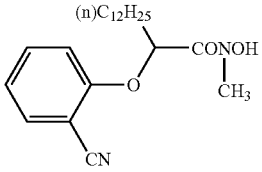
Cpd-O
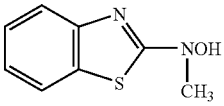

-continued
Cpd-P
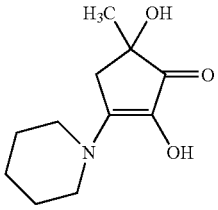
Cpd-Q
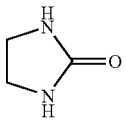
Cpd-R
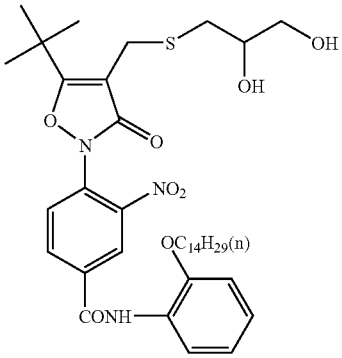
Cpd-S
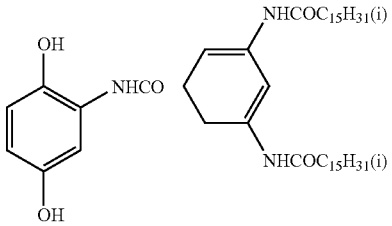
Cpd-T
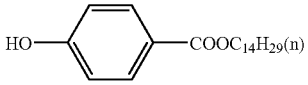
Cpd-U
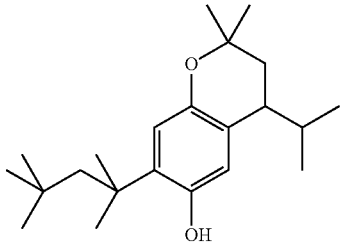
U-1
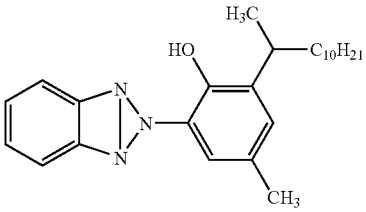
U-2
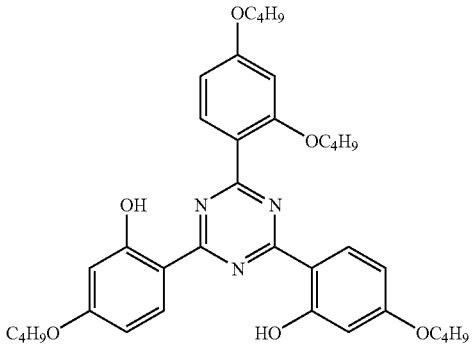
U-3
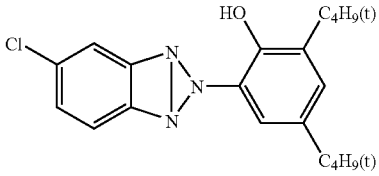
U-4
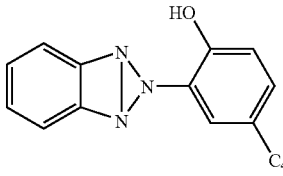
U-5
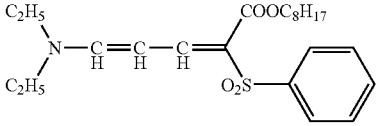
U-6
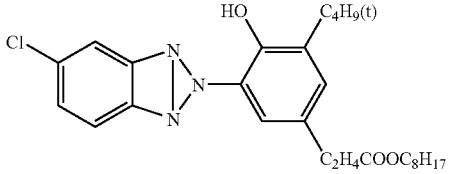

-continued
S-1
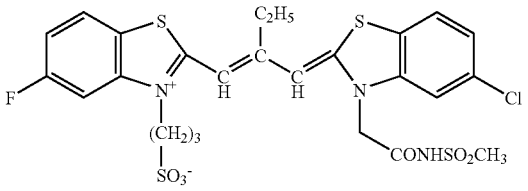
S-2
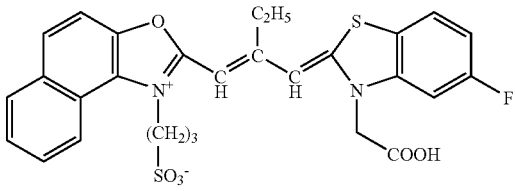
S-3
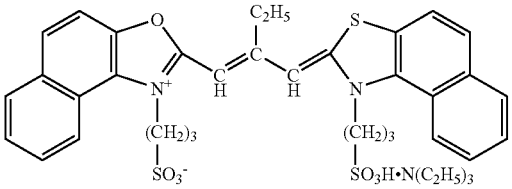
S-4
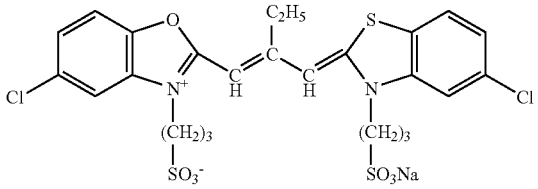
S-5
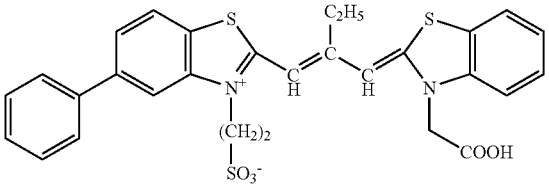
S-6
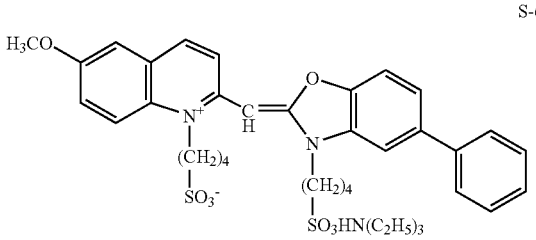
S-7
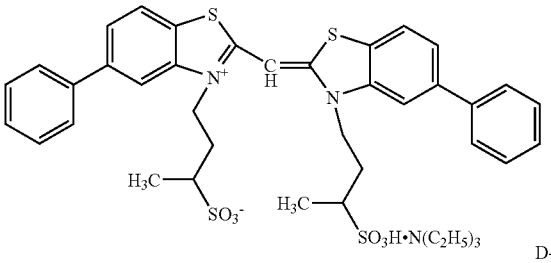
S-8
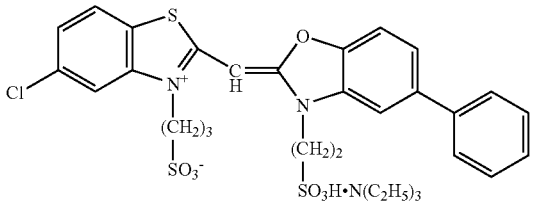
D-1
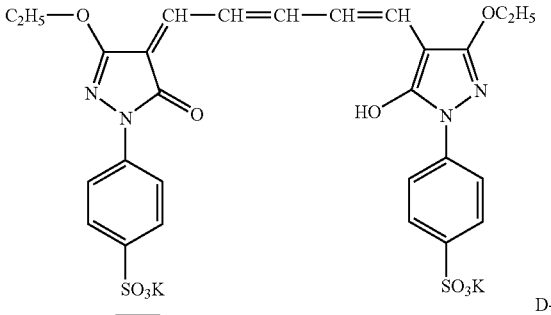
D-2
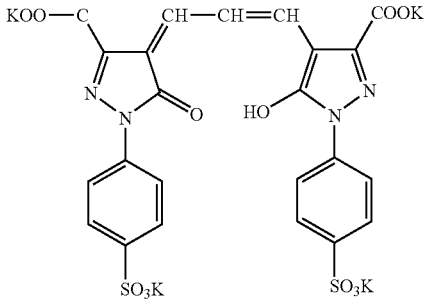
D-3
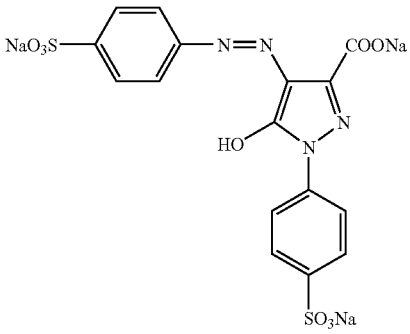
D-4
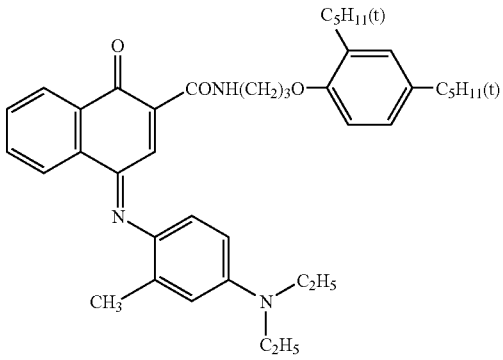

-continued
D-5
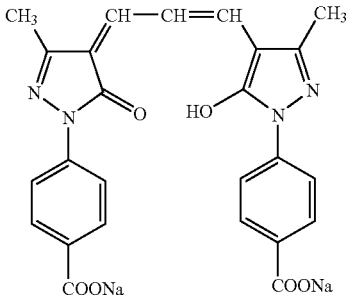
D-6
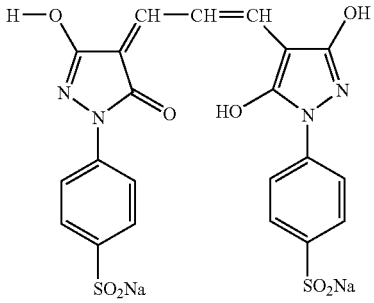
D-7
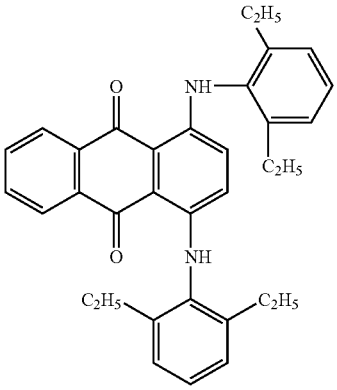
D-8
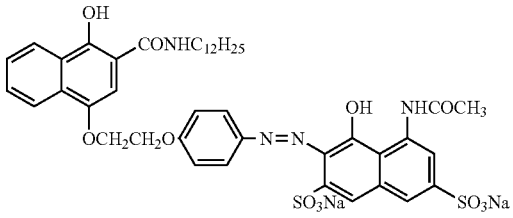
D-9
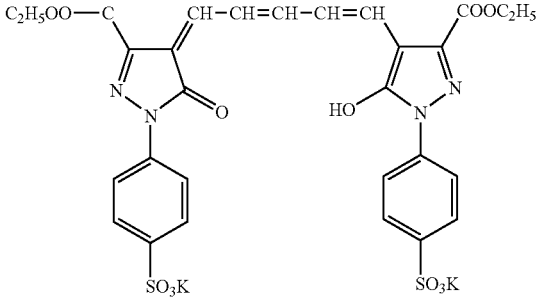
D-10
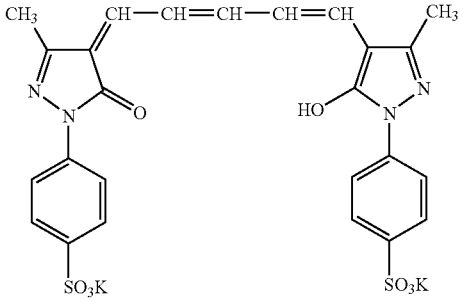
D-11
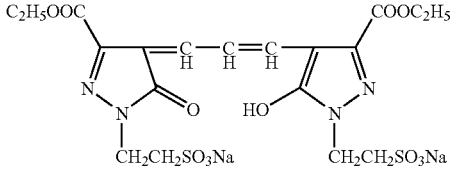
E-1
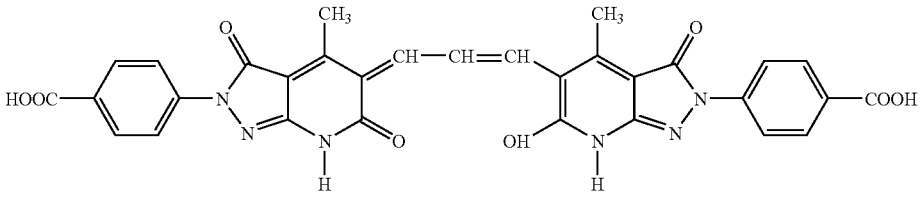

-continued
E-2
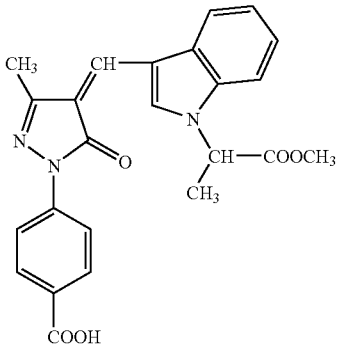
H-1
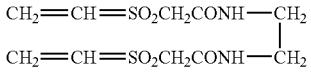
W-1
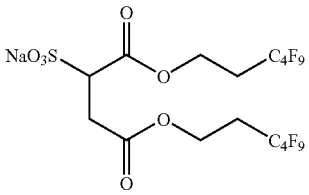
W-2
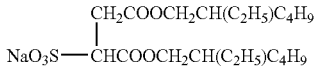
W-3
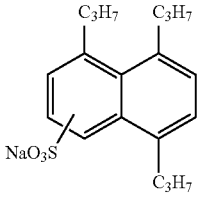
W-4
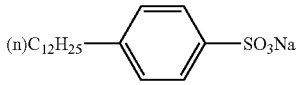
W-5
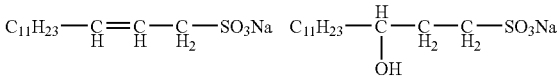
A mixture (60%:40%)
P-1
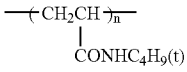
(n = 100–1000)
P-2
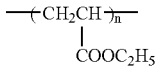
(n = 100–1000)
P-3
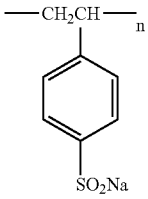
(n = 100–1000)
P-4
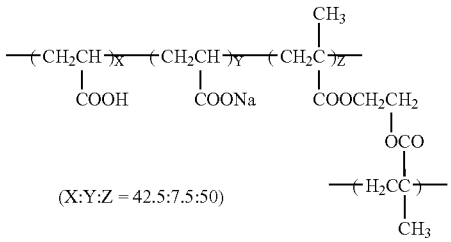
(X:Y:Z = 42.5:7.5:50)
F-1
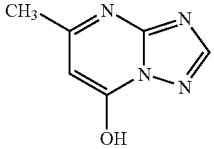
F-2
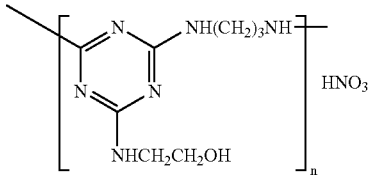
n = 3–4

-continued

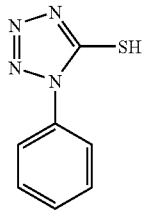

F-3

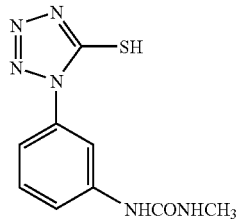

F-4

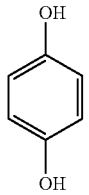

F-5

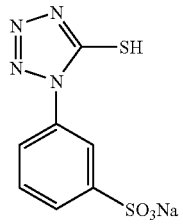

F-6

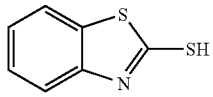

F-7

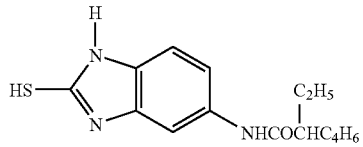

F-8

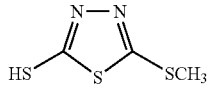

F-9

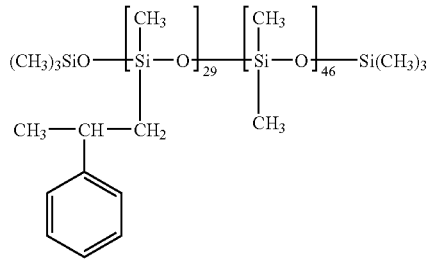

SO-1

Preparation of Dispersion of Organic Solid Dispersed Dye (Preparation of Fine Crystal Dispersion of Dye E-1)

W-5 in an amount of 15 g was added to a wet cake of dye E-1 (net weight of E-1 was 270 g) and water to make 4000 g. Next, ULTRA VISCO MILL (UVM-2) manufactured by Imex K.K. was filled with 1,700 mL of zirconia beads having an average grain size of 0.5 mm. The slurry was milled by passing through the mill for 2 hr at a peripheral speed of about 10 m/sec and a discharge amount of 0.5 L/min. The beads were removed by filtration, and water was added to dilute the mixture to the dye concentration of 3%. After that, the mixture was heated for 10 hr at 90° C. for stabilization. The obtained dye fine grains had an average grain size of 0.25 μm with the width of grain size distribution (standard deviation of grain size×100/average grain size) of 20%.

(Preparation of Fine Crystalline Solid Dispersion of Dye E-2)

Water and 270 g of W-3 were added to 1,400 g of a wet cake of E-2 containing 30 weight % of water, and the resultant material was stirred to form a slurry having an E-2 concentration of 40 weight %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr, followed by diluted with ion-exchanged water to 20 wt. %, thereby obtaining a fine-grain solid dispersion of E-2. The average grain size was 0.15 μm.

The development processing steps shown below was designated as (Development processing A).

Running processing using Sample 101 before exposure to light and the same sample after full exposure to light in a ratio of 1:1 was conducted until the replenishing amount of each solution was four times the tank volume, to evaluate the sample.

| Processing Step | Time | Temperature | Tank volume | Replenishment rate |
|---|---|---|---|---|
| 1st development | 6 min | 38° C. | 12 L | 2,200 mL/m$^2$ |
| 1st washing | 2 min | 38° C. | 4 L | 7,500 mL/m$^2$ |
| Reversal | 2 min | 38° C. | 4 L | 1,100 mL/m$^2$ |
| Color development | 6 min | 38° C. | 12 L | 2,200 mL/m$^2$ |
| Pre-bleaching | 2 min | 38° C. | 4 L | 1,100 mL/m$^2$ |
| Bleaching | 6 min | 38° C. | 12 L | 220 mL/m$^2$ |
| Fixing | 4 min | 38° C. | 8 L | 1,100 mL/m$^2$ |
| 2nd washing | 4 min | 38° C. | 35 L | 4,000 mL/m$^2$ |
| Final rinsing | 1 min | 25° C. | 19 L | 1,100 mL/m$^2$ |

Emulsions A2 to F2 were prepared as in emulsions A1 to F1, respectively, used in the preparation of Sample 101, except that, among the sensitizing dyes used, the ratios of sensitizing dye S-2 were increased, and fine adjustments of performance were conducted. Emulsions A3 to F3 were prepared as in emulsions A1 to F1, respectively, except that the ratios of sensitizing dye S-3 in emulsions A1 to F1 were increased and fine adjustments of performance were conducted. Emulsions A4 to F4 were prepared in the same manner as in emulsions A2 to F2, except that the ratios of S-2 were increased. Emulsions A5 to F5 were prepared in the same manner as in emulsions A4 to F4, except that the addition method of S-3 was altered. The characteristics of the spectral sensitization of these emulsions are set froth in Tables 3 to 6. Samples 102 to 105 were prepared by using respective emulsions as shown in Table 7.

TABLE 3

Spectral sensitization of emulsions A1 to F1 and G to Q

| Emulsion | Spectral sensitizing dye added | Addition amount per mol of silver halide (g) | Timing at which the sensitizing dye was added |
|---|---|---|---|
| A1 | S-1 | 0.82 | Subsequent to after-ripening |
| | S-2 | 0.08 | Subsequent to after-ripening |
| | S-3 | 0.10 | Subsequent to after-ripening |
| B1 | S-1 | 0.75 | Prior to after-ripening |
| | S-2 | 0.15 | Prior to after-ripening |
| | S-3 | 0.05 | Prior to after-ripening |
| C1 | S-1 | 0.70 | Prior to after-ripening |
| | S-2 | 0.10 | Prior to after-ripening |
| | S-3 | 0.07 | Prior to after-ripening |
| D1 | S-1 | 0.77 | Prior to after-ripening |
| | S-2 | 0.08 | Prior to after-ripening |
| | S-3 | 0.10 | Prior to after-ripening |
| E1 | S-1 | 0.90 | Prior to after-ripening |
| | S-2 | 0.15 | Prior to after-ripening |
| | S-3 | 0.15 | Prior to after-ripening |
| F1 | S-1 | 1.05 | Prior to after-ripening |
| | S-2 | 0.15 | Prior to after-ripening |
| | S-3 | 0.15 | Prior to after-ripening |
| G | S-4 | 0.65 | Subsequent to after-ripening |
| | S-5 | 0.10 | Subsequent to after-ripening |
| H | S-4 | 0.60 | Subsequent to after-ripening |
| | S-5 | 0.10 | Subsequent to after-ripening |
| I | S-4 | 0.70 | Prior to after-ripening |
| | S-5 | 0.10 | Prior to after-ripening |
| J | S-4 | 0.80 | Prior to after-ripening |
| | S-5 | 0.10 | Prior to after-ripening |
| K | S-4 | 0.80 | Prior to after-ripening |
| | S-5 | 0.15 | Prior to after-ripening |
| L, M | S-6 | 0.10 | Subsequent to after-ripening |
| | S-7 | 0.10 | Subsequent to after-ripening |
| | S-8 | 0.50 | Subsequent to after-ripening |
| N | S-6 | 0.10 | Subsequent to after-ripening |
| | S-7 | 0.15 | Subsequent to after-ripening |
| | S-8 | 0.55 | Subsequent to after-ripening |
| O | S-7 | 0.20 | Subsequent to after-ripening |
| | S-8 | 0.65 | Subsequent to after-ripening |
| P | S-6 | 0.06 | Subsequent to after-ripening |
| | S-7 | 0.15 | Subsequent to after-ripening |
| | S-8 | 0.70 | Subsequent to after-ripening |
| Q | S-6 | 0.05 | Prior to after-ripening |
| | S-7 | 0.15 | Prior to after-ripening |
| | S-8 | 0.80 | Prior to after-ripening |

TABLE 4

Spectral sensitization of emulsions A2 to F2

| Emulsion | Spectral sensitizing dye added | Addition amount per mol of silver halide (g) | Timing at which the sensitizing dye was added |
|---|---|---|---|
| A2 | S-1 | 0.75 | Subsequent to after-ripening |
| | S-2 | 0.15 | Subsequent to after-ripening |
| | S-3 | 0.10 | Subsequent to after-ripening |
| B2 | S-1 | 0.60 | Prior to after-ripening |
| | S-2 | 0.30 | Prior to after-ripening |
| | S-3 | 0.05 | Prior to after-ripening |
| C2 | S-1 | 0.60 | Prior to after-ripening |
| | S-2 | 0.20 | Prior to after-ripening |
| | S-3 | 0.07 | Prior to after-ripening |

TABLE 4-continued

Spectral sensitization of emulsions A2 to F2

| Emulsion | Spectral sensitizing dye added | Addition amount per mol of silver halide (g) | Timing at which the sensitizing dye was added |
|---|---|---|---|
| D2 | S-1 | 0.70 | Prior to after-ripening |
| | S-2 | 0.15 | Prior to after-ripening |
| | S-3 | 0.10 | Prior to after-ripening |
| E2 | S-1 | 0.75 | Prior to after-ripening |
| | S-2 | 0.30 | Prior to after-ripening |
| | S-3 | 0.15 | Prior to after-ripening |
| F2 | S-1 | 0.90 | Prior to after-ripening |
| | S-2 | 0.30 | Prior to after-ripening |
| | S-3 | 0.15 | Prior to after-ripening |

TABLE 5

Spectral sensitization of emulsions A3 to F3

| Emulsion | Spectral sensitizing dye added | Addition amount per mol of silver halide (g) | Timing at which the sensitizing dye was added |
|---|---|---|---|
| A3 | S-1 | 0.82 | Subsequent to after-ripening |
| | S-2 | 0.05 | Subsequent to after-ripening |
| | S-3 | 0.13 | Subsequent to after-ripening |
| B3 | S-1 | 0.75 | Prior to after-ripening |
| | S-2 | 0.05 | Prior to after-ripening |
| | S-3 | 0.20 | Prior to after-ripening |
| C3 | S-1 | 0.70 | Prior to after-ripening |
| | S-2 | 0.05 | Prior to after-ripening |
| | S-3 | 0.12 | Prior to after-ripening |
| D3 | S-1 | 0.77 | Prior to after-ripening |
| | S-2 | 0.05 | Prior to after-ripening |
| | S-3 | 0.13 | Prior to after-ripening |
| E3 | S-1 | 0.90 | Prior to after-ripening |
| | S-2 | 0.05 | Prior to after-ripening |
| | S-3 | 0.25 | Prior to after-ripening |
| F3 | S-1 | 1.05 | Prior to after-ripening |
| | S-2 | 0.05 | Prior to after-ripening |
| | S-3 | 0.25 | Prior to after-ripening |

TABLE 6

Spectral sensitization of emulsionsA4 to F4 and A5 to F5

| Emulsion | Spectral sensitizing dye added | Addition amount per mol of silver halide (g) | Timing at which the sensitizing dye was added |
|---|---|---|---|
| A4, A5 | S-1 | 0.67 | Subsequent to after-ripening |
| | S-2 | 0.13 | Subsequent to after-ripening |
| | S-3 | 0.20 | Subsequent to after-ripening |
| B4, B5 | S-1 | 0.53 | Prior to after-ripening |
| | S-2 | 0.27 | Prior to after-ripening |
| | S-3 | 0.15 | Prior to after-ripening |
| C4, C5 | S-1 | 0.54 | Prior to after-ripening |
| | S-2 | 0.18 | Prior to after-ripening |
| | S-3 | 0.15 | Prior to after-ripening |
| D4, D5 | S-1 | 0.62 | Prior to after-ripening |
| | S-2 | 0.13 | Prior to after-ripening |
| | S-3 | 0.20 | Prior to after-ripening |
| E4, E5 | S-1 | 0.68 | Prior to after-ripening |
| | S-2 | 0.27 | Prior to after-ripening |
| | S-3 | 0.25 | Prior to after-ripening |
| F4, F5 | S-1 | 0.79 | Prior to after-ripening |
| | S-2 | 0.26 | Prior to after-ripening |
| | S-3 | 0.30 | Prior to after-ripening |

Preparation of Samples 106–110

In the preparation of samples 101–105, interimage effect-donating layers and a color mixing-preventing layer (IIE-1 to IIE-3 layers and ML layer) as shown below were disposed respectively in a form such that IIE-1, IIE-2 and ML layers were disposed between the third layer and the fourth layer in this order from the side nearer from the support, and that IIE-3 layer was disposed between the 12th layer and the 13th layer, to prepare samples 106–110, respectively.

Preparation of Samples 111 to 120

In the preparation of samples 101–110, by replacing compound C-1 used in the forth and fifth layers by C-3, removing C-1 used in the sixth layer, changing couplers C-4 and C-5 used in the ninth and tenth layers to C-6, replacing C-4 and C-5 in the 11th layer by C-7, removing C-10 in the 14th to 16th layers and carrying out adjustment so that densities of yellow, magenta and cyan became around equal coloring density, samples 111 to 120 were prepared, respectively. Table 7 shows details of emulsion construction in the fourth to sixth layers of the prepared samples 101 to 120.

TABLE 7

Emulsion construction and maximum sensitivity wavelength of Samples 101–120

| Sample | Emulsion in 4th layer | Emulsion in 5th layer | Emulsion in 6th layer | Maximum sensitivity wavelength of red-sensitive layer unit |
|---|---|---|---|---|
| 101, 111 | A1, B1, C1 | C1, D1 | E1, F1 | 660 |
| 102, 112 | A2, B2, C2 | C2, D2 | E2, F2 | 640 |
| 103, 113 | A3, B3, C3 | C3, D3 | E3, F3 | 665 |
| 104, 114 | A4, B4, C4 | C4, D4 | E4, F4 | 645 |
| 105, 115 | A5, B5, C5 | C5, D5 | E5, F5 | 644 |
| 106, 116 | A1, B1, C1 | C1, D1 | E1, F1 | 660 |
| 107, 117 | A2, B2, C2 | C2, D2 | E2, F2 | 640 |
| 108, 118 | A3, B3, C3 | C3, D3 | E3, F3 | 665 |
| 109, 119 | A4, B4, C4 | C4, D4 | E4, F4 | 645 |
| 110, 120 | A5, B5, C5 | C5, D5 | E5, F5 | 644 |

IIE-1 Layer: Light-sensitive Emulsion Layer

| | | |
|---|---|---|
| Emulsion R | silver amount | 0.20 g |
| Emulsion S | silver amount | 0.10 g |
| Fine grain silver iodide grains (average equivalent-sphere diameter 0.05 μm, cube) | silver amount | 0.050 g |
| Gelatin | | 0.5 g |
| Compound Cpd-F | | 0.030 g |
| High-boiling organic solvent Oil-6 | | 0.010 g |

IIE-2 Layer: Light-sensitive Emulsion Layer

| | | |
|---|---|---|
| Emulsion U | silver amount | 0.20 g |
| Gelatin | | 0.4 g |
| ML layer: intermediate layer | | |
| Gelatin | | 1.50 g |
| Compound Cpd-M | | 0.10 g |
| Compound Cpd-D | | 0.010 g |
| Compound Cpd-K | | 3.0 mg |
| Compound Cpd-O | | 3.0 mg |
| Compound Cpd-T | | 5.0 mg |
| Ultraviolet absorbing agent U-6 | | 0.010 g |
| High-boiling organic solvent Oil-6 | | 0.10 g |
| High-boiling organic solvent Oil-3 | | 0.010 g |
| High-boiling organic solvent Oil-4 | | 0.010 g |
| IIE-3 layer: light-sensitive emulsion layer | | |
| Emulsion T | silver amount | 0.15 g |
| Gelatin | | 0.40 g |
| Coupler C-1 | | 5.0 mg |
| Coupler C-2 | | 0.5 mg |
| High-boiling organic solvent Oil-5 | | 2.0 mg |
| Compound Cpd-Q | | 0.20 g |
| dye D-6 | | 2.0 mg |

The characteristics of used emulsions R to T are listed together in Tables 8 and 9. Characteristics of prepared samples 101 to 120 were as listed in Table 10.

TABLE 8

Characteristics of emulsions used in interimage effect-donating layers of samples 106–110

Silver iodobromide emulsion newly used for the preparation of Samples 106–110

| Emulsion | Characteristics | Av. ESD (μm) | COV (%) | Av. AgI content (mol %) | Structure in halide composition of silver halide grains | Average AgI content at grain surface (mol %) | Other characteristics (1) | (2) | (3) | (4) | (5) |
|---|---|---|---|---|---|---|---|---|---|---|---|
| R | Monodisperse (111) tabular grains Av. aspect ratio 5.0 | 0.40 | 15 | 8.0 | Quadruple structure | 4.0 | ○ | ○ | | | ○ |
| S | Monodisperse (111) tabular grains Av. aspect ratio 4.0 | 0.70 | 13 | 12.5 | Quadruple structure | 3.0 | | ○ | ○ | | ○ |
| T | Monodisperse (111) tabular grains Av. aspect ratio 4.0 | 0.45 | 13 | 10.5 | Quadruple structure | 2.8 | ○ | ○ | | | ○ |

TABLE 8-continued

Characteristics of emulsions used in interimage effect-donating layers of samples 106–110

Silver iodobromide emulsion newly used for the preparation of Samples 106–110

| Emulsion | Characteristics | Av. ESD (μm) | COV (%) | Av. AgI content (mol %) | Structure in halide composition of silver halide grains | Average AgI content at grain surface (mol %) | Other characteristics (1) | (2) | (3) | (4) | (5) |
|---|---|---|---|---|---|---|---|---|---|---|---|
| U | Monodisperse (111) tabular grains Av. aspect ratio 4.0 | 0.55 | 15 | 12.5 | Triple structure | 1.5 | | ○ | ○ | | ○ |

Av. ESD = Equivalent-sphere average grain size; COV = Coefficient of variation
(Other characteristics)
The mark "○" means each of the conditions set forth below is satisfied.
(1) A reduction sensitizer was added during grain formation.
(2) A selenium sensitizer was used as an after-ripening agent.
(3) A rhodium salt was added during grain formation.
(4) A shell was provided subsequent to after-ripening by using silver nitrate in an amount of 10%, in terms of silver molar ratio, of the emulsion grains at that time, together with the equimolar amount of potassium bromide
(5) The presence of dislocation lines in an average number of ten or more per grain was observed by a transmission electron microscope.
Note that all the lightsensitive emulsions were after-ripped by the use of sodium thiosulfate, potassium thiocyanate, and sodium aurichloride. Note, also, a iridium salt was added during grain formation.
Note, also, that chemically-modified gelatin whose amino groups were partially converted to phthalic acid amide, was added to emulsions R, S, and T.

TABLE 9

Spectral sensitization of emulsions R to U

| Emulsion | Spectral sensitizing dye added | Addition amount per mol of silver halide (g) | Timing at which the sensitizing dye was added |
|---|---|---|---|
| R | S-4 | 0.40 | Subsequent to after-ripening |
| | S-6 | 0.30 | Subsequent to after-ripening |
| S | S-4 | 0.40 | Subsequent to after-ripening |
| | S-6 | 0.30 | Subsequent to after-ripening |

TABLE 9-continued

Spectral sensitization of emulsions R to U

| Emulsion | Spectral sensitizing dye added | Addition amount per mol of silver halide (g) | Timing at which the sensitizing dye was added |
|---|---|---|---|
| T | S-7 | 0.05 | Prior to after-ripening |
| | S-8 | 0.60 | Prior to after-ripening |
| U | S-1 | 0.60 | Prior to after-ripening |
| | S-3 | 0.30 | Prior to after-ripening |

TABLE 10

Performance characteristics of Samples 101–120

| Sample | | λrmax | IIE-donating layer | Sr(610)/Sr(λ rmax) | Sr(680)/Sr(λ rmax) | Sr(690)/Sr(λ rmax) |
|---|---|---|---|---|---|---|
| 101 | Comparison | 660 | None | 0.005 | 0.03 | 0.008 |
| 102 | Comparison | 640 | None | 0.037 | 0.01 | 0.006 |
| 103 | Comparison | 665 | None | 0.002 | 0.6 | 0.04 |
| 104 | Comparison | 645 | None | 0.034 | 0.5 | 0.03 |
| 105 | Comparison | 644 | None | 0.033 | 0.09 | 0.03 |
| 106 | Comparison | 660 | Present | 0.005 | 0.03 | 0.008 |
| 107 | Comparison | 640 | Present | 0.037 | 0.02 | 0.007 |
| 108 | Comparison | 665 | Present | 0.002 | 0.6 | 0.04 |
| 109 | Invention | 645 | Present | 0.034 | 0.5 | 0.03 |
| 110 | Invention | 644 | Present | 0.033 | 0.09 | 0.03 |
| 111 | Comparison | 660 | None | 0.005 | 0.03 | 0.008 |
| 112 | Comparison | 640 | None | 0.037 | 0.01 | 0.006 |
| 113 | Comparison | 665 | None | 0.002 | 0.6 | 0.04 |
| 114 | Comparison | 645 | None | 0.034 | 0.5 | 0.03 |
| 115 | Comparison | 644 | None | 0.033 | 0.09 | 0.03 |
| 116 | Comparison | 660 | Present | 0.005 | 0.03 | 0.008 |
| 117 | Comparison | 640 | Present | 0.037 | 0.02 | 0.007 |
| 118 | Comparison | 665 | Present | 0.002 | 0.6 | 0.04 |
| 119 | Invention | 645 | Present | 0.034 | 0.5 | 0.03 |
| 120 | Invention | 644 | Present | 0.033 | 0.09 | 0.03 |

(Evaluation of Samples)

The following evaluations were carried out for samples prepared as described above.

Photographs were taken by irradiating a color chart made by Macbeth with sunlight (color temperature was 5850K) or a fluorescent lamp with relative spectral distribution of a F10 three-wavelength region emission type defined in JIS Z8719, separately, followed by the color processing mentioned above. The tinge of the gray plate photographed with the fluorescent lamp at optical density of 0.7, was evaluated visually. Ten valuers carried out evaluation and graded the result by defining 10 as full points.

Further, sky at sunset was photographed and 10 experts evaluated tinge from the view point of color reproduction preferred as nature photography by defining 10 as full points.

Table 11 shows evaluation results of respective samples.

TABLE 11

Evaluation results of Samples 101–120

| Sample | | Evaluation results of saturation and color reproduction under fluorescent lamp: Point 1 | Remarks | Evaluation of sample on which sunset was photographed: Point 2 | Remarks | Total judgment (1 + 2)/2 |
|---|---|---|---|---|---|---|
| 101 | Comp. | 3 | Low saturation; Fog under fluorescent lamp present | 4 | Low saturation; Rather reddish evening glow | 3.5 |
| 102 | Comp. | 5 | Low saturation; Fog under fluorescent lamp reduced | 3 | Low saturation; Less reddish evening glow | 4.0 |
| 103 | Comp. | 3 | Low saturation; Fog under fluorescent lamp present | 6 | Low saturation; Tendency toward considerably reddish evening glow | 4.5 |
| 104 | Comp. | 6 | Low saturation; Fog under fluorescent lamp reduced | 6 | Low saturation; Tendency toward considerably reddish evening glow | 6.0 |
| 105 | Comp. | 5 | Low saturation; Fog under fluorescent lamp reduced | 5 | Low saturation; Tendency toward reddish evening glow | 5.0 |
| 106 | Comp. | 5 | Tendency toward high saturation, but fog under fluorescent lamp present | 6 | High saturation; Rather reddish evening glow | 6.0 |
| 107 | Comp. | 9.5 | Considerably high saturation; Faithful color hue and fog under fluorescent lamp reduced, which appear good | 4 | High saturation, but less reddish evening glow that causes a certain feeling of deficiency | 6.8 |
| 108 | Comp. | 4 | High saturation, but fog under fluorescent lamp present | 9 | Tendency toward high saturation; Strong tendency toward reddish evening glow | 6.5 |
| 109 | Inv. | 9 | Considerably high saturation, and fog under fluorescent lamp reduced, which appear good | 9.5 | High saturation; Preferable color reproduction of evening glow | 9.3 |
| 110 | Inv. | 9 | Considerably high saturation, and fog under fluorescent lamp reduced, which appear good | 9 | High saturation; Preferable color reproduction of evening glow | 9.0 |
| 111 | Comp. | 1 | Very low saturation; Fog under fluorescent lamp present | 2 | Very low saturation; Rather reddish evening glow | 1.5 |
| 112 | Comp. | 3 | Considerably low saturation; Fog under fluorescent lamp reduced | 1 | Very low saturation; Less reddish evening glow | 2.0 |
| 113 | Comp. | 1 | Very low saturation; Fog under fluorescent lamp present | 4 | Considerable low saturation; Tendency toward considerably reddish evening glow | 2.5 |
| 114 | Comp. | 4 | Considerably low saturation; Fog under fluorescent lamp reduced | 4 | Considerable low saturation; Tendency toward considerably reddish evening glow | 4.0 |
| 115 | Comp. | 3 | Considerably low saturation; Fog under fluorescent lamp reduced | 3 | Considerably low saturation; Tendency toward reddish evening glow | 3.0 |
| 116 | Comp. | 3 | Tendency toward high saturation, but fog under fluorescent lamp present | 4 | Tendency toward high saturation; Rather reddish evening glow | 4.0 |
| 117 | Comp. | 8 | High saturation; Tendency toward faithful hue, and fog under fluorescent lamp reduced, which appear good | 3 | Tendency toward high saturation, but a little reddish evening glow that causes a certain deficiency | 5.5 |
| 118 | Comp. | 3 | Tendency toward high saturation, but fog under fluorescent lamp present | 8.5 | Tendency toward high saturation; Strongly reddish evening glow | 5.8 |
| 119 | Inv. | 7.5 | Tendency toward high saturation, and fog under fluorescent lamp reduced, which appear good | 8 | High saturation, and preferable color reproduction of evening glow | 7.8 |
| 120 | Inv. | 7.5 | Tendency toward high saturation, and fog under fluorescent lamp reduced, which appear good | 7.5 | High saturation; Preferable color reproduction of evening glow | 7.5 |

Table 11 indicates that faithfulness in hue and high color saturation of photograph taken under a fluorescent lamp and the like can be compatible only after carrying out not only adjustment of spectral properties but also suitable emphasis of interimage effect. For example, Sample 117 is the most suitable structure only from the view points of high color saturation and faithful color reproduction. However, as can be seen from the evaluation result of photographing sunset, the structure alone is not satisfactory from the view point of achieving color reproduction preferred by nature photographers. It is understood that, only after forming the structure according to the invention such as that of Samples 119 and 120, it becomes possible to realize photosensitive material capable of satisfying both sides and provide silver halide photosensitive material greatly suitable for nature photography. Further, it is understood that, by using couplers represented by MC-I, CC-I and YC-I as the coupler and adopting the structure such as that of Samples 109 and 110, silver halide photosensitive material with further higher color saturation and suitable for nature photography can be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color reversal photosensitive material comprising at least one blue-sensitive emulsion layer unit containing a yellow color-forming coupler, at least one green-sensitive emulsion layer unit containing a magenta color-forming coupler and at least one red-sensitive emulsion layer unit containing a cyan color-forming coupler, on a transparent support, wherein the silver halide color reversal photosensitive material includes at least one interimage effect-donating layer that substantially forms no image;

the wavelength, λrmax, at which the maximum sensitivity of the spectral sensitivity distribution of the red-sensitive emulsion layer unit is given, satisfies the relation: 620 nm≦λmax≦680 nm;

the sensitivities of the red-sensitive emulsion layer unit satisfy the following relationships:

Sr (610) is ⅕ of Sr (λrmax) or more,

Sr (680) is {fraction (1/10)} of Sr (λrmax) or more, and/or

Sr (690) is {fraction (1/50)} of Sr (λrmax) or more wherein Sr (610), Sr (680) and Sr (690) are the sensitivities of the red-sensitive emulsion layer unit at 610 nm, 680 nm and 690 nm, respectively, and Sr (λmax) is the maximum sensitivity at λrmax and at least one of the yellow color-forming couplers is represented by the following general formula (YC-I):

(YC-I)

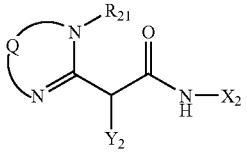

wherein Q represents a residue forming a nitrogen-containing 6-membered ring with —N—C═N— moiety; $R_{21}$ represents an alkyl group having 7 carbon atoms or more wherein $R_{21}$ may be substituted by another substituent; $X_2$ represents an aryl group; and $Y_2$ represents a hydrogen atom or a group capable of splitting off by a coupling reaction with an oxidized aromatic primary amine color developing agent.

2. The silver halide color reversal photosensitive material according to claim 1, wherein the silver halide color reversal photosensitive material comprising at least one coupler selected from the group consisting of magenta couplers represented by the following general formula (MC-I) and cyan couplers represented by the general formula (CC-I); and each of the magenta couplers represented by the general formula (MC-I) and cyan couplers represented by the general formula (CC-I) occupies from 30 mol % to 100 mol % of image-forming couplers contained in the blue-sensitive emulsion layer unit, the green-sensitive emulsion layer unit and the red-sensitive emulsion layer unit;

(MC-I)

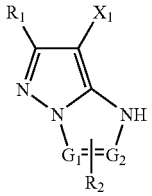

wherein $R_1$ represents a hydrogen atom or substituent; one of $G_1$ and $G_2$ represents a carbon atom, and the other represents a nitrogen atom; and $R_2$ represents a substituent that substitutes one of $G_1$ and $G_2$ which is a carbon atom, wherein $R_1$ and $R_2$ may further have a substituent, a polymer of the general formula (MC-I) may be formed via $R_1$ or $R_2$, or a polymer chain may be bonded via $R_1$ or $R_2$; and $X_1$ represents a hydrogen atom or a group that is capable of splitting off by a coupling reaction with an oxidized aromatic primary amine color developing agent;

(CC-I)

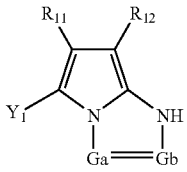

wherein Ga represents —C($R_{13}$)═ or —N═; Gb represents —C($R_{13}$)═ when Ga represents —N═, or Gb represents —N═ when Ga represents —C($R_{13}$)═; each of $R_{11}$ and $R_{12}$ is an electron-withdrawing group with a Hammett substituent constant σp value of 0.20 to 1.0; $R_{13}$ represents a substituent; and $Y_1$ represents a hydrogen atom or a group capable of splitting off by a coupling reaction with an oxidized aromatic primary amine color developing agent.

3. The silver halide color reversal photosensitive material according to claim 1, wherein the wavelength, λrmax, at which the maximum sensitivity of the spectral sensitivity distribution of the red-sensitive emulsion layer unit is given, satisfies the relation: 630 nm≦λrmax≦650 nm.

4. The silver halide color reversal photosensitive material according to claim 1, wherein the sensitivities of the red-sensitive emulsion layer unit satisfy the following relationships: Sr (610) is ⅓ of Sr (λrmax) or more, Sr (680) is ⅕ of Sr (λrmax) or more, and/or Sr (690) is {fraction (1/40)} of Sr (λrmax) or more.

5. The silver halide color reversal photosensitive material according to claim 1, wherein the interimage effect-donating layer contains a light-sensitive emulsion having a silver iodide content of 6 mol % or more.

6. The silver halide color reversal photosensitive material according to claim 1, wherein the interimage effect-donating layer contains two or more light-sensitive emulsions in combination, and the two or more light-sensitive emulsions have different speeds to each other.

7. The silver halide color reversal photosensitive material according to claim 1, wherein the interimage effect-donating layer contains a light-sensitive emulsion and a non-light-sensitive fine grain emulsion.

8. The silver halide color reversal photosensitive material according to claim 1, wherein the interimage effect-donating layer is an interimage effect-donating unit composed of two or more layers.

9. The silver halide color reversal photosensitive material according to claim 1, wherein the interimage effect-donating layer is one to donate interimage effect from the red-sensitive emulsion layer unit to the green-sensitive emulsion layer unit, or one to donate interimage effect from the green-sensitive emulsion layer unit to the blue-sensitive emulsion layer unit.

10. The silver halide color reversal photosensitive material according to claim 2, wherein the at least one coupler occupies from 70 mol % to 100 mol % of image-forming couplers contained in the blue-sensitive emulsion layer unit, the green-sensitive emulsion layer unit and the red-sensitive emulsion layer unit.

11. The silver halide color reversal photosensitive material according to claim 2, wherein the blue-sensitive emulsion layer unit contains at least one yellow coupler represented by the general formula (YC-I).

12. The silver halide color reversal photosensitive material according to claim 11, wherein the yellow coupler represented by the general formula (YC-I) occupied from 30 mol % to 100 mol % of image-forming coupler(s) contained in the blue-sensitive emulsion layer unit.

13. The silver halide color reversal photosensitive material according to claim 2, wherein the silver halide color reversal photosensitive material contains at least one each of the magenta coupler represented by the general formula (MC-I), the cyan coupler represented by the general formula (CC-I) and the yellow coupler represented by the general formula (YC-I).

14. The silver halide color reversal photosensitive material according to claim 13, wherein the magenta coupler represented by the general formula (MC-I) is contained in the green-sensitive emulsion layer unit in an amount of 30 mol % to 100 mol % of image-forming coupler(s) contained in the green sensitive emulsion layer unit, the cyan coupler represented by the general formula (CC-I) is contained in the red-sensitive emulsion layer unit in an amount of 30 mol % to 100 mol % of image-forming coupler(s) contained in the red-sensitive emulsion layer unit, and the yellow coupler represented by the general formula (YC-I) is contained in the blue-sensitive emulsion layer unit in an amount of 30 mol % to 100 mol % of image-forming coupler(s) contained in the blue sensitive emulsion layer unit.

15. The silver halide color reversal photosensitive material according to claim 1, wherein the silver halide color reversal photosensitive material comprising at least one coupler selected from the group consisting of magenta couplers represented by the following general formula (MC-I) and cyan couplers represented by the general formula (CC-I);

(MC-I)

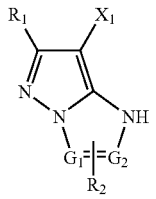

wherein $R_1$ represents a hydrogen atom or substituent; one of $G_1$ and $G_2$ represents a carbon atom, and the other represents a nitrogen atom; and $R_2$ represents a substituent that substitutes one of $G_1$ and $G_2$ which is a carbon atom, wherein $R_1$ and $R_2$ may further have a substituent, a polymer of the general formula (MC-I) may be formed via $R_1$ or $R_2$, or a polymer chain may be bonded via $R_1$ or $R_2$; and $X_1$ represents a hydrogen atom or a group that is capable of splitting off by a coupling reaction with an oxidized aromatic primary amine color developing agent;

(CC-I)

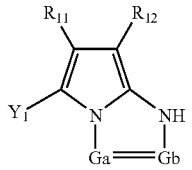

wherein Ga represents —C($R_{13}$)═ or —N═; Gb represents —C($R_{13}$)═ when Ga represents —N═, or Gb represents —N═ when Ga represents —C($R_{13}$)═; each of $R_{11}$ and $R_{12}$ is an electron-withdrawing group with a Hammett substituent constant σp value of 0.20 to 1.0; $R_{13}$ represents a substituent; and $Y_1$ represents a hydrogen atom or a group capable of splitting off by a coupling reaction with an oxidized aromatic primary amine color developing agent.

* * * * *